US008811833B2

(12) United States Patent
Adachi et al.

(10) Patent No.: US 8,811,833 B2
(45) Date of Patent: Aug. 19, 2014

(54) IMAGE FORMING APPARATUS

(75) Inventors: Motoki Adachi, Ashigarakami-gun (JP); Masanori Tanaka, Yokohama (JP); Hideo Kihara, Yokohama (JP); Takashi Mukai, Kawasaki (JP); Shinichi Agata, Suntou-gun (JP); Shuhei Kawasaki, Susono (JP); Yuji Kawaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 13/395,845

(22) PCT Filed: Oct. 18, 2010

(86) PCT No.: PCT/JP2010/068772

§ 371 (c)(1),
(2), (4) Date: Mar. 13, 2012

(87) PCT Pub. No.: WO2011/049219

PCT Pub. Date: Apr. 28, 2011

(65) Prior Publication Data

US 2012/0195611 A1 Aug. 2, 2012

(30) Foreign Application Priority Data

| | | |
|---|---|---|
| Oct. 22, 2009 | (JP) | 2009-243768 |
| Dec. 14, 2009 | (JP) | 2009-283456 |
| Dec. 24, 2009 | (JP) | 2009-292839 |
| Jan. 8, 2010 | (JP) | 2010-003027 |

(51) Int. Cl.
*G03G 15/08* (2006.01)

(52) U.S. Cl.
CPC ..... *G03G 15/086* (2013.01); *G03G 15/0856* (2013.01); *G03G 15/0831* (2013.01); *G03G 2215/0888* (2013.01)
USPC ..... 399/27; 399/53

(58) Field of Classification Search
CPC ..... G03G 15/086; G03G 15/0856; G03G 15/0831; G03G 2215/0888
USPC ..... 399/27, 53
See application file for complete search history.

(56) References Cited

U.S. PATENT DOCUMENTS

| | | | | |
|---|---|---|---|---|
| 7,912,390 | B2 * | 3/2011 | Mitsui | 399/61 |
| 2001/0043814 | A1 * | 11/2001 | Abe | 399/27 |

(Continued)

FOREIGN PATENT DOCUMENTS

| | | | |
|---|---|---|---|
| CN | 101334614 | A | 12/2008 |
| CN | 101334615 | A | 12/2008 |
| JP | 4-234777 | A | 8/1992 |
| JP | 2002-132038 | A | 5/2002 |
| JP | 2004-085901 | A | 3/2004 |

(Continued)

*Primary Examiner* — David Gray
*Assistant Examiner* — Tyler Hardman
(74) *Attorney, Agent, or Firm* — Canon USA, Inc., IP Division

(57) ABSTRACT

An image forming apparatus includes a developing device, a detection mode execution unit, and a notice signal generating unit. The developing device supplies a toner bearing member with toner in a container by rotating a toner supply member in a contact manner with the toner bearing member. The detection mode execution unit executes a detection mode in which a predetermined period for changing a toner amount in the foam layer by rotating the toner supply member is provided, a capacitance $C_1$ between the first and second electrode members is detected before the predetermined period, and a capacitance $C_2$ between the first and second electrode members is detected after the predetermined period. The notice signal generating unit generates a low toner amount notice signal in response to an absolute value $|C_1-C_2|$ of a difference between the capacitances $C_1$ and $C_2$ being smaller than a predetermined threshold.

30 Claims, 42 Drawing Sheets

(56) References Cited

U.S. PATENT DOCUMENTS

| | | | | |
|---|---|---|---|---|
| 2007/0206965 | A1* | 9/2007 | Namiki et al. | 399/27 |
| 2010/0303484 | A1* | 12/2010 | Hogan et al. | 399/35 |

FOREIGN PATENT DOCUMENTS

| | | | |
|---|---|---|---|
| JP | 2009-009035 | A | 1/2009 |
| JP | 2009-009036 | A | 1/2009 |

* cited by examiner

IMAGE FORMING APPARATUS

CROSS REFERENCE TO RELATED APPLICATIONS

This application is a National Stage filing of PCT application No. PCT/JP2010/068772, filed Oct. 18, 2010, which claims priority from Japanese Patent Application No. 2009-243768, filed Oct. 22, 2009, Japanese Patent Application No. 2009-283456, filed Dec. 14, 2009, Japanese Patent Application No. 2009-292839, filed Dec. 24, 2009, and Japanese Patent Application No. 2010-003027, filed Jan. 8, 2010, all of which are hereby incorporated by reference herein in their entirety.

TECHNICAL FIELD

The present invention relates to an image forming apparatus including a developing device having a toner bearing member and a toner supply member that supplies the toner bearing member with a toner, and more particularly to an image forming apparatus including a detection mechanism that detects a capacitance between an electrode member provided in the toner bearing member and an electrode member provided in the toner supply member.

BACKGROUND ART

A method for detecting a remaining toner amount in a developing device used in an image forming apparatus, such as an electrophotographic apparatus, may be a capacitance detection method that provides information relating to the remaining toner amount by detecting a capacitance between two electrodes provided in the developing device.

In particular, if a developing device including a development roller serving as a toner bearing member, and a supply roller having a foam layer serving as a toner supply member is used, the capacitance detection method may be a method that provides information relating to the remaining toner amount by detecting a capacitance between a shaft of the development roller and a shaft of the supply roller. The method is, for example, disclosed in Patent Literature 1. In this method, since the remaining toner amount of the developing device is correlated with the capacitance between the shafts, the remaining toner amount can be measured by detecting the capacitance.

When the image forming apparatus that measures the remaining toner amount by detecting the capacitance in the developing device is used, if temperature and humidity environment is changed, the capacitance may be changed. The measurement accuracy for the remaining toner amount may be degraded, and the image forming apparatus may not notify a user that the remaining toner amount is smaller than a predetermined amount or that a cartridge has to be replaced. To reduce the influence by the change in environment, for example, Patent Literature 2 discloses a technique that corrects timing of a notice by using a temperature sensor and a humidity sensor.

CITATION LIST

Patent Literature

PTL 1 Japanese Patent Laid-Open No. 2009-9035
PTL 2 Japanese Patent Laid-Open No. 2002-132038

SUMMARY OF INVENTION

Technical Problem

In the image forming apparatus configured to detect the capacitance between the electrode member provided in the toner bearing member and the electrode member provided in the toner supply member as described in Patent Literature 1, the capacitance is changed if the temperature and humidity environment is changed. Hence, the measurement accuracy for the remaining toner amount may be degraded, and the image forming apparatus may not notify a user that the remaining toner amount is smaller than the predetermined amount or that the cartridge has to be replaced. To reduce the influence by the change in environment, if the temperature sensor and the humidity sensor are provided as described in Patent Literature 2, the degree of freedom for design may be reduced because the arrangement may be limited by these sensors, and the cost may be increased.

Thus, the present invention provides an image forming apparatus that can notify a user with high accuracy that a remaining toner amount is smaller than a predetermined amount or that a cartridge has to be replaced, without a temperature sensor or a humidity sensor even if the temperature and humidity environment is changed.

Solution to Problem

An image forming apparatus according to a first aspect of the present invention includes a developing device including a container that has an opening and contains a toner, a toner bearing member arranged at the opening of the container, having a first electrode member, and supplying an electrostatic latent image with the toner by bearing and conveying the toner, and a toner supply member arranged in the container and having a second electrode member and a foam layer, the foam layer being provided around the second electrode member and sucking and discharging the toner, the developing device supplying the toner bearing member with the toner in the container by rotating the toner supply member in a contact manner with the toner bearing member; a detection mode execution unit configured to execute a detection mode in which a predetermined period for changing a toner amount in the foam layer by rotating the toner supply member is provided, a capacitance $C_1$ between the first and second electrode members is detected before the period, and a capacitance $C_2$ between the first and second electrode members is detected after the period; and a notice signal generating unit configured to generate a notice signal if an absolute value $|C_1-C_2|$ of a difference between the capacitances $C_1$ and $C_2$ is smaller than a predetermined threshold, the notice signal being indicative of that a toner amount in the container is smaller than a predetermined amount.

An image forming apparatus according to a second aspect of the present invention includes a developing device including a container that has an opening and contains a toner, a toner bearing member arranged at the opening of the container, having a first electrode member, and supplying an electrostatic latent image with the toner by bearing and conveying the toner, and a toner supply member arranged in the container and having a second electrode member and a foam layer, the foam layer being provided around the second electrode member and sucking and discharging the toner, the developing device supplying the toner bearing member with the toner in the container by rotating the toner supply member in a contact manner with the toner bearing member; a mount portion on which the developing device is mounted in a replaceable manner; a detection mode execution unit configured to execute a detection mode in which a predetermined period for changing a toner amount in the foam layer by rotating the toner supply member is provided, a capacitance $C_1$ between the first and second electrode members is detected before the period, and a capacitance $C_2$ between the first and second electrode members is detected after the period; and a notice signal generating unit configured to generate a notice signal if an absolute value $|C_1-C_2|$ of a difference between the capacitances $C_1$ and $C_2$ is smaller than a predetermined threshold, the notice signal promoting replacement of the developing device.

Advantageous Effects of Invention

The image forming apparatus can be provided, the apparatus which can notify a user with high accuracy that the remaining toner amount is smaller than the predetermined amount or that the cartridge has to be replaced, without the temperature sensor or the humidity sensor even if the temperature and humidity environment is changed.

DESCRIPTION OF EMBODIMENTS

First Embodiment

Bias

A first embodiment of the present invention will be described below with reference to the drawings. However, dimensions, materials, shapes, and relative arrangements of components described in the embodiment may be properly changed in accordance with a configuration to which the present invention is applied or various conditions. The embodiment does not intend to limit the scope of the present invention.

Figure 1:
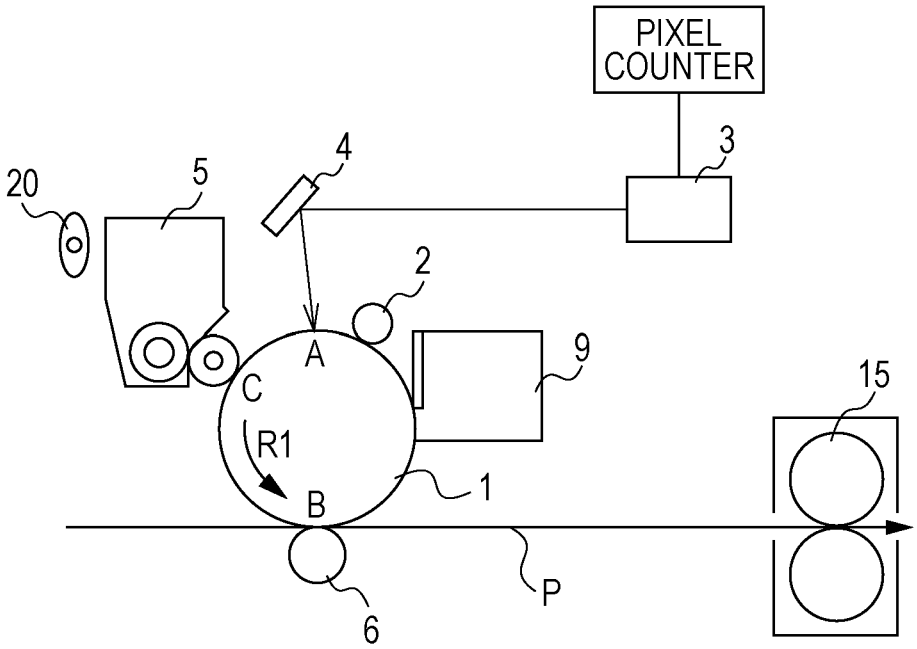
FIG. 1 is a configuration diagram schematically showing an exemplary image forming apparatus according to a first embodiment.

FIG. 1 illustrates an image forming apparatus according to a first embodiment. A photosensitive drum 1 serves as an image bearing member. The photosensitive drum 1 rotates in a direction R1. Reference sign 2 denotes a charging roller, 3 is an exposure device, and 4 is a reflection mirror. A laser beam emitted from the exposure device 3 is reflected by the reflection mirror 4 and then reaches an exposure position A on the photosensitive drum 1. A developing device 5 contains a black toner having a normal charge polarity (which is a charge polarity for developing an electrostatic latent image, and is negative because an electrostatic latent image with a negative polarity is reversely developed). A transfer roller 6 is arranged below the photosensitive drum 1. A transfer material P after transferring is conveyed to a fixing unit 15. A cleaning device 9 is provided downstream a transfer position in a moving direction of the photosensitive drum 1. The cleaning device 9 includes a blade being in contact with the photosensitive drum 1 so that the blade scrapes a toner on the photosensitive drum 1.

Image formation by the image forming apparatus will be described. A controller 70 collectively controls the image formation in accordance with a predetermined control program and a reference table as follows. First, the charging roller 2 causes the surface of the photosensitive drum 1 to be charged by a predetermined potential while the photosensitive drum 1 is rotated at 100 mm/sec in the direction R1. An electrostatic latent image is formed on the photosensitive drum 1 at the exposure position A by a laser beam emitted by the exposure devise 3 and reflected by the reflection mirror 4 in accordance with an image signal for each color. The formed electrostatic latent image is developed by the developing device 5 at a development position C. Thus, a toner image is formed. The toner image formed on the photosensitive drum 1 is transferred on the transfer material P at a transfer position B. The transfer material P with the toner image transferred thereon is conveyed to the fixing unit 15. The fixing unit 15 applies pressure and heat to the toner image on the transfer material P to fix the toner image to the transfer material P. Thus, a final image is obtained.

The developing device 5 will be described in detail below with reference to FIG. 2. The developing device 5 includes a cartridge (container) 21 that contains a toner T, a development roller 25 serving as a toner bearing member that is arranged at an opening of the cartridge 21 and is rotatable, a restriction blade 27 serving as a toner restriction member, and a supply roller 24 serving as a toner supply member that is provided in the cartridge 21 in a contact manner with the development roller 25, supplies the development roller 25 with the toner T, and is rotatable.

The development roller 25 rotates while being in contact with the photosensitive drum 1 during developing. A driving force is transmitted from a drive-P 60 serving as a first drive and provided in the apparatus body of the image forming apparatus, to the development roller 25 and the supply roller 24. Hence, the development roller 25 and the supply roller 24 are synchronously rotated and stopped. After developing, a cam 20 provided in the apparatus body of the image forming apparatus rotates and pushes an upper portion of the cartridge 21. The cartridge 21 rotates around a swing center axis 30, and the development roller 25 is separated from the photosensitive drum 1. After the separation, the drive-P 60 stops the rotation.

The development roller 25 includes a conductive shaft 25*a* and a conductive elastic layer 25*b*. The conductive shaft 25*a* serves as a first electrode member made of, for example, stainless steel or an aluminum alloy, and has a diameter of ϕ8 mm. The conductive elastic layer 25*b* is formed around the shaft 25*a* and has a base layer made of silicone rubber. The development roller 25 has a surface layer coated with an acrylic urethane rubber layer. The development roller 25 has an outer diameter of ϕ13 mm, and a volume resistivity of about 10E5 Ω·cm. During developing, the development roller 25 is supported by the cartridge 21 such that the development roller 25 contacts the photosensitive drum 1 at the development position C and is rotated in a direction R4 in FIG. 2. The rotation speed (peripheral speed) of the development roller 25 is 160 mm/sec during the image formation. While the development roller 25 is in contact with the photosensitive drum 1, a direct-current (DC) voltage can be applied from a direct-current (DC) power supply 90 serving as a voltage applying unit, to the shaft 25*a*. As long as the development roller 25 includes the first electrode member for detecting a capacitance (described later), for example, a conductive sleeve may be provided on the surface of the development roller 25, and the sleeve may serve as the first electrode member.

The supply roller 24 includes a conductive shaft 24*a* and a urethane spongy layer 24*b*. The conductive shaft 24*a* serves as a second electrode member made of, for example, stainless steel or an aluminum alloy, and has a diameter of ϕ6 mm. The urethane spongy layer 24*b* is formed around the shaft 24*a*, and is a foam layer made of a soft open-cell foam material. The supply roller 24 has an outer diameter of ϕ15 mm, and a volume resistivity of about 10E8 Ω·cm. In this embodiment, a distance between the center of the shaft 25*a* of the development roller 25 and the center of the shaft 24*a* of the supply roller 24 (hereinafter, referred to as a center distance) is 13 mm. The development roller 25 and the supply roller 24 are arranged such that the surface of the development roller 25 pushes the urethane spongy layer 24*b* of the supply roller 24 by an entering distance of about 1.0 mm. The entering distance is a distance obtained by dividing the sum of the outer diameter of the supply roller 24 and the outer diameter of the development roller 25 by two and then subtracting the center distance from the obtained value.

Figure 2:
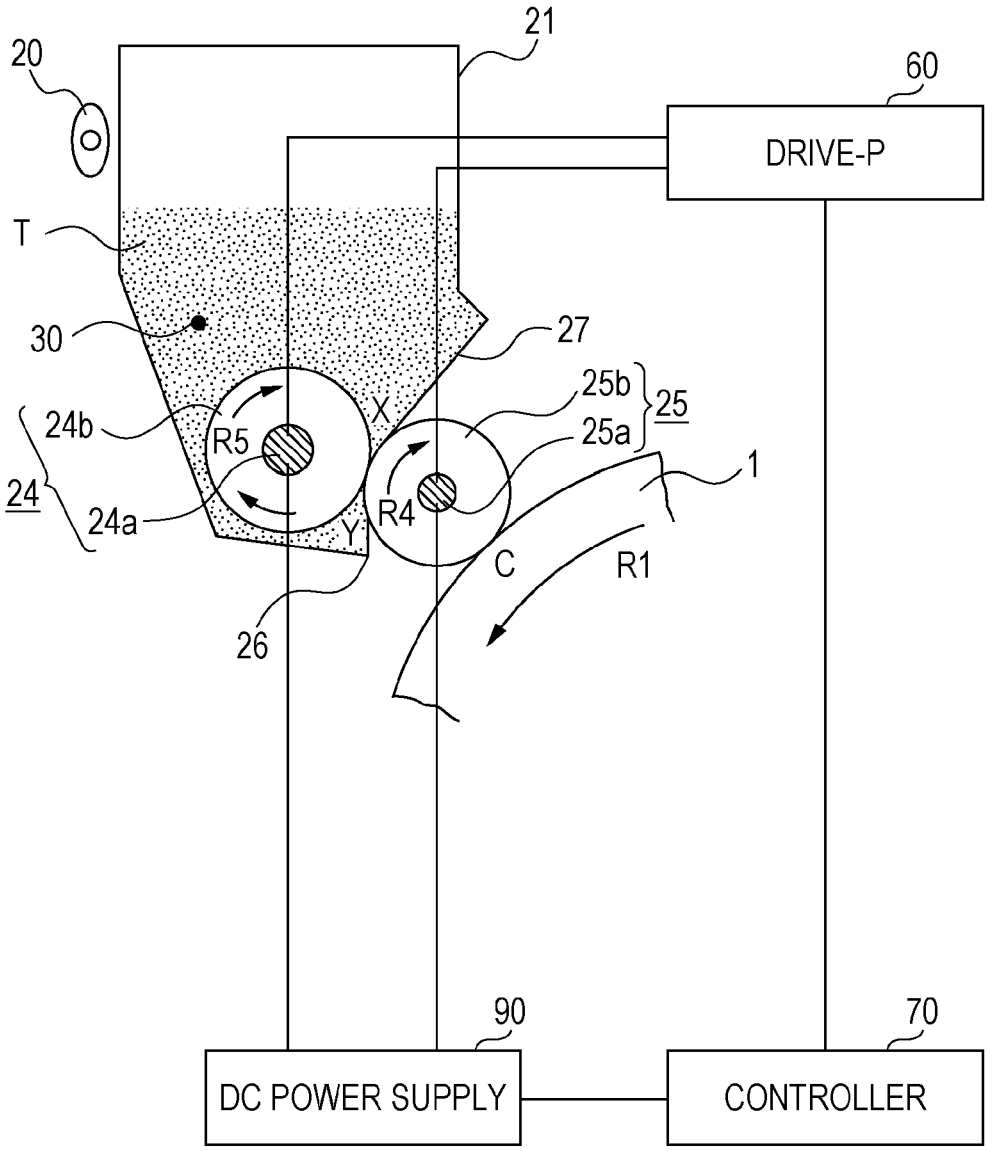
FIG. 2 is a configuration diagram schematically showing a developing device during image formation according to the first embodiment.

The supply roller 24 is supported by the cartridge 21 such that the supply roller 24 can be rotated in a direction R5 in FIG. 2. The rotation speed (peripheral speed) of the supply roller 24 is 140 mm/sec during the image formation. While the development roller 25 is in contact with the photosensitive drum 1, the DC voltage can be applied from the DC power supply 90 serving as the voltage applying unit, to the second electrode member. Although described later, the DC voltage applied to the supply roller 24 may be changed to one of a plurality of steps. The DC voltage applied to the supply roller 24 is controlled by a voltage control unit (not shown) provided in the apparatus body. The DC voltage is changed at desirable timing.

The restriction blade 27 is formed of a flexible phosphor bronze sheet. The restriction blade 27 has an end fixed to the cartridge 21 and the other end that is a free end. The restriction blade 27 contacts the development roller 25. The restriction blade 27 is arranged such that a flat smooth surface located near the free end slides on the surface of the development roller 25 in an opposite direction to a rotating direction of the development roller 25.

Figure 17:
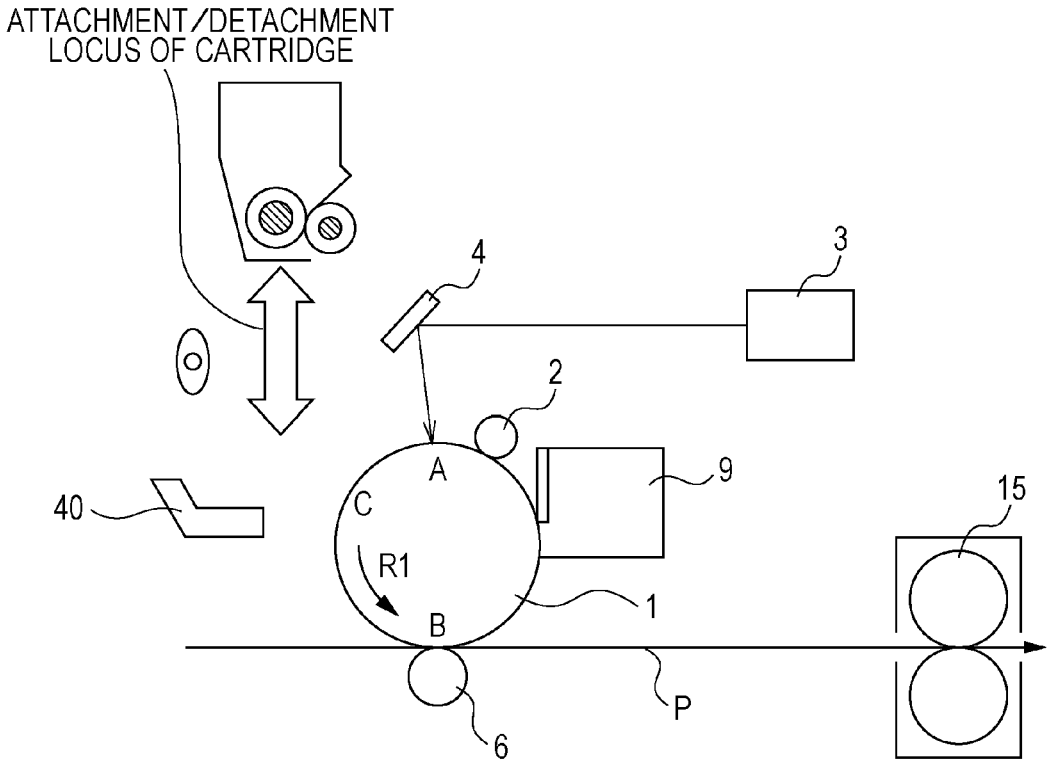
FIG. 17 illustrates that a developing device is mounted on an apparatus body of the image forming apparatus in a replaceable manner.

Also, a leakage prevention seal 26 is provided to seal a gap between the development roller 25 and the cartridge 21. Further, referring to FIG. 17, the developing device 5 is mounted on a mount portion 40 in a replaceable manner.

Described next are the behavior of the urethane spongy layer 24*b* of the supply roller 24 and the behavior of the toner around the urethane spongy layer 24*b* when the supply roller 24 and the development roller 25 are rotated at predetermined speeds. The urethane spongy layer 24*b* of the supply roller 24 is compressed in a region (portion X in FIG. 2) located upstream a contact position, at which the supply roller 24 contacts the development roller 25, in a rotating direction of the supply roller 24, and decompressed in a region (portion Y in FIG. 2) located downstream the contact position in the rotating direction. Since the supply roller 24 is compressed in the portion X, the toner sucked into the supply roller 24 is discharged together with the air.

In contrast, since the supply roller 24 is released from the compressed state and is restored to the original shape in the portion Y, the toner dispersed into the air is sucked into the supply roller 24. The toner can be smoothly sucked into and discharged from the urethane spongy layer 24*b*. Thus, the pressure of the toner as powder accumulated in the portion near the supply roller 24 and the pressure of the toner as powder in the supply roller 24 are balanced. The toner amount held in the supply roller 24 is correlated with the total toner amount in the cartridge 21. Hence, the capacitance between the shaft 24*a* of the supply roller 24 and the shaft 25*a* of the development roller 25 indicates the toner amount held in the supply roller 24 and also expects the total toner amount in the cartridge 21 (see Patent Literature 1). The toner is sucked and discharged mainly when the supply roller 24 is rotated. The supply roller 24 after the rotation is stopped holds the toner amount obtained by the rotation. Even if the developing device 5 is moved or the posture thereof is changed in this state, the toner amount held in the supply roller 24 is not substantially changed, and the change is negligible.

Next, a method for measuring the remaining toner amount of the developing device 5 according to this embodiment will be described. In this embodiment, if the remaining toner amount is large, a pixel counting unit (pixel counter) that can count the number of pixels (pixel count) of light emitted by the exposure device 3 is used to roughly estimate a toner use amount (hereinafter, this method is referred to as a pixel count method). The toner amount required for developing a certain image is substantially proportional to the number of pixels (pixel count) of light emitted by the exposure device 3. Hence, in the pixel count method, a toner use amount per pixel count is stored in a memory in the apparatus body, and a total toner use amount is estimated by using an integrated value of the stored value and the number of pixels (pixel count) counted by the pixel counter. The integrated value is stored in a memory provided in the developing device 5.

If the remaining toner amount becomes relatively small, a high accuracy detection mode (described later) using a capacitance is executed to accurately detect the run out timing of the toner, and the replacement timing of the developing device 5. The "run out of toner" does not indicates a state in which the toner does not remain in the developing device 5 at all, but indicates a state in which the toner remains by an amount having a difficulty in maintaining the desired level of an image quality. Hereinafter, it is assumed that the wordings "run out of toner" have the meaning as described above.

A flow for measuring the remaining toner amount will be described in detail below with reference to FIG. 3.

In a standby state (S000), when image formation is started (S001), the number of pixels is counted (measurement for the pixel count is performed) (S002). When the image formation is ended, the counted numbers of pixels (measured pixel counts) are integrated, and hence a pixel count integrated value Pcount is calculated (S003). Then, it is determined whether the integrated value Pcount reaches a predetermined value Pth (S004). If the integrated value Pcount reaches the predetermined value Pth, a remaining toner amount measurement sequence (high accuracy detection mode) using the capacitance is started (S005). If the integrated value Pcount does not reach the predetermined value Pth, the normal image formation is continued until Pcount becomes equal to or larger than Pth (S006).

In this embodiment, when the predetermined value Pth is an integrated value that is 20% smaller than a pixel count integrated value P0% expected to be obtained when the toner is run out (see Expression 1), the first execution timing for the high accuracy detection mode is determined as follows:

$$Pth = P0\% \times 0.8 \quad (1).$$

The first execution timing for the high accuracy detection mode is determined when the remaining toner amount is larger than the remaining toner amount when the toner is run out by the following reason. The remaining toner amount estimated by the pixel counts may be fluctuated due to variation of the toner use amount. The high accuracy detection mode has to be reliably executed by taking into account the variation so that an image with a low density or an image with an unprinted portion is not generated. Therefore, the high accuracy detection mode is executed at timing slightly earlier than the run out timing of the toner estimated by using the pixel counts.

After the first high accuracy detection mode is executed, Pth is calculated again by a calculating method (described later), and when the integrated value Pcount reaches the predetermined value Pth that is newly set, the next high accuracy detection mode is executed. Accordingly, the run out of the toner can be detected by executing the high accuracy detection mode a few number of times.

In this embodiment, the pixel count method is used in order to roughly estimate the remaining toner amount in a short time when the remaining toner amount is large. To accurately detect the run out timing of the toner and the replacement timing of the developing device, required herein is that the high accuracy detection mode is executed. The pixel count method may not be used. For example, the high accuracy detection mode may be executed every time when the image formation is performed for a predetermined number of sheets. Alternatively, the start timing of the high accuracy detection mode may be determined by another method for measuring the remaining toner amount.

Figure 4:
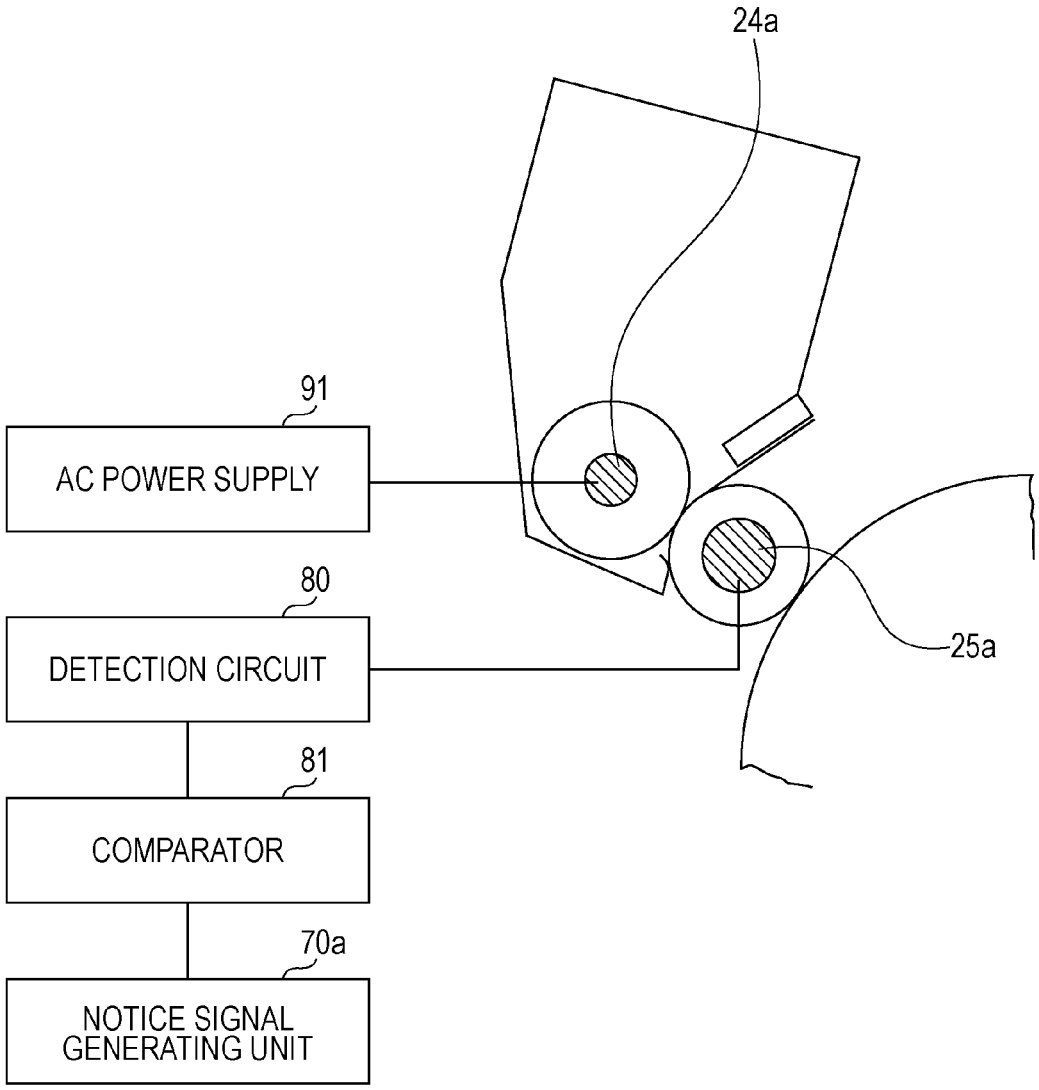
FIG. 4 is a block diagram showing a remaining toner amount measuring device according to the first embodiment.

A method for measuring a capacitance, the method which is required for executing the high accuracy detection mode, will be described below. Referring to FIG. 4, a predetermined alternating-current (AC) voltage is applied from an alternating-current (AC) power supply 91 to the shaft 24*a* (second electrode member) of the supply roller 24, and by using a voltage induced at the shaft 25*a* (first electrode member) of the development roller 25, a capacitance between the shaft 24*a* and the shaft 25*a* is detected.

(Alternatively, an AC voltage may be applied to the shaft 25*a* and the remaining toner amount may be measured by using a voltage induced at the shaft 24*a*. However, since the development roller 25 faces the photosensitive drum 1, if the AC voltage is applied to the shaft 25*a*, the toner may adhere to the photosensitive drum 1. In contrast, since the supply roller 24 does not face the photosensitive drum 1, it is desirable to apply the AC voltage to the supply roller 24 because the toner hardly adheres to the photosensitive drum 1.) The capacitance is detected when the development roller 25 is separated from the photosensitive drum 1 and the rotation of the development roller 25 is stopped.

Accordingly, the influence of the photosensitive drum 1 to the capacitance to be detected can be reduced. Also, a stable output can be obtained as long as the capacitance is detected after the development roller 25 is stopped. However, to obtain the advantage of reducing the influence by the temperature and humidity environment, the development roller 25 does not have to be separated, or the development roller 25 does not have to be stopped when the capacitance is detected. Referring to FIG. 4, the AC power supply 91 for the detection is connected with the shaft 24*a*, and a detection circuit 80 is connected with the shaft 25*a*. The AC voltage for detecting the capacitance has a frequency of 50 kHz and a peak-to-peak voltage Vpp of 200 V. The capacitance is detected by detecting an induced voltage value detected from the shaft 25*a* in correspondence with the capacitance. In this embodiment, the AC voltage induced at the shaft 25*a* is rectified by the detection circuit 80, and the rectified DC voltage is detected. Thus, the capacitance is detected.

Figure 5:
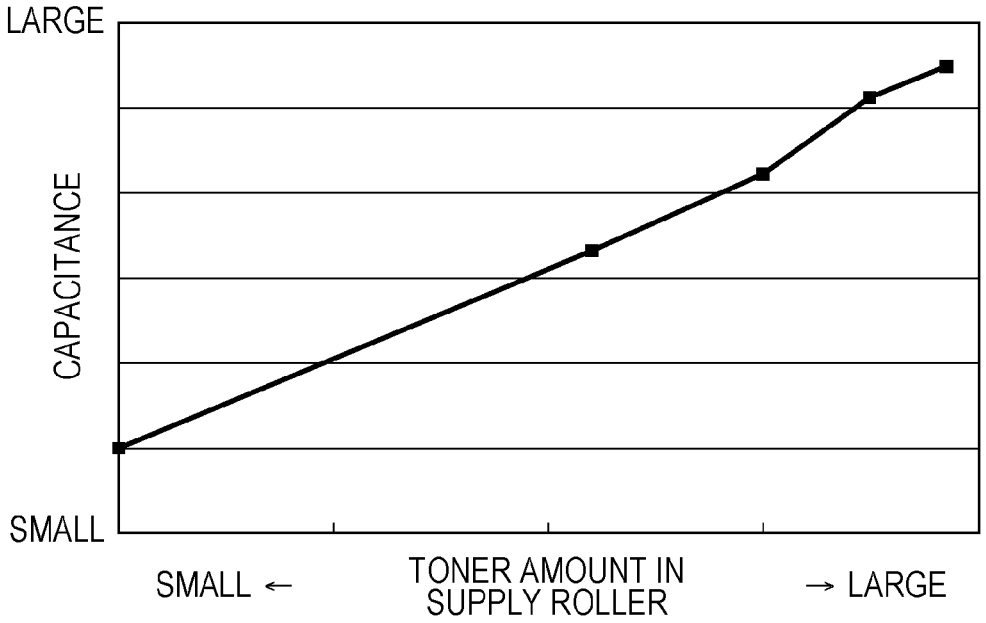
FIG. 5 illustrates the relationship between the toner amount in a supply roller and the capacitance.

It is to be noted that the capacitance between the shafts 25*a* and 24*a* is correlated with the toner amount in the supply roller 24 as shown in FIG. 5. The toner has a dielectric constant that is three times the dielectric constant of the air. If the toner amount in the supply roller 24 increases, the capacitance between the shafts 25*a* and 24*a* increases.

Figure 6:
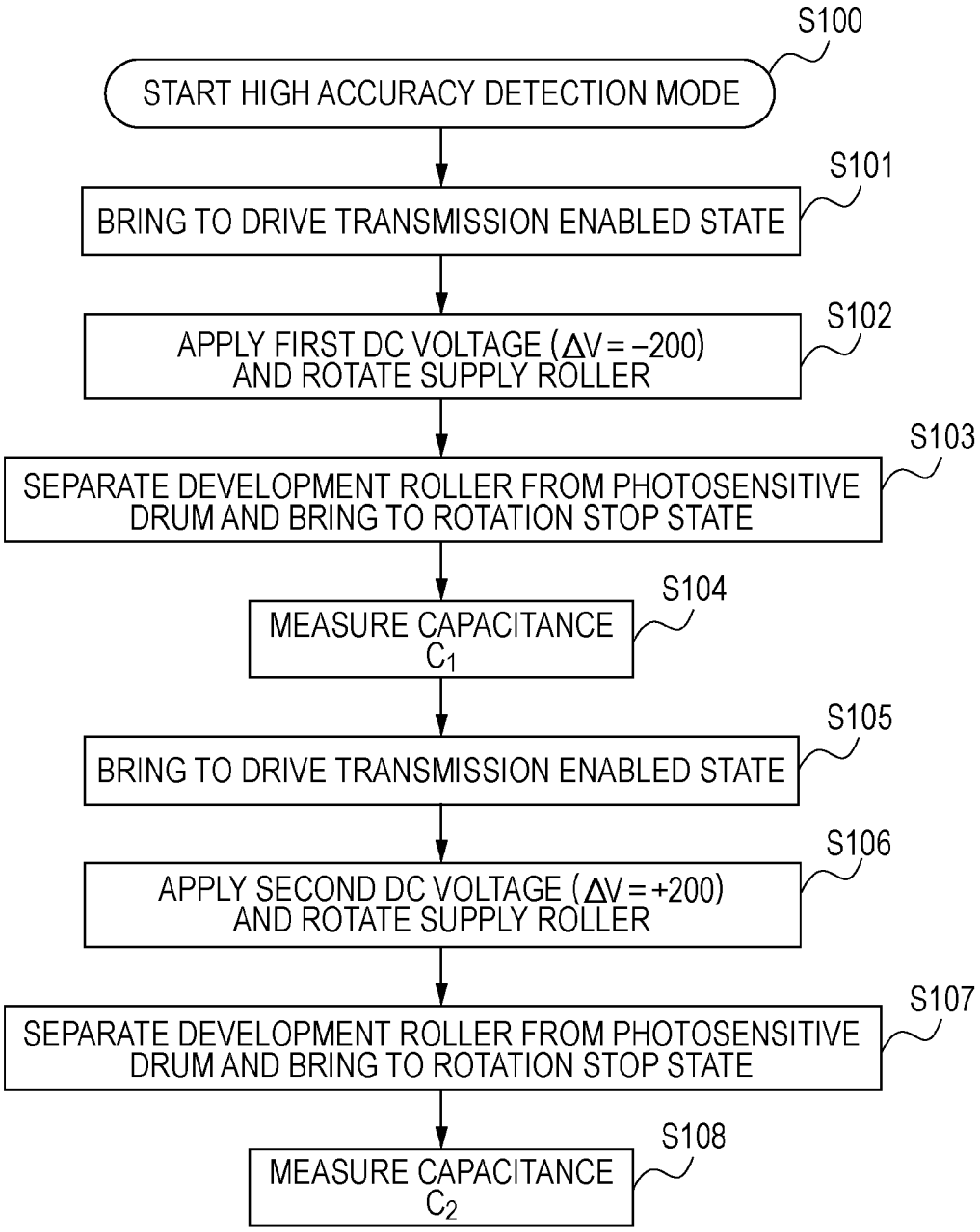
FIG. 6 is a flowchart of the high accuracy detection mode according to the first embodiment.

The high accuracy detection mode that is a feature of the present invention will be described below with reference to FIG. 6. The controller 70 functions as a detection mode execution unit, by executing the following control in the high accuracy detection mode.

If the pixel count integrated value Pcount of the developing device 5 reaches the predetermined value Pth, after developing, the high accuracy detection mode is started (S005, S100). The development roller 25 and the supply roller 24 are brought into a drive transmission enabled state, in which the drive-P 60 can transmit driving forces to the development roller 25 and the supply roller 24 (S101). Then, while a first DC voltage is applied between the shafts 25*a* and 24*a* from the DC power supply 90 serving as the voltage applying unit, the supply roller 24 is rotated for a first predetermined time (S102). When the first DC voltage is applied, a potential $V_a$ for the shaft 24*a* is −500 V and a potential $V_b$ for the shaft 25*a* is −300 V. Hence, the potential difference between the shafts 24*a* and 25*a* is $\Delta V_1 = V_a - V_b = -200$ V.

The first predetermined time is determined so that the toner amount in the supply roller 24 becomes stable. In this embodiment, the first predetermined time is 60 seconds. After the rotation for the first predetermined time, to measure the remaining toner amount, the development roller 25 is separated from the photosensitive drum 1, and the rotation of the development roller 25 and the supply roller 24 is stopped (S103). Then, a first capacitance $C_1$ is measured (S104).

Then, the state is brought into the drive transmission enabled state (S105). While a second DC voltage is applied between the shafts 25*a* and 24*a* from the DC power supply 90 serving as the voltage applying unit, the development roller 25 and the supply roller 24 are rotated for a second predetermined time. With the rotation, the toner amount in the foam layer of the supply roller 24 increases (S106). When the second DC voltage is applied, a potential $V_c$ for the shaft 24*a* is −100 V and a potential $V_d$ for the shaft 25*a* is −300 V. Hence, the potential difference between the shafts 24*a* and 25*a* is $\Delta V_2 = V_c - V_d = +200$ V.

The second predetermined time is determined so that the toner amount in the supply roller 24 becomes stable. In this embodiment, the second predetermined time is 60 seconds. After the rotation for the second predetermined time, to measure the remaining toner amount, the development roller 25 is separated from the photosensitive drum 1, and the rotation of the development roller 25 and the supply roller 24 is stopped (S107). Then, a second capacitance $C_2$ is measured (S108).

Figure 7:
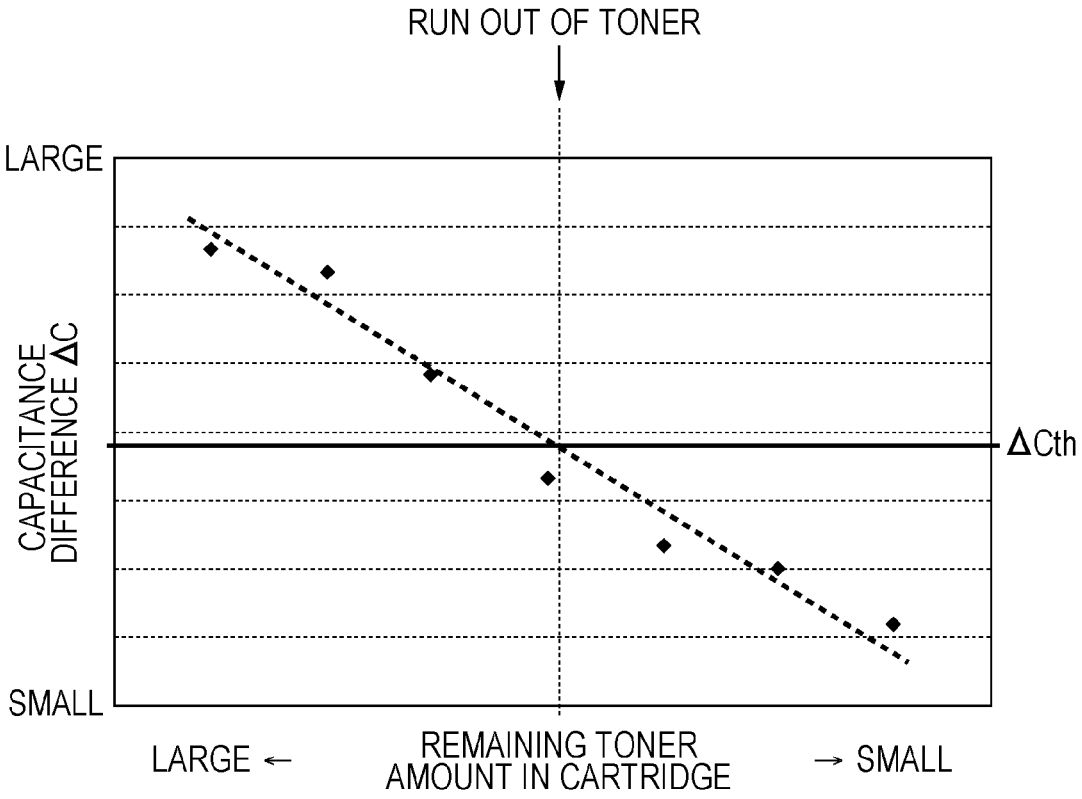
FIG. 7 illustrates the relationship between the remaining toner amount and the capacitance difference $\Delta C$ according to the first embodiment.

When an absolute value $|C_1 - C_2|$ of the difference between the detected capacitances $C_1$ and $C_2$ is $\Delta C$, the relationship between $\Delta C$ and the remaining toner amount in the developing device 5 becomes one illustrated in FIG. 7. In the measurement for the remaining toner amount, the run out timing of the toner should be accurately detected. Hence, the remaining toner amount is measured when the remaining toner amount is reduced by a certain degree. Therefore, the wordings "large" and "small" for the remaining toner amount in FIG. 7 are relative expressions when the remaining toner amount is reduced by a certain degree. (In the following figures, the wordings "large" and "small" for the remaining toner amount are used similarly.) Referring to FIG. 7, it is found that ΔC is correlated with the remaining toner amount. If the remaining toner amount is large, ΔC is large. As the remaining toner amount decreases, ΔC decreases. Hence, by measuring ΔC, the remaining toner amount can be measured with the use of the correlation.

Figure 8:
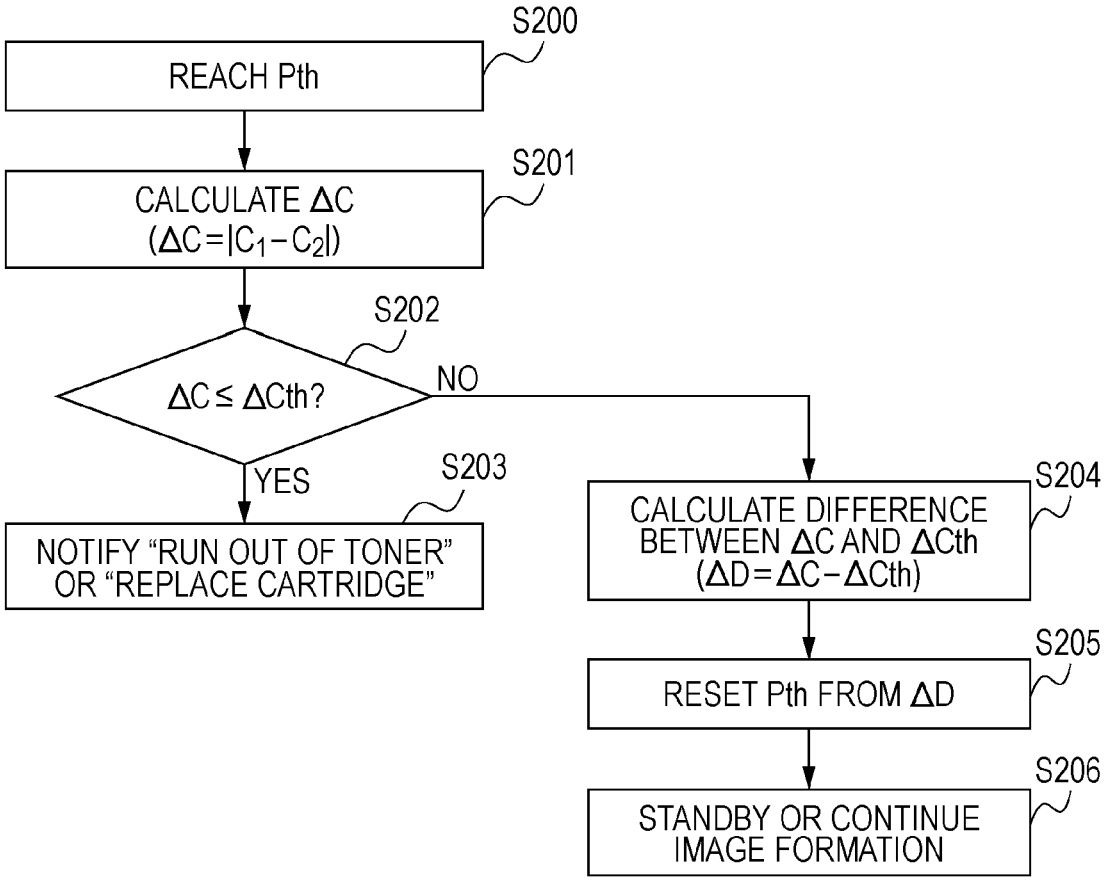
FIG. 8 is a flowchart for judging the result of the high accuracy detection mode.

FIG. 8 illustrates an operation of the controller 70 after ΔC is calculated. After the pixel count integrated value Pcount reaches the predetermined value Pth (S200) and ΔC is calculated (S201), it is determined whether ΔC is equal to or smaller than a threshold ΔCth (S202). If ΔC is equal to or smaller than the threshold ΔCth (YES in S202), a notice signal for notification of the run out of the toner is generated (S203). That is, the controller 70 functions as a notice signal generating unit 70*a*.

In contrast, if ΔC is not equal to or smaller than ΔCth (NO in S202), a difference ΔD between ΔC and ΔCth is calculated (S204), and Pth is reset (S205). The image formation is continued until the pixel count integrated value Pcount reaches the newly set predetermined value Pth (S206). (The process goes back to S000 or S001 in FIG. 3.) When the integrated value Pcount reaches the predetermined value Pth, the second high accuracy detection mode is executed.

Figure 9:
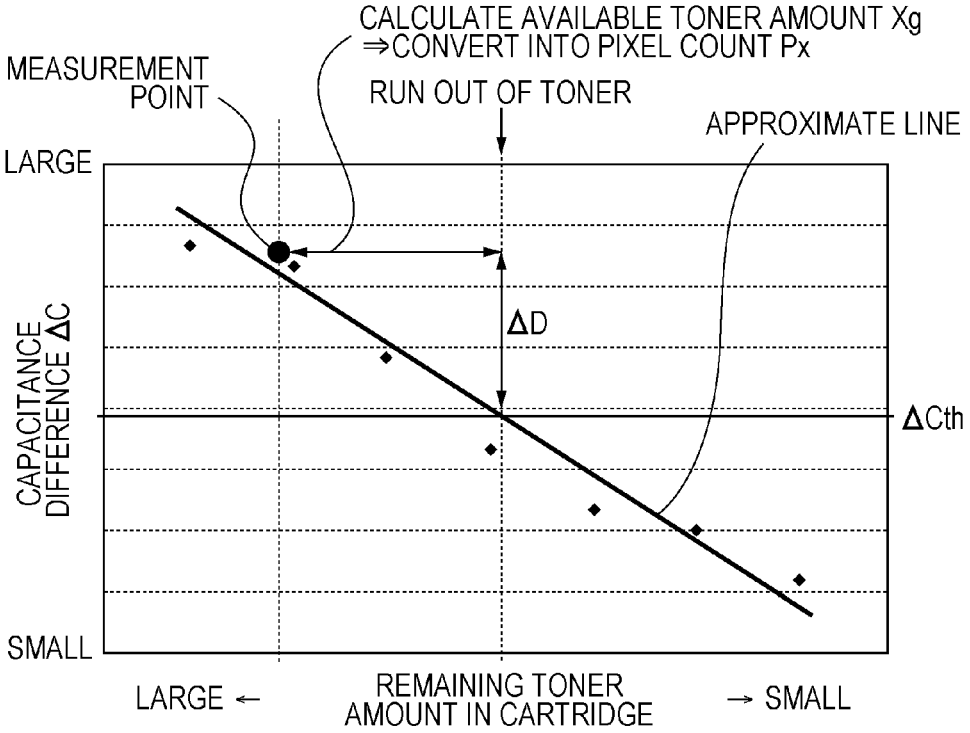
FIG. 9 illustrates a method for determining the timing at which the high accuracy detection mode is executed next.

Next, a method for resetting Pth by using ΔD will be described. The relationship between the remaining toner amount and ΔC is illustrated in FIG. 9. An approximate line is previously calculated from the relationship, and the approximate line data is stored in the memory in the apparatus body of the image forming apparatus. By using ΔD and the previously stored approximate line data, a toner use amount Xg, by which the toner can be used until the toner is run out, is calculated. By using the toner amount Xg, a pixel count Px, which is expected to be integrated, is calculated. Px is added to the old value Pth, and Pth' is obtained. Pth' is used as the newly reset value Pth. When the pixel count integrated value Pcount reaches the reset value Pth, the second high accuracy detection mode is executed. If ΔC is not equal to or smaller than ΔCth, the steps from S200 to S202, and S204 to S206 are repeated until ΔC becomes equal to or smaller than ΔCth.

Here, the physical meaning of the correlation between the capacitance difference (difference between capacitances) and the toner amount in the cartridge 21 will be discussed on the basis of the observed result of the developing device 5.

Figure 10:
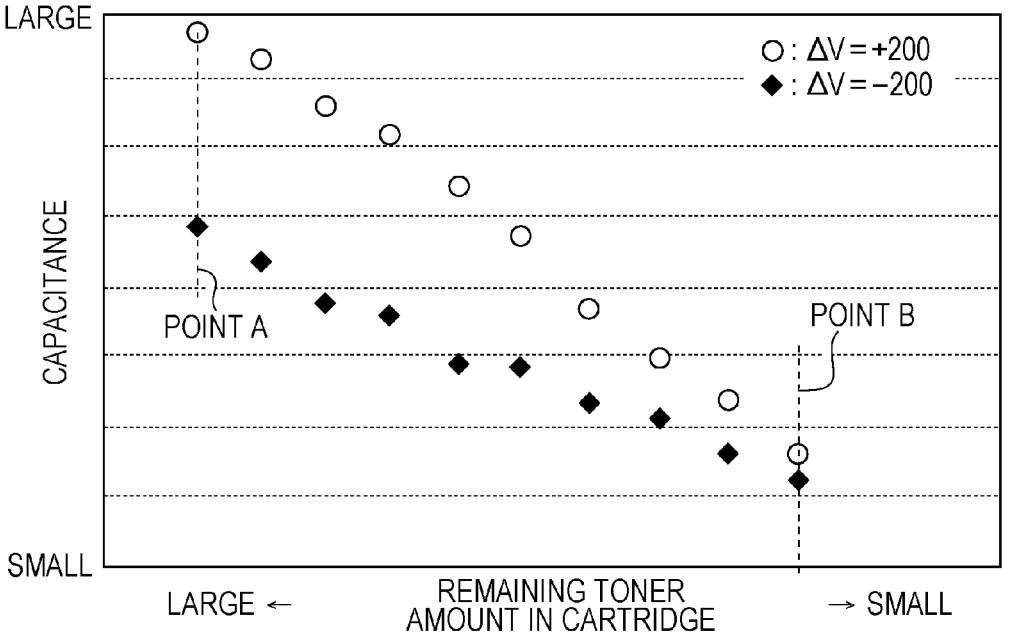
FIG. 10 illustrates capacitances measured with various potential differences.

The inventors of the present invention found that the relationship between the remaining toner amount and the toner amount in the supply roller 24 was changed by the potential difference ΔV of the DC voltage that was applied between the shaft 24*a* of the supply roller 24 and the shaft 25*a* of the development roller 25. FIG. 10 illustrates the toner amount in the cartridge 21 and the contained toner amount in the supply roller 24, in a state approximate to the state in which the toner is run out, when the supply roller 24 is rotated with the potential differences ΔV of −200 and +200 V. When ΔV=+200, the contained toner amount is larger than the contained toner amount when ΔV=−200 V. In particular, the difference is large when the toner amount in the cartridge 21 is large. As the toner amount in the cartridge 21 decreases, the toner amount in the supply roller 24 also decreases in either case of ΔV=−200 V and ΔV=+200 V. If the toner amount in the cartridge 21 is very small (point B), the contained toner amount with ΔV=−200 V is substantially equivalent to the contained toner amount with ΔV=+200 V.

From the observed result by the inventors of the present invention, it was found that the discharge amount of the toner to the portion X (FIG. 2) was larger in the case of ΔV=−200 V. When ΔV=+200 V, the toner having the negative normal charge polarity is more attracted toward the supply roller 24 due to an electric field between the development roller 25 and the supply roller 24 as compared with the case of ΔV=−200 V. The toner is sucked in the portion X when ΔV=+200 V; however, if ΔV becomes −200 V, the toner is likely discharged from the supply roller 24 due to the electric field, and hence the toner is hardly sucked in the portion X. As the result, when the toner remains in the cartridge 21 by a certain degree (point A), the toner amount in the supply roller 24 is smaller when the supply roller 24 is rotated with ΔV=−200 V.

In contrast, when the toner remains in the cartridge 21 by a very small amount (point B), the toner in the portion Y (FIG. 2) is reduced. The portion Y is a portion in which the supply roller 24 compressed by the contact with the development roller 25 is decompressed. Hence, the toner is sucked by a large amount in the portion Y at the moment of the decompression. Since the toner is mainly sucked into the supply roller 24 from the portion Y, the state of the toner in the portion Y affects the toner amount in the supply roller 24. If the toner amount in the portion Y is small, it may be difficult to supply the supply roller 24 with the toner. The toner amount in the supply roller 24 decreases. As mentioned above, this phenomenon is significantly affected by the state of the toner in the portion Y. Thus, the toner amount in the supply roller 24 may decrease irrespective of the potential difference ΔV.

Consequently, the relationship between the toner amount in the cartridge 21 and the toner amount in the supply roller 24 becomes one shown in FIG. 10. If FIG. 10 is plotted by using the difference therebetween, the relationship in FIG. 7 is obtained.

Figure 11A:
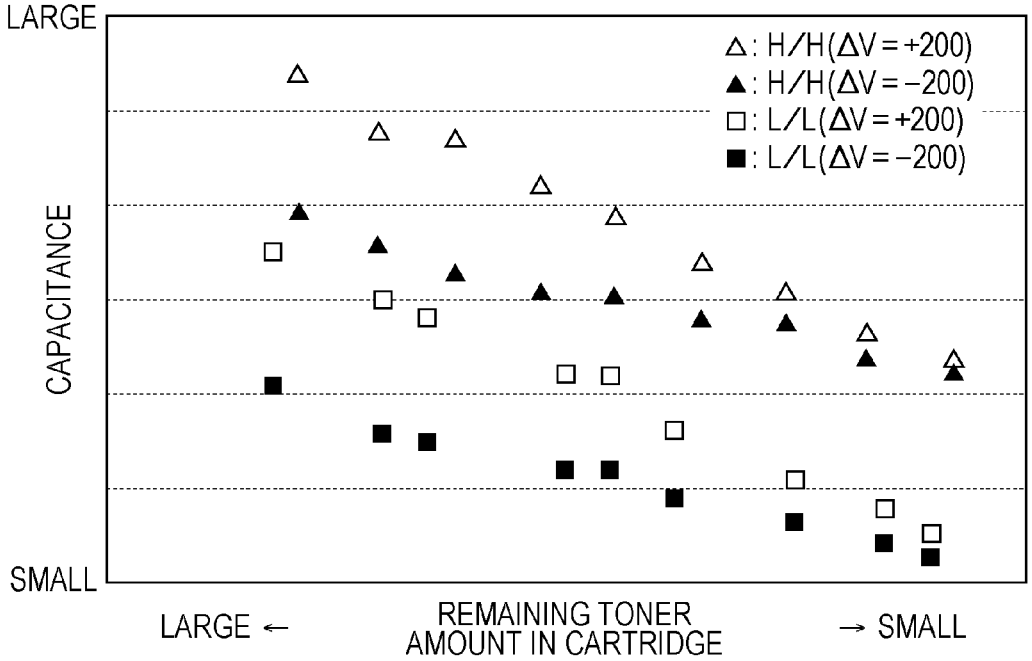
FIG. 11A illustrates the relationship between the capacitance and the remaining toner amount for various environment and potential differences.
Figure 11B:
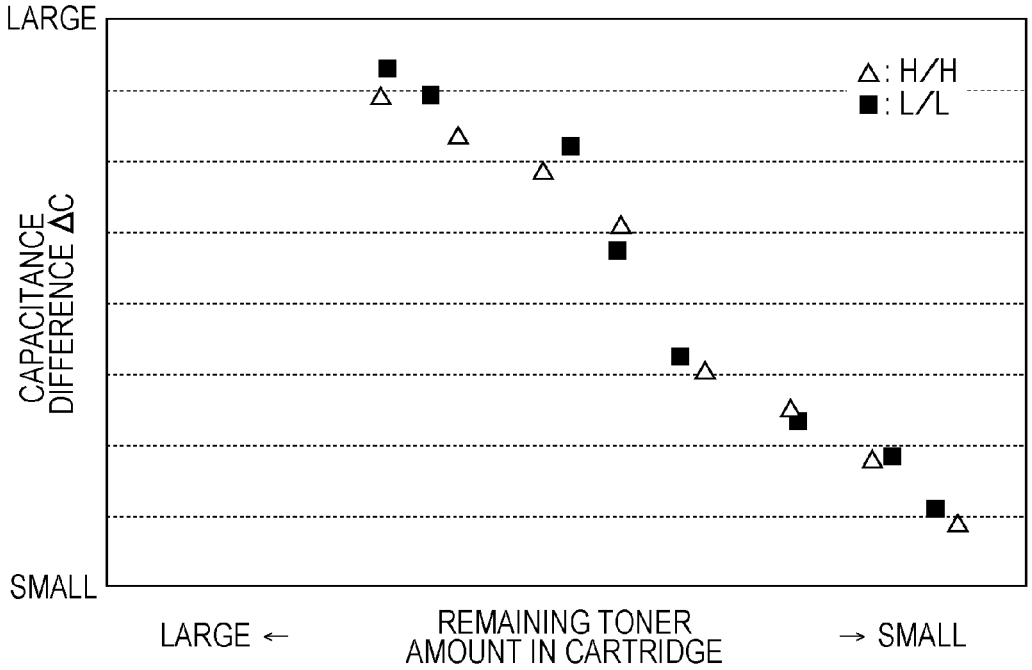
FIG. 11B illustrates the relationship between the capacitance difference and the remaining toner amount when the potential difference is changed for various environment.

With regard to the above-described points, the advantage according to this embodiment of the present invention will be described in detail. FIG. 11A illustrates the relationship between the toner amount in the cartridge 21 and the capacitance for various potential differences under high-temperature high-humidity environment (at 30° C. and 80% RH, hereinafter, referred to as H/H) and low-temperature low-humidity environment (at 15° C. and 10% RH, hereinafter, referred to as L/L). The measurement value at H/H indicates a higher capacitance than the measurement value at L/L. This is because, for example, the toner and the foam layer of the supply roller 24 absorb moisture and the resistance thereof changes with temperature. If the capacitance difference is measured for the various potential differences, the result at H/H is similar to the result at L/L as shown in FIG. 11B. With these results, the influence by the temperature and humidity to the capacitance is substantially equivalent even if the potential difference ΔV of the DC voltage that is applied to the supply roller 24 and the development roller 25 is changed.

Accordingly, if the capacitance differences with the various potential differences are used as parameters for detecting the remaining toner amount, the influence by the change in environment to the capacitance can be canceled. By measuring the remaining toner amount with the high accuracy detection mode according to this embodiment, even if the temperature and humidity environment is changed, the remaining toner amount can be highly accurately measured without the temperature sensor or the humidity sensor. Thus, a user can be notified with high accuracy that the remaining toner amount is smaller than a predetermined amount or that the cartridge 21 has to be replaced, without the temperature sensor or the humidity sensor even if the temperature and humidity environment is changed.

In this embodiment, the potential difference is $\Delta V_1$=−200 V when the first DC voltage is applied and the potential difference is $\Delta V_2$=+200 V when the second DC voltage is applied in the high accuracy detection mode. If the high accuracy detection mode is ended after the rotation with the potential difference of $\Delta V_2$=+200 V, as compared with the case in which the high accuracy detection mode is ended after the rotation with the potential difference of $\Delta V_1$=−200 V, the development can be started with the more toner contained in the supply roller 24 for the next image formation.

That is, by applying the first and second DC voltages such that the value of $\Delta V_1-\Delta V_2$, i.e., the value of $(V_a-V_b)-(V_c-V_d)$ is homopolar with the normal charge polarity of the toner, an image with a low density or an image with an unprinted portion is less frequently generated even if an image with a high coverage rate is output after the high accuracy detection mode, as compared with the antipolar case. However, to obtain the advantage according to the present invention of highly accurately measuring the remaining toner amount even if the temperature and humidity environment is changed, the relationship between $\Delta V_1-\Delta V_2$ and the normal charge polarity of the toner does not have to be satisfied.

Also, the values used for the first and second DC voltages are not limited thereto, and may be desirably selected. However, since the relationship between the remaining toner amount and the toner amount in the supply roller 24 is changed by using the voltages with different values ΔV as described above, this embodiment does not include a configuration using the same voltage. Further, the supply roller rotation time required so that the toner amount in the supply roller 24 becomes stable depends on, for example, the rotation speed of the supply roller 24. Hence, the first and second predetermined times are not limited to the values according to this embodiment, and do not have to be the same.

Further, in this embodiment, the potential of the shaft 25*a* of the development roller 25 is fixed whereas the potential of the shaft 24*a* of the supply roller 24 is changed by the plurality of steps when the first DC voltage is applied and when the second DC voltage is applied. However, required herein is that the potential difference between the shafts 25*a* and 24*a* is changed. Hence, the potential of the shaft 25*a* may be changed.

Second Embodiment

Bias and Rotary Drum

A second embodiment of the present invention will be described below with reference to the drawings. However, dimensions, materials, shapes, and relative arrangements of components described in the embodiment may be properly changed in accordance with a configuration to which the present invention is applied or various conditions. The embodiment does not intend to limit the scope of the present invention.

Figure 12:
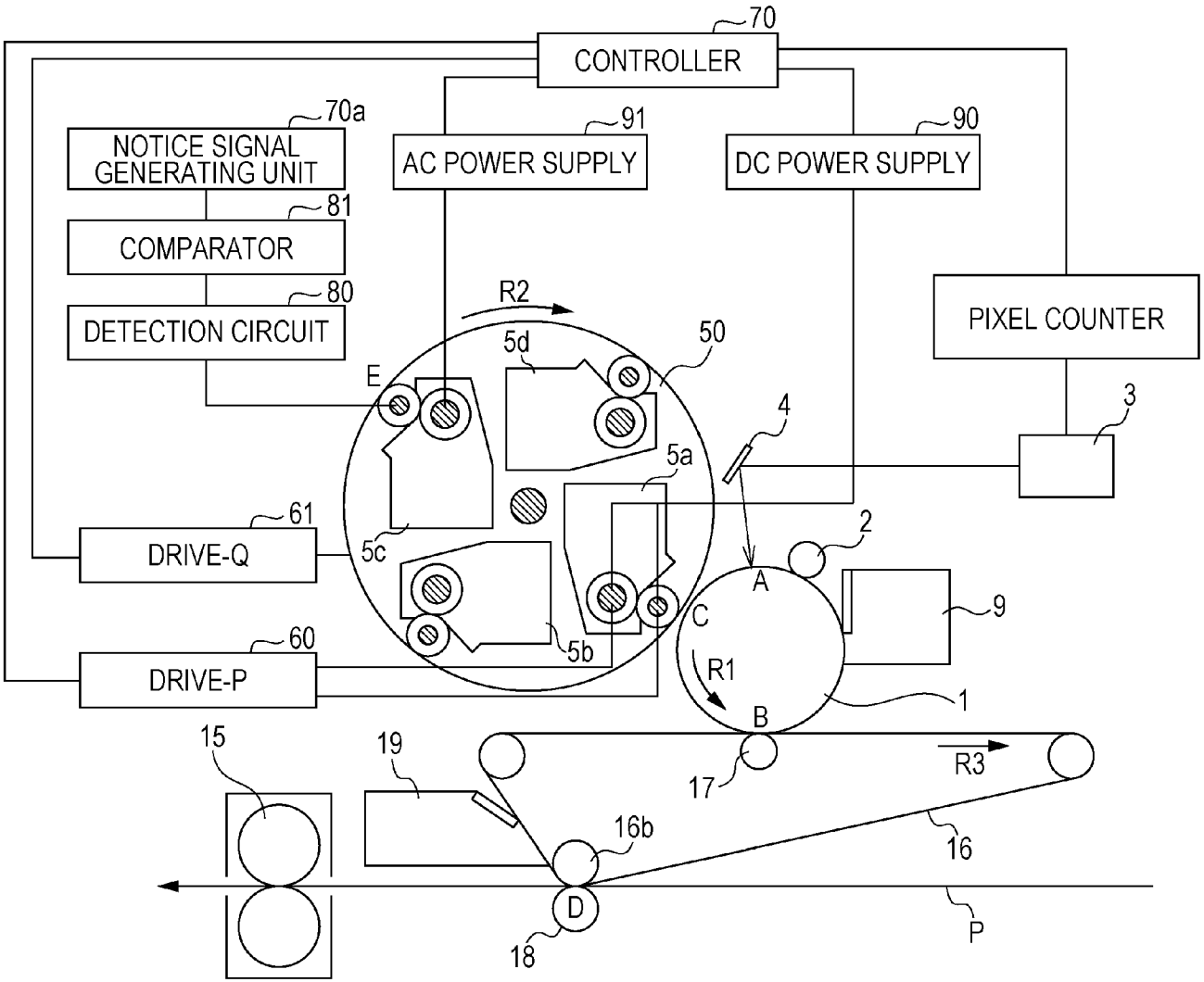
FIG. 12 schematically illustrates an exemplary image forming apparatus according to a second embodiment.

FIG. 12 illustrates an image forming apparatus according to the second embodiment. A photosensitive drum 1 serves as an image bearing member. The photosensitive drum 1 rotates in a direction R1. Reference sign 2 denotes a charging roller, 3 is an exposure device, and 4 is a reflection mirror. A laser beam emitted from the exposure device 3 is reflected by the reflection mirror 4 and then reaches an exposure position A on the photosensitive drum 1.

Developing devices 5*a*, 5*b*, 5*c*, and 5*d* respectively contain a yellow toner, a magenta toner, a cyan toner, and a black toner each having a negative normal charge polarity. The developing devices 5*a* to 5*d* have the same configuration, and hence, if the contained toners do not have to be distinguished from each other, the developing devices 5*a* to 5*d* are collectively described as developing devices 5. The developing devices 5 are cartridges that are mounted on mount portions of a rotary drum 50 in a replaceable manner. The rotary drum 50 is rotatably supported with the developing devices 5 attached thereto. The rotary drum 50 can rotate to bring a desirable one of the developing devices 5 (for example, the developing device 5*a*) to a development position C at which the developing device 5 (5*a*) faces and contacts the photosensitive drum 1.

A transfer belt 16 serving as an intermediate transfer member is provided below the photosensitive drum 1 and supported by a plurality of rollers. The transfer belt 16 is rotatable in a direction R3 in FIG. 12. A primary transfer roller 17 is arranged at a primary transfer position B, at which the transfer belt 16 is pressed to and contacts the photosensitive drum 1, such that the primary transfer roller 17 and the photosensitive drum 1 pinch the transfer belt 16. A secondary transfer roller 18 is arranged at a roller 16*b* included in the rollers that support the transfer belt 16 such that the secondary transfer roller 18 and the roller 16*b* pinch the transfer belt 16. The secondary transfer roller 18 can contact the transfer belt 16, and can be separated from the transfer belt 16.

The roller 16*b* is named a secondary transfer opposite roller 16*b* for the secondary transfer roller 18. The position, at which the secondary transfer roller 18 contacts and is separated from the transfer belt 16, is named a secondary transfer position D. Although described later, an image is transferred on a conveyed transfer material P at the secondary transfer position D. The transfer material P after the transferring is conveyed to a fixing unit 15.

A transfer cleaning device 19 is provided downstream the secondary transfer position D in a moving direction of the transfer belt 16. The cleaning device 19 includes a blade being in contact with the transfer belt 16 so that the blade scrapes a toner on the transfer belt 16. Also, a photosensitive member cleaning device 9 is provided downstream the primary transfer position B in a moving direction of the photosensitive drum 1. The cleaning device 9 includes a blade being in contact with the photosensitive drum 1 so that the blade scrapes a toner on the photosensitive drum 1.

Image formation by the image forming apparatus will be described. The charging roller 2 causes the surface of the photosensitive drum 1 to be charged by a predetermined potential while the photosensitive drum 1 is rotated at 100 mm/sec in the direction R1. An electrostatic latent image is formed on the photosensitive drum 1 at the exposure position A by a laser beam emitted by the exposure device 3 and reflected by the reflection mirror 4 in accordance with an image signal for each color. The formed electrostatic latent image is developed by the developing device 5 at the development position C. Thus, a toner image is formed. The developing device 5 that is provided at the development position C is determined in accordance with the image signal for each color. The rotary drum 50 is rotated in a direction R2 in advance, so that the developing device 5 of a desirable color is provided at the development position C. The order of toner images to be developed is also determined. In this embodiment, toner images are formed in order of yellow, magenta, cyan, and black.

The toner images formed on the photosensitive drum 1 are transferred on the transfer belt 16 at the primary transfer position B. By superposing the toner images successively on one another, a full-color toner image is formed on the transfer belt 16.

The secondary transfer roller 18 is separated from the transfer belt 16 until the full-color toner image is formed. After the full-color image is formed, the secondary transfer roller 18 contacts the transfer belt 16. The transfer material P is conveyed to the secondary transfer position D at the timing when the formed full-color toner image reaches the secondary transfer position D. The secondary transfer roller 18 and the secondary transfer opposite roller 16*b* pinch the transfer material P together with the transfer belt 16, so that the full-color toner image is transferred on the transfer material P. The transfer material P with the full-color toner image transferred thereon is conveyed to the fixing unit 15. The fixing unit 15 applies pressure and heat to the full-color toner image on the transfer material P to fix the full-color toner image to the transfer material P. Thus, a final image is obtained.

The developing device 5 used in the second embodiment has a configuration similar to the configuration of the developing device 5 used in the first embodiment. The developing device 5 of the second embodiment has a development roller 25 and a supply roller 24 similar to those of the first embodiment. The peripheral speed of the development roller 25 is 160 mm/sec, and the peripheral speed of the supply roller 24 is 140 mm/sec during image formation. In this embodiment, a DC voltage that is applied from a DC power supply 90 to the supply roller 24 can be changed by a plurality of steps like the first embodiment.

Next, a method for measuring a remaining toner amount of the developing device 5 according to this embodiment will be described. The method for measuring the remaining toner amount is basically similar to that of the first embodiment, and hence, only feature part of this embodiment will be described. In this embodiment, the developing device 5 as the subject of detection for the remaining toner amount is provided on a rotary support member, i.e., the rotary drum 30. A drive-Q 60 (second drive) rotates the rotary drum 50, so that the developing device 5 is moved to a detection position E for measurement. The detection position E is the position of the developing device 5*c* in FIG. 12. An AC power supply 91 for detection is connected with the shaft 24*a*, and a detection circuit 80 is connected with the shaft 25*a* at the detection position E through electrode terminals (not shown).

At the detection position E, since a toner around the supply roller 24 is dropped by own weight, the influence of the toner near the supply roller 24 can be reduced. Accordingly, the toner near the supply roller 24 hardly disturbs the detection. The toner amount in the supply roller 24 can be correctly measured.

Also, in this embodiment, a pixel counting unit (pixel counter) is provided to calculate a light-emitting rate of the exposure device 3 like the first embodiment. A pixel count integrated value for each developing device 5 is calculated, and a toner use amount is roughly estimated. The pixel count integrated value is stored in a memory provided in each developing device 5. The execution timing for the high accuracy detection mode is determined by using the pixel count integrated value as a trigger like the first embodiment. However, to accurately detect the run out timing of the toner and the replacement timing of the developing device 5, required herein is that the high accuracy detection mode is executed. Hence, the pixel count method may not be used.

Figure 13:
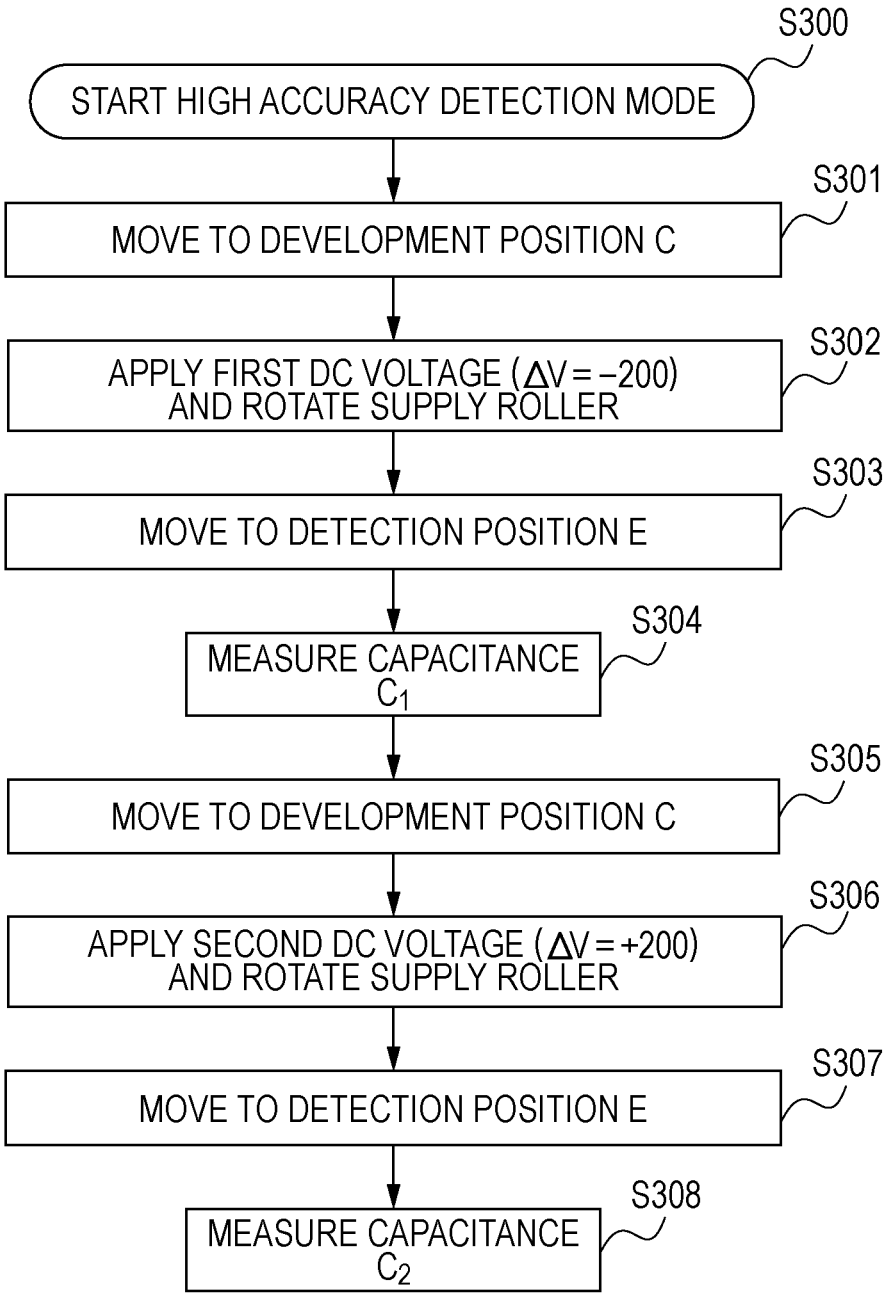
FIG. 13 is a flowchart of a high accuracy detection mode according to the second embodiment.
Figure 14:
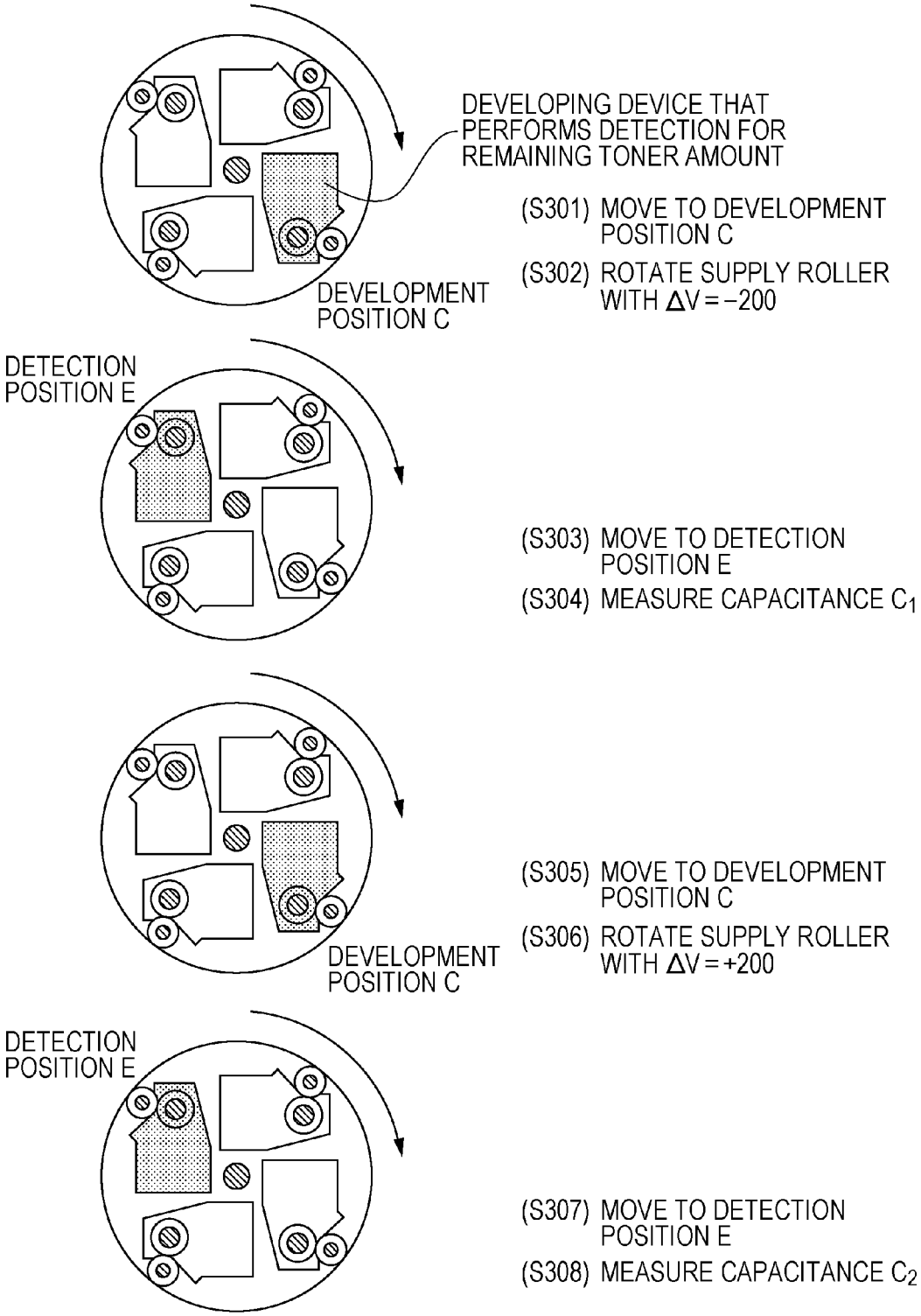
FIG. 14 illustrates movement of a rotary drum in the high accuracy detection mode according to the second embodiment.

The operation in the high accuracy detection mode according to this embodiment will be described. FIGS. 13 and 14 illustrate the flow of a sequence and the movement of the rotary drum 50. When the pixel count integrated value Pcount of certain one of the developing devices 5 reaches the predetermined value Pth, the high accuracy detection mode is executed (S300). First, the developing device 5 whose integrated value Pcount reaches the predetermined value Pth is moved to the development position C (S301). To change the toner amount in the foam layer of the supply roller 24, a first DC voltage is applied between the first and second electrode members at that position, and the supply roller 24 is rotated for a first predetermined time (S302). Similarly to the first embodiment, when the first DC voltage is applied, a potential $V_a$ for the shaft 24*a* is −500 V and a potential $V_b$ for the shaft 25*a* is −300 V. Hence, the potential difference between the shafts 24*a* and 25*a* is $\Delta V_1=V_a-V_b=-200$ V. The first predetermined time is determined so that the toner amount in the supply roller 24 becomes stable. In this embodiment, the first predetermined time is 60 seconds.

After the rotation for the predetermined time, the developing device 5 is moved to the detection position E (S303), and a first capacitance $C_1$ is measured (S304). Then, the developing device 5 is moved to the development position C again (S305). To change the toner amount in the foam layer of the supply roller 24 again, a second DC voltage is applied between the first and second electrode members at that position, and the supply roller 24 is rotated for a second predetermined time (S306). Similarly to the first embodiment, when the second DC voltage is applied, a potential $V_c$ for the shaft 24*a* is −100 V and a potential $V_d$ for the shaft 25*a* is −300 V. Hence, the potential difference between the shafts 24*a* and 25*a* is $\Delta V_2=V_c-V_d=+200$ V.

The second predetermined time is determined so that the toner amount in the supply roller 24 becomes stable. In this embodiment, the second predetermined time is 60 seconds. Then, the developing device 5 is moved to the detection position E (S307), and a second capacitance $C_2$ is measured (S308).

An absolute value $|C_1-C_2|$ of the difference between the detected capacitances $C_1$ and $C_2$ is $\Delta C$. After $\Delta C$ is calculated, it is determined whether $\Delta C$ exceeds a threshold through the flow shown in FIG. 8 like the first embodiment, to perform notification relating to the remaining toner amount and detection relating to the replacement timing of the cartridge 21 like the first embodiment.

Figure 15A:
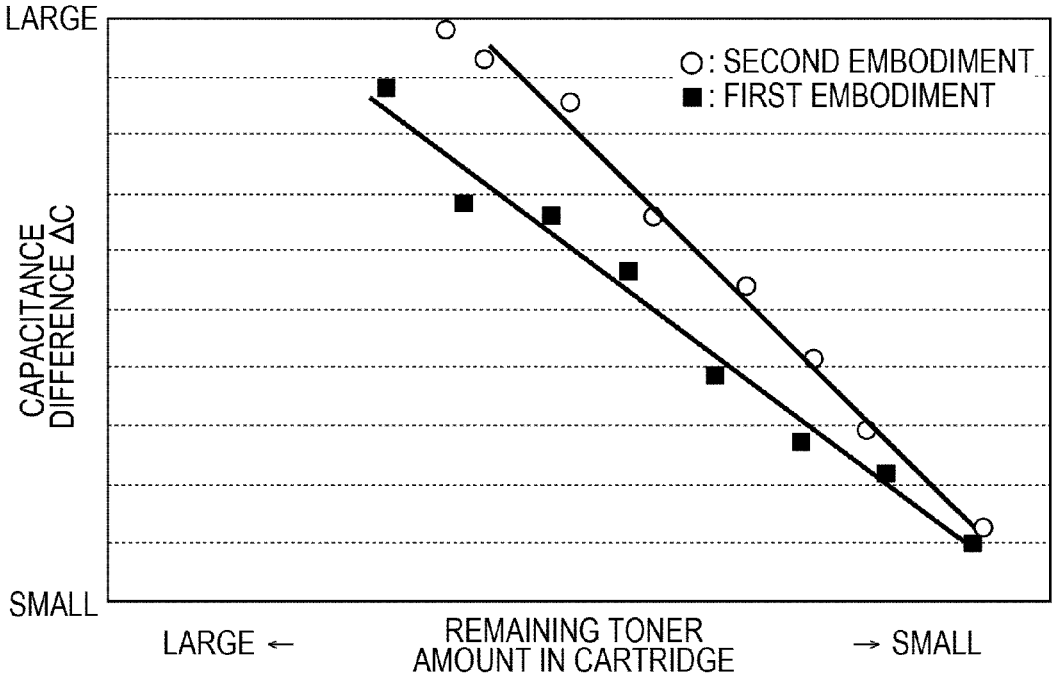
FIG. 15A is a graph showing the relationship between the remaining toner amount and the capacitance difference according to the first and second embodiments.

This embodiment provides an advantage on account of the use of the rotary drum 50, in addition to the advantage attained in the first embodiment. The advantage will be described. The capacitance difference $\Delta C$ in this embodiment has a tendency as shown in FIG. 15A. This tendency is similar to that in the first embodiment, however, an inclination of the capacitance difference $\Delta C$ to the toner amount in the cartridge 21 is larger than that of the result in the first embodiment. Accordingly, $\Delta C$ is more sensitive to the change in remaining toner amount. Thus, the remaining toner amount can be more accurately detected.

Figure 15B:
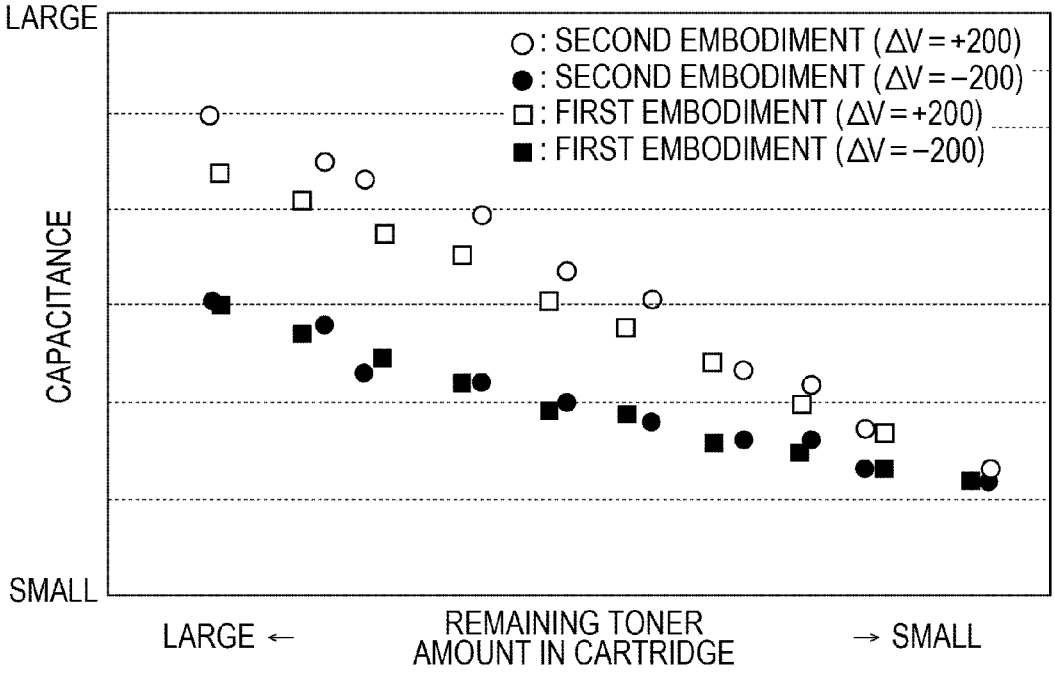
FIG. 15B is a graph showing the relationship between the remaining toner amount and the capacitance for various potential differences according to the first and second embodiments.

The phenomenon that the inclination of the capacitance difference $\Delta C$ to the toner amount in the cartridge 21 is increased by the configuration of this embodiment will be described below. FIG. 15B illustrates the relationship of the remaining toner amount in the cartridge 21 with respect to the capacitance after the potential difference $\Delta V_1$ of −200 V by the first DC voltage is applied and the supply roller 24 is rotated, and to the capacitance after the potential difference $\Delta V_2$ of +200 V is applied and the supply roller 24 is rotated by using the configuration of this embodiment. As compared with the first embodiment, it is found that a measurement value when the supply roller 24 is rotated upon the application with $\Delta V=+200$ V is large.

Figure 16:
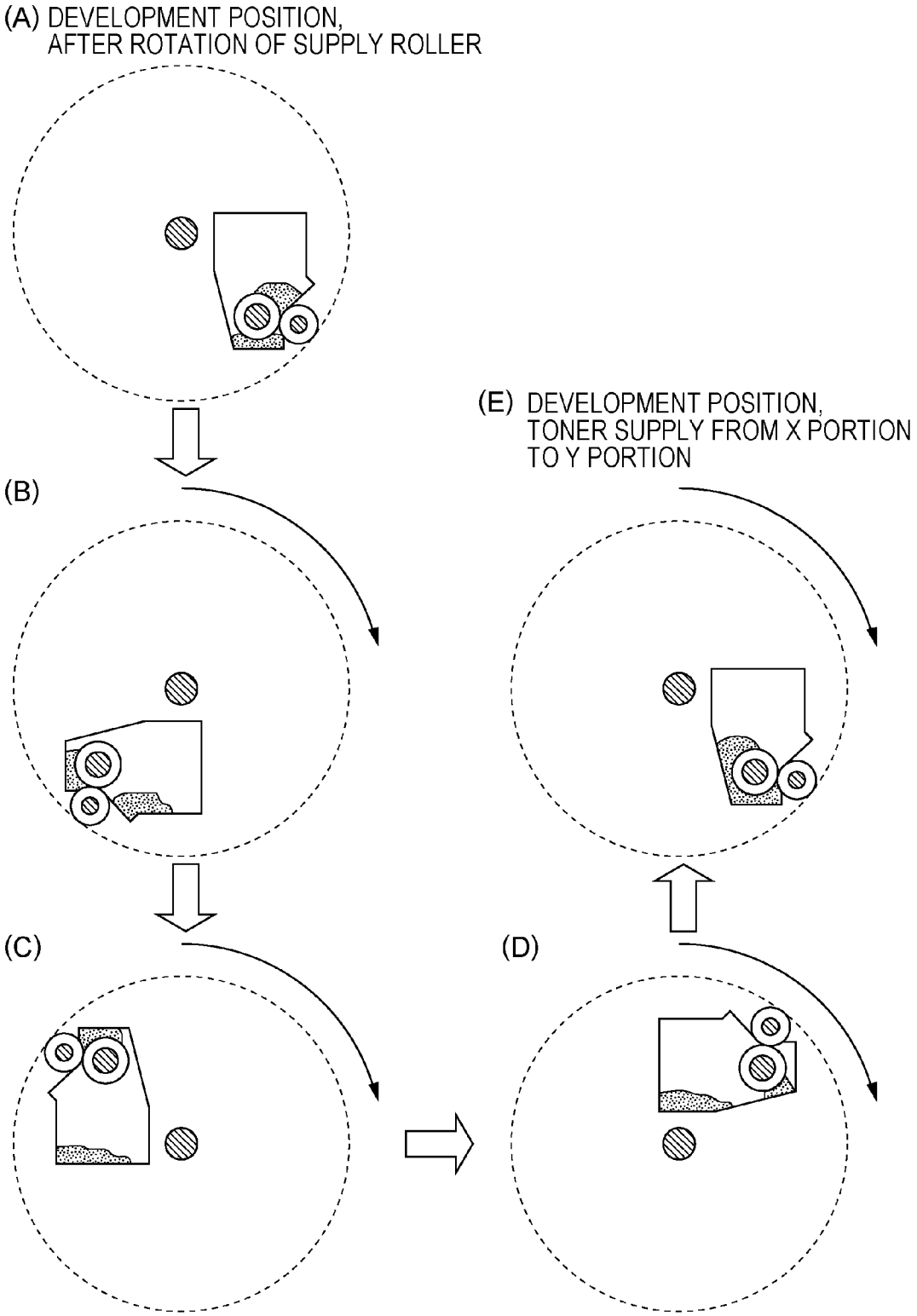
FIG. 16 illustrates movement of the rotary drum and a toner according to the second embodiment.

This phenomenon will be discussed. FIG. 16 illustrates the movement of the toner in the cartridge 21, i.e., the developing device 5 when the rotary drum 50 is rotated when the amount of the toner is small. After the rotation at the development position C, a large amount of toner is present above the supply roller 24 (portion X) as shown in part (A) in FIG. 16. The rotary drum 50 is rotated from this state successively to part (B), part (C), part (D), and then part (E) in FIG. 16, the toner staying in the portion X located upstream the contact position, at which the development roller 25 contacts the supply roller 24, in the rotating direction of the supply roller 24 is conveyed to the portion Y located downstream the contact position in the rotating direction of the supply roller 24.

The supply roller 24 is supplied with the toner mainly through suction from the portion Y. Hence, by conveying the toner to the portion Y by the rotation of the rotary drum 50, the toner in the supply roller 24 can be increased. When the supply roller 24 is rotated with the potential difference ΔV of −200 V, the toner is likely discharged from the supply roller 24 due to the electric field, and hence the discharged amount of the toner to the portion X becomes larger than the sucked amount of the toner from the portion Y. The toner amount in the foam layer hardly varies depending on whether the rotary drum 50 is rotated or not. In contrast, when the supply roller 24 is rotated with the potential difference ΔV of +200 V, the toner is attracted to the supply roller 24 due to the electric field. The suction of the toner from the portion Y is predominant over the discharge of the toner to the portion X. Accordingly, the supply roller 24 easily sucks the toner.

The capacitance does not markedly change after the rotation with the potential difference ΔV of −200 V, whereas the capacitance increases after the rotation with the potential difference ΔV of +200 V. The capacitance difference is larger as compared with a configuration without the rotary drum 50. If the toner amount is very small, the toner in the portion Y is used up. The toner amount in the supply roller 24 becomes small after the rotation with the potential difference ΔV of +200 V. The case with the rotation of the rotary drum 50 is no longer different from the first embodiment.

Hence, it is considered that the inclination of the capacitance difference ΔC with respect to the toner amount in the cartridge 21 is larger than that of the first embodiment. The variation in remaining toner amount is smaller than the variation appearing during the detection for the capacitance difference ΔC. The remaining toner amount can be highly accurately detected.

The rotary drum 50 attains another advantage such that the toner is hardly affected even if the toner is left for a long period because the toner is stirred by the rotation of the rotary drum 50. Thus, the toner amount in the supply roller 24 becomes stable after the rotation of the supply roller 24. The variation in toner amount when the capacitance is measured can be reduced.

In this embodiment, the potential difference is $\Delta V_1$=−200 V when the first DC voltage is applied and the Potential difference is $\Delta V_2$=+200 V when the second DC voltage is applied in the high accuracy detection mode. If the high accuracy detection mode is ended after the rotation with the potential difference of $\Delta V_2$=+200 V, as compared with the case in which the high accuracy detection mode is ended after the rotation with the potential difference of $\Delta V_1$=−200 V, the supply roller 24 can contain the toner by a large amount for the next image formation.

That is, by applying the first and second DC voltages such that the value of $\Delta V_1-\Delta V_2$, i.e., the value of $(V_a-V_b)-(V_c-V_d)$ is homopolar with the normal charge polarity of the toner, an image with a low density or an image with an unprinted portion is less frequently generated even if an image with a high coverage rate is output after the high accuracy detection mode, as compared with the antipolar case. However, to obtain the advantage according to the present invention of highly accurately measuring the remaining toner amount even if the temperature and humidity environment is changed, the relationship between $\Delta V_1-\Delta V_2$ and the normal charge polarity of the toner does not have to be satisfied.

Also, the values used for the first and second DC voltages are not limited thereto, and may be desirably selected. However, since the relationship between the remaining toner amount and the toner amount in the supply roller 24 is changed by using the voltages with different values ΔV as described above, this embodiment does not include a configuration using the same voltage.

Further, the supply roller rotation time required so that the toner amount in the supply roller 24 becomes stable depends on, for example, the rotation speed of the supply roller 24. Hence, the first and second predetermined times are not limited to the values according to this embodiment, and do not have to be the same. Further, in this embodiment, the potential of the shaft 25*a* of the development roller 25 is fixed whereas the potential of the shaft 24*a* of the supply roller 24 is changed by the plurality of steps when the first DC voltage is applied and when the second DC voltage is applied. However, required herein is that the potential difference between the shafts 25*a* and 24*a* is changed. Hence, the potential of the shaft 25*a* may be changed.

Third Embodiment

Speed

An image forming apparatus according to a third embodiment of the present invention has a basic configuration similar to the image forming apparatus in FIG. 1 according to the first embodiment. This embodiment executes the flow shown in FIG. 3 for detecting the remaining toner amount like the first embodiment. However, a method for changing the toner amount in the foam layer of the supply roller 24 in the high accuracy detection mode after the flow in FIG. 3 is different from that in the first embodiment. In particular, in this embodiment, the drive-P 60 in FIG. 2 can change the rotation speed of the supply roller 24 into a plurality of speeds. Accordingly, unlike the first and second embodiments, the toner amount in the foam layer can be changed although the potential difference between the shafts 25*a* and 24*a* is not changed.

The same reference signs refer the members having the same configurations and functions as those of the first embodiment. Also, redundant description will be omitted except for the high accuracy detection mode.

Only feature part of the embodiment will be described.

As mentioned above, the image forming apparatus of this embodiment includes the drive-P 60 (FIG. 2) that can change the rotation speed of the development roller 25 and the supply roller 24 into a plurality of speeds.

Figure 18:
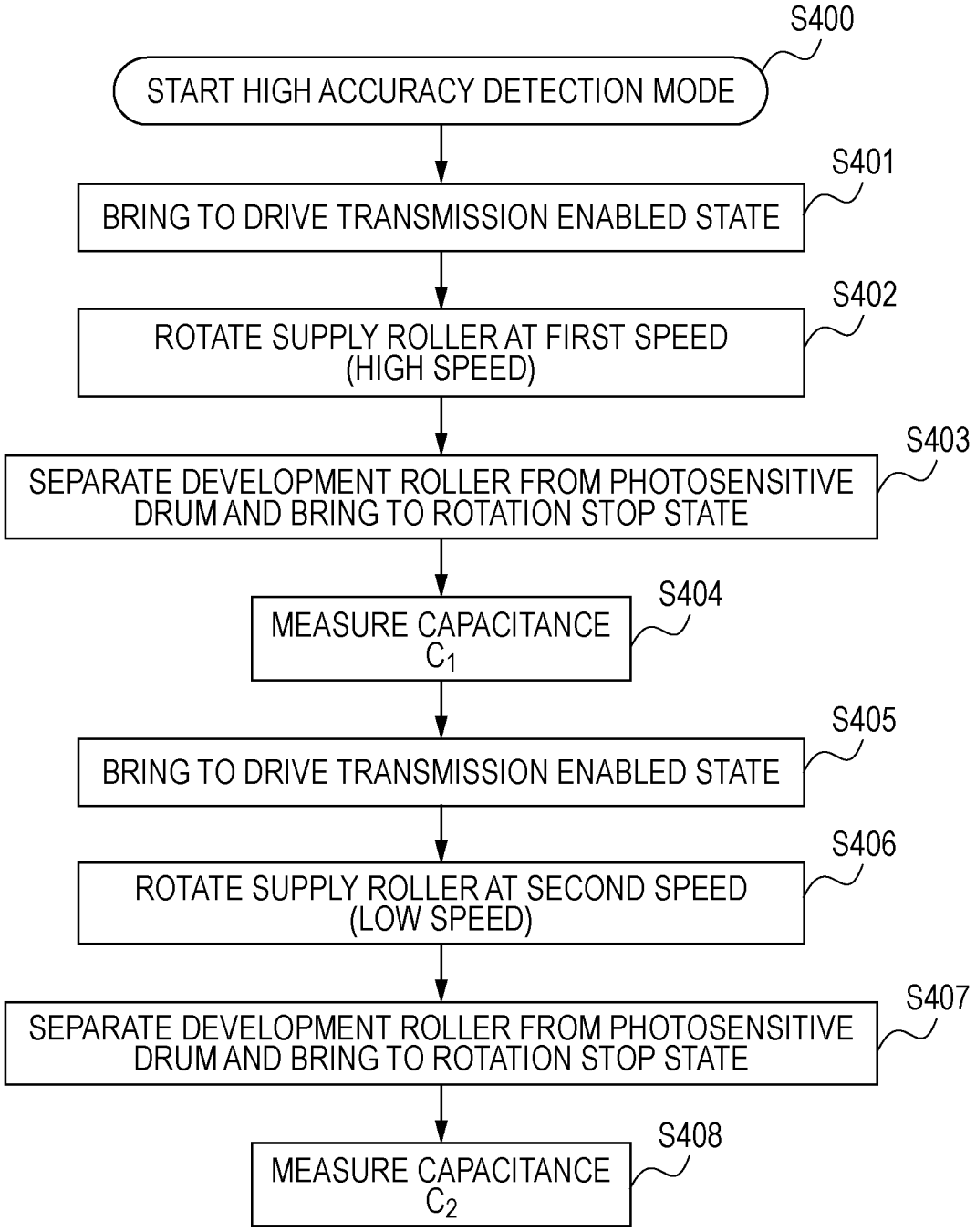
FIG. 18 is a flowchart of a high accuracy detection mode according to a third embodiment.

The high accuracy detection mode that is a feature of this embodiment will be described with reference to FIG. 18. If a pixel count integrated value Pcount of a certain developing device reaches the predetermined value Pth, after developing, the high accuracy detection mode is started (S005, S400). First, the state is brought into the drive transmission enabled state (S401). To change the toner amount in the foam layer of the supply roller 24, the supply roller 24 is rotated at a first rotation speed for a first predetermined time (S402). The first rotation speed is a rotation speed during normal image formation. This rotation speed is defined as 100%. The rotation time is determined so that the toner amount in the supply roller 24 becomes stable. In this embodiment, the rotation time is 15 seconds. After the rotation for 15 seconds, to measure the remaining toner amount, the development roller 25 is separated from the photosensitive drum 1, and the rotation of the development roller 25 and the supply roller 24 is stopped (S403). Then, a first capacitance $C_1$ is measured (S404).

Then, the state is brought into the drive transmission enabled state again (S405). To change the toner amount in the foam layer of the supply roller 24, the supply roller 24 is rotated at a second rotation speed for a second predetermined time (S406). When the rotation speed during the normal image formation is 100%, the second rotation speed is 40%. The rotation time is determined so that the toner amount in the supply roller 24 becomes stable. In this embodiment, the rotation time is 40 seconds.

After the rotation for 40 seconds, to measure the remaining toner amount, the development roller 25 is separated from the photosensitive drum 1, and the rotation of the development roller 25 and the supply roller 24 is stopped (S407). Then, a second capacitance $C_2$ is measured (S408). (Since the toner amount in the supply roller 24 becomes stable faster if the rotation speed is a higher rotation speed of the first and second rotation speeds, the rotation time at the higher rotation speed is shorter than the rotation time at a lower rotation speed. Accordingly, the time required for the high accuracy detection mode can be reduced as compared with the case in which the rotation time at the higher rotation speed is longer than the rotation time at the lower rotation speed.)

When an absolute value $|C_1-C_2|$ of the difference between the detected capacitances $C_1$ and $C_2$ is $\Delta C$, the relationship between $\Delta C$ and the remaining toner amount in the developing device 5 provides the result similar to one illustrated in FIG. 7. That is, $\Delta C$ is correlated with the remaining toner amount. If the remaining toner amount is large, $\Delta C$ is large. As the remaining toner amount decreases, $\Delta C$ decreases. Hence, by measuring $\Delta C$, the remaining toner amount can be measured with the use of the correlation. By using the calculated value $\Delta C$, it is determined whether $\Delta C$ exceeds a threshold through the flow shown in FIG. 8 like the first embodiment, to perform notification relating to the remaining toner amount and detection relating to the cartridge replacement timing like the first embodiment.

Here, the physical meaning in this embodiment of the correlation between the capacitance difference and the toner amount in the cartridge 21 will be discussed on the basis of the observed result of the developing device 5.

Figure 19:
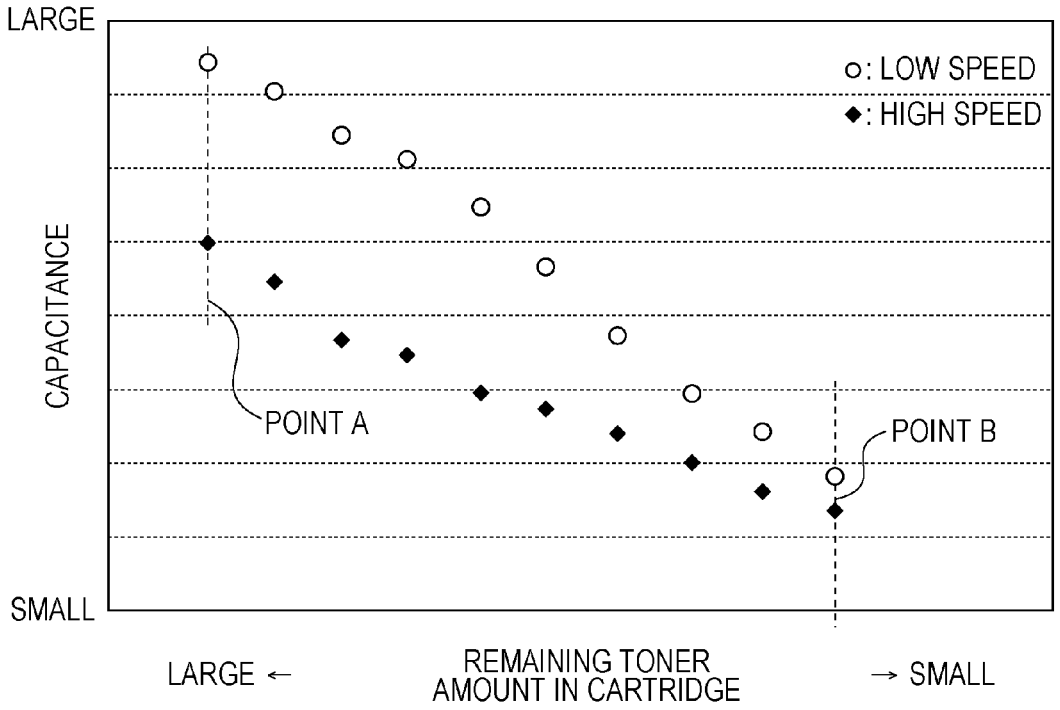
FIG. 19 illustrates capacitances for various speeds.

The inventors of the present invention found that the relationship between the remaining toner amount and the toner amount in the supply roller 24 was changed by the rotation speed of the supply roller 24. FIG. 19 illustrates the toner amount in the cartridge 21 and the contained toner amount in the supply roller 24 when the supply roller 24 is rotated at high and low speeds. When the toner amount in the cartridge 21 is large, the more toner is contained at the low speed (40%). Hence, the difference between the measurement amount at the high speed and the measurement amount at the low speed is large. As the toner amount in the cartridge 21 decreases, the toner amount in the supply roller 24 also decreases in either case of the high speed (100%) and the low speed (40%). If the toner amount in the cartridge 21 is very small (point B), the contained toner amount at the 100% rotation speed is substantially equivalent to the contained toner amount at the 40% rotation speed.

From the observed result by the inventors of the present invention, it was found that the discharged amount of the toner to the portion X (FIG. 2) was larger at the higher rotation speed. The toner sucked from the portion X due to own weight of the toner at the low speed. However, at the high speed, the toner is likely discharged, and the toner is hardly sucked from the portion X. As the result, when the toner remains in the cartridge 21 by a certain degree (point A), the toner amount in the supply roller 24 is smaller when the supply roller 24 is rotated at the high speed.

In contrast, when the toner remains in the cartridge 21 by a very small amount (point B), the toner in the portion Y (FIG. 2) is reduced. The portion Y is a portion in which the supply roller 24 compressed by the contact with the development roller 25 is decompressed. Hence, the toner is sucked by a large amount in the portion Y at the moment of the decompression. Since the toner is mainly sucked into the supply roller 24 from the portion Y, the state of the toner in the portion Y affects the toner amount in the supply roller 24. If the toner amount in the portion Y is small, it may be difficult to supply the supply roller 24 with the toner. The toner amount in the supply roller 24 decreases. As mentioned above, this phenomenon is significantly affected by the state of the toner in the portion Y. Thus, the toner amount in the supply roller 24 may decrease irrespective of the speed.

Consequently, the relationship between the toner amount in the cartridge 21 and the toner amount in the supply roller 24 becomes one shown in FIG. 19. If FIG. 19 is plotted by using the difference therebetween, the relationship similar to that in FIG. 7 is obtained.

Figure 20A:
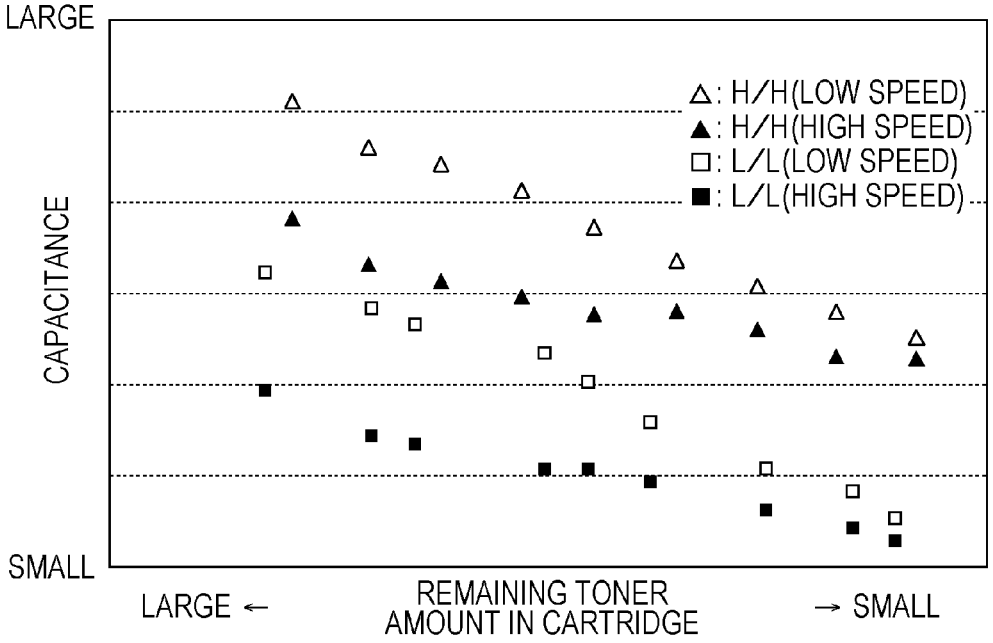
FIG. 20A illustrates the relationship between the capacitance and the remaining toner amount for various environment and speeds.
Figure 20B:
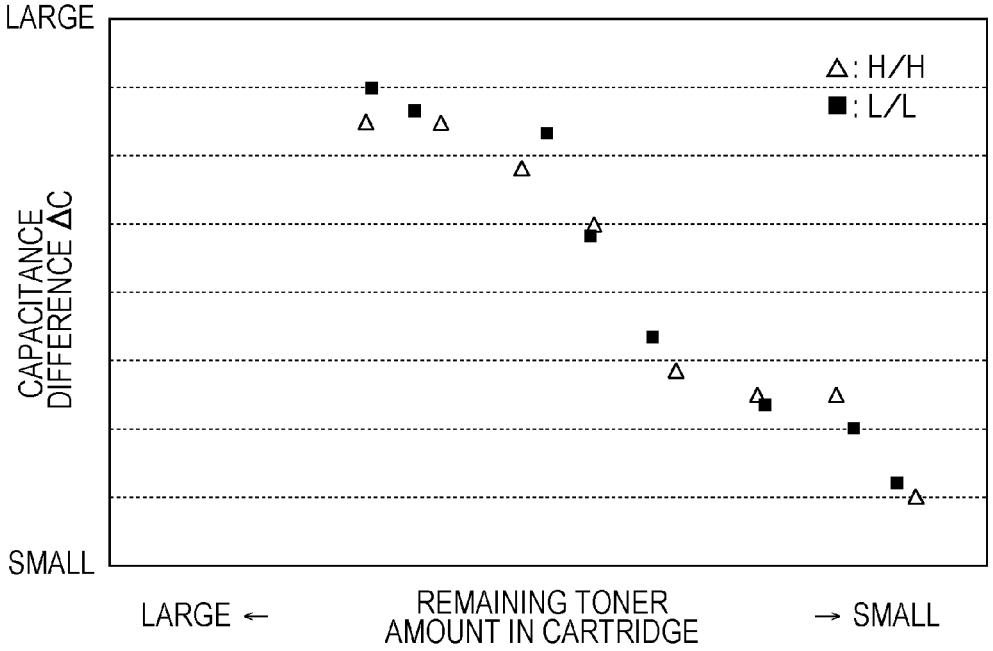
FIG. 20B illustrates the relationship between the capacitance difference and the remaining toner amount when the speed is changed for various environment.

With regard to the above-described points, the advantage according to this embodiment of the present invention will be described in detail. FIG. 20A illustrates the relationship between the toner amount in the cartridge 21 and the capacitance at the respective speeds under high-temperature high-humidity environment (at 30° C. and 80% RH, hereinafter, referred to as H/H) and low-temperature low-humidity environment (at 15° C. and 10% RH, hereinafter, referred to as L/L). The measurement value at H/H indicates a higher capacitance than the measurement value at L/L. This is because, for example, the toner and the foam layer of the supply roller 24 absorb moisture and the resistance changes with temperature. If the capacitance difference is measured at the respective speeds, the result at H/H is similar to the result at L/L as shown in FIG. 20B. With these results, the influence by the temperature and humidity to the capacitance is substantially equivalent even if the speed is changed. Accordingly, if the capacitance differences at the respective speeds are used as parameters for detecting the remaining toner amount, the influence by the change in environment to the capacitance can be canceled. By measuring the remaining toner amount with the high accuracy detection mode according to this embodiment, even if the temperature and humidity environment is changed, the remaining toner amount can be highly accurately measured without the temperature sensor or the humidity sensor. Thus, a user can be notified with high accuracy that the remaining toner amount is smaller than a predetermined amount or that a cartridge 21 has to be replaced, without the temperature sensor or the humidity sensor even if the temperature and humidity environment is changed.

In this embodiment, the first rotation speed of the supply roller 24 is high, and the subsequent second rotation speed is low in the high accuracy detection mode. This is because if the high accuracy detection mode is ended after the rotation at the low speed, the supply roller 24 can contain the toner by a large amount for the next image formation. Accordingly, an image with a low density or an image with an unprinted portion is less frequently generated even if an image with a high coverage rate is output after the high accuracy detection mode. However, to obtain the advantage according to the present invention of highly accurately measuring the remaining toner amount even if the temperature and humidity environment is changed, the rotation speeds do not have to be set in that order.

Fourth Embodiment

Speed and Rotary Drum

An image forming apparatus according to a fourth embodiment of the present invention has a basic configuration similar to the image forming apparatus in FIG. 12 according to the second embodiment. This embodiment executes the flow shown in FIG. 3 for detecting the remaining toner amount like the first to third embodiments. However, a method for changing the toner amount in the foam layer of the supply roller 24 in the high accuracy detection mode after the flow in FIG. 3 is different from that in the second embodiment. In particular, in this embodiment, the drive-P 60 in FIG. 2 can change the rotation speed of the supply roller 24 into a plurality of speeds. Accordingly, unlike the second embodiment, the toner amount in the foam layer can be changed although the potential difference between the shafts 25*a* and 24*a* is not changed.

The same reference signs refer the members having the same configurations and functions as those of the second embodiment. Also, redundant description will be omitted except for the high accuracy detection mode.

Only feature part of the embodiment will be described.

As mentioned above, the image forming apparatus of this embodiment includes the drive-P 60 (FIGS. 2 and 12) that can change the rotation speed of the supply roller 24 into a plurality of speeds.

Figure 21:
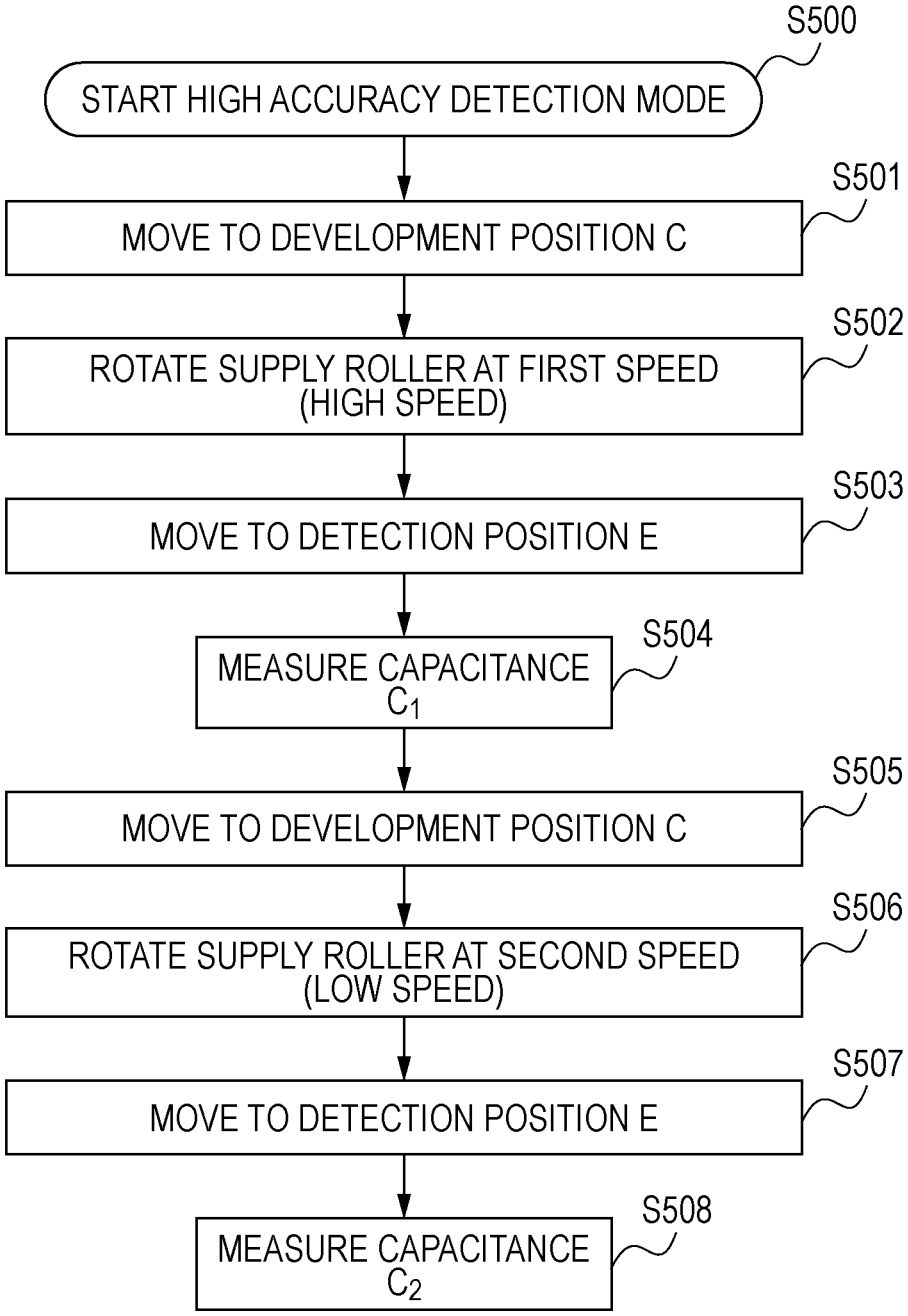
FIG. 21 is a flowchart of a high accuracy detection mode according to a fourth embodiment.
Figure 22:
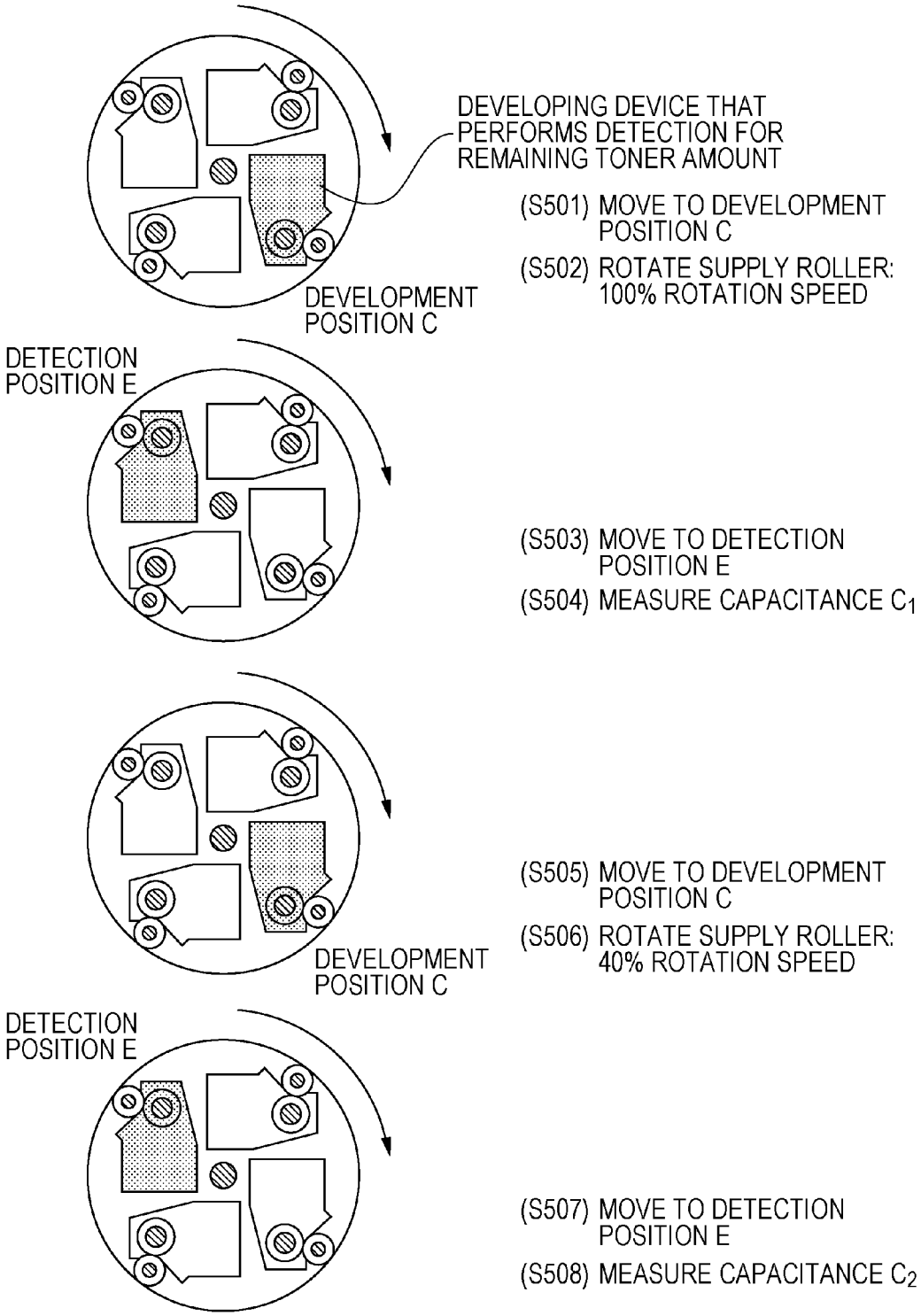
FIG. 22 illustrates movement of a rotary drum in the high accuracy detection mode according to the fourth embodiment.

The high accuracy detection mode that is a feature of this embodiment will be described with reference to FIGS. 21 and 22. If the pixel count integrated value Pcount of a certain developing device reaches the predetermined value Pth, the high accuracy detection mode is started (S500). First, the developing device 5 whose integrated value Pcount reaches the predetermined value Pth is moved to the development position C (S501). To change the toner amount in the foam layer of the supply roller 24, the supply roller 24 is rotated at this position at a first rotation speed for a first predetermined rotation time (S502). The first rotation speed is a rotation speed during normal image formation. This rotation speed is defined as a 100% rotation speed. The first rotation time is determined so that the toner amount in the supply roller 24 becomes stable. In this embodiment, the first rotation time is 15 seconds.

After the rotation for 15 seconds, the developing device 5 is moved to the detection position E (S503), and a first capacitance $C_1$ is measured (S504). Then, the developing device 5 is moved to the development position C again (S505). To change the toner amount in the foam layer of the supply roller 24, the supply roller 24 is rotated at this position at a second rotation speed that is lower than the first rotation speed, for a second predetermined time (S506). The second rotation speed is 40% of the rotation speed during normal image formation. The second rotation time is determined so that the toner amount in the supply roller 24 becomes stable. In this embodiment, the second rotation time is 30 seconds. Then, the developing device 5 is moved to the detection position E (S507), and a second capacitance $C_2$ is measured (S508).

An absolute value $|C_1-C_2|$ of the difference between the detected capacitances $C_1$ and $C_2$ is $\Delta C$. In this embodiment, by using the calculated value $\Delta C$, it is determined whether $\Delta C$ exceeds a threshold through the flow shown in FIG. 8, to perform notification relating to the remaining toner amount and detection relating to the cartridge 21 replacement timing like the first to third embodiments.

Figure 23A:
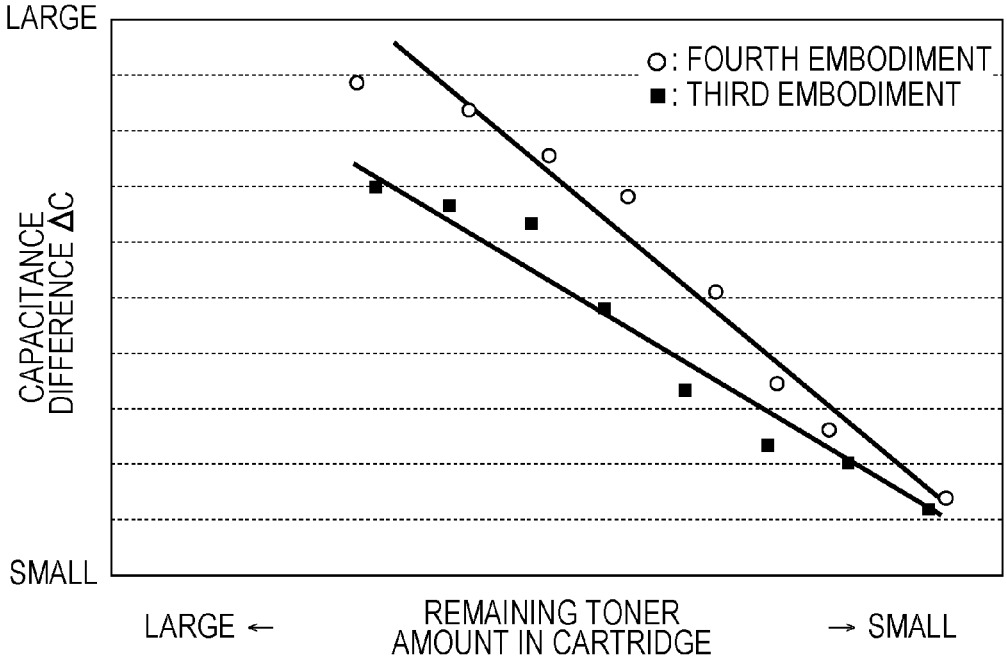
FIG. 23A is a graph showing the relationship between the remaining toner amount and the capacitance difference according to the third and fourth embodiments.

This embodiment uses the drive-P 60 functioning as the changing unit like the third embodiment. This embodiment provides an advantage on account of the use of the rotary drum 50, in addition to the advantage attained in the third embodiment. The advantage will be described. The capacitance difference $\Delta C$ in this embodiment has a tendency as shown in FIG. 23A. Referring to FIG. 23A, the inclination of the capacitance difference $\Delta C$ with respect to the toner amount in the cartridge 21 in this embodiment is larger than that of the third embodiment. Accordingly, the variation in remaining toner amount is smaller than the variation appearing during the detection for the capacitance difference $\Delta C$. The remaining toner amount can be more highly accurately detected than the third embodiment.

Figure 23B:
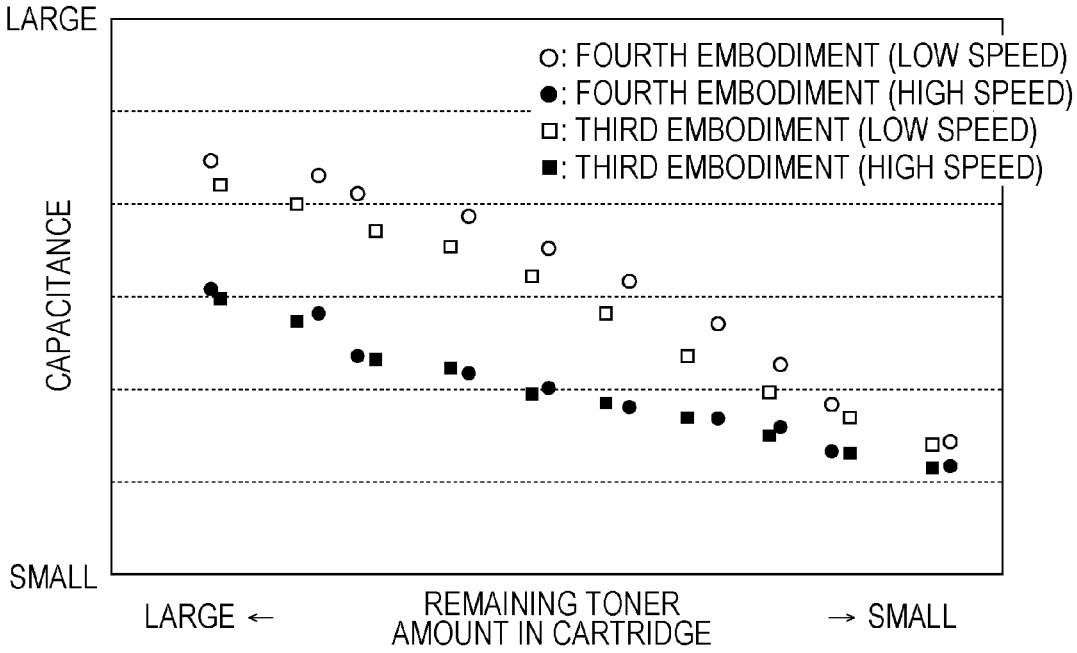
FIG. 23B is a graph showing the relationship between the remaining toner amount and the capacitance for various speeds according to the third and fourth embodiments.

FIG. 23B illustrates the relationship of the remaining toner amount in the cartridge 21 with respect to the capacitance after the supply roller 24 is rotated at the low speed, and to the capacitance after the supply roller 24 is rotated at the high speed by using the configuration of this embodiment. As compared with the third embodiment, it is found that a measurement value with the low-speed rotation is large. The reason why the result in FIG. 23B is obtained will be discussed. FIG. 16 illustrates the movement of the toner when the rotary drum 50 is rotated when the amount of the toner is small. After the rotation at the development position C, a large amount of the toner is present above the supply roller 24 (portion X) as shown in part (A) in FIG. 16. The rotary drum 50 is rotated from this state successively to part (B), part (C), part (D), and then part (E) in FIG. 16, the toner staying in the portion X located upstream the contact position, at which the development roller 25 contacts the supply roller 24, in a rotating direction of the supply roller 24 is conveyed to the portion Y located downstream the contact position in the rotating direction of the supply roller 24.

The supply roller 24 is supplied with the toner mainly through suction from the portion Y. Hence, by conveying the toner to the portion Y by the rotation of the rotary drum 50, the toner in the supply roller 24 can be increased. When the supply roller 24 is rotated at the high speed, the amount of the toner discharged to the portion X is larger than the amount of the toner supplied from the portion Y. Hence, the toner amount hardly varies depending on whether the rotary drum 50 is rotated or not. However, if the supply roller 24 is rotated at the low speed, since the discharge amount of the toner to the portion X is small, the supply roller 24 is supplied with the toner mainly through the suction from the portion Y. Accordingly, the supply roller 24 easily sucks the toner. The capacitance does not markedly change after the rotation at the high speed, whereas the capacitance increases after the rotation at the low speed. The capacitance difference is larger as compared with a configuration without the rotary drum 50. If the toner amount is very small, the toner in the portion Y is used up. The toner amount in the supply roller 24 becomes small after the rotation at the low speed. The case with the rotation of the rotary drum 50 is no longer different from the third embodiment.

Hence, the inclination of the capacitance difference $\Delta C$ with respect to the toner amount in the cartridge 21 is larger than that of the third embodiment. That is, the variation in remaining toner amount is smaller than the variation appearing during the detection for the capacitance difference $\Delta C$ in the third embodiment. The remaining toner amount and the replacement of the developing device 5 can be highly accurately notified.

For another advantage of the rotary drum 50, since the toner is conveyed to the portion Y through the rotation of the rotary drum 50, the supply roller 24 can easily suck the toner. Thus, the toner amount in the supply roller 24 can become stable faster during the rotation at the low speed. Accordingly the rotation time at the low speed can be reduced. The rotary drum 50 attains another advantage such that the toner is hardly affected even if the toner is left for a long period because the toner is stirred by the rotation of the rotary drum 50. Thus, the toner amount in the supply roller 24 becomes stable after the rotation of the supply roller 24. The variation in capacitance can be reduced.

Fifth Embodiment

Posture

An image forming apparatus according to a fifth embodiment of the present invention has a basic configuration similar to the image forming apparatus in FIG. 1 according to the first embodiment. A developing device used in this embodiment has a configuration shown in FIG. 24. In this embodiment, a method for changing the toner amount in the foam layer of the supply roller 24 in the high accuracy detection mode after the flow shown in FIG. 3 differs from that in the first embodiment. In particular, the image forming apparatus according to this embodiment can change the toner amount in the foam layer by changing the posture of the developing device 5 from a first posture to a second posture, and by rotating the supply roller 24 at the second posture, the second posture having a height of a top of the supply roller 24, the height which is different from a height of the top of the supply roller 24 of the first posture, with respect to a height of a top of the development roller 25.

The same reference signs refer the members having the same configurations and functions as those of the first embodiment. Also, redundant description will be partly omitted except for the high accuracy detection mode.

Only feature part of the embodiment will be described.

Figure 24:
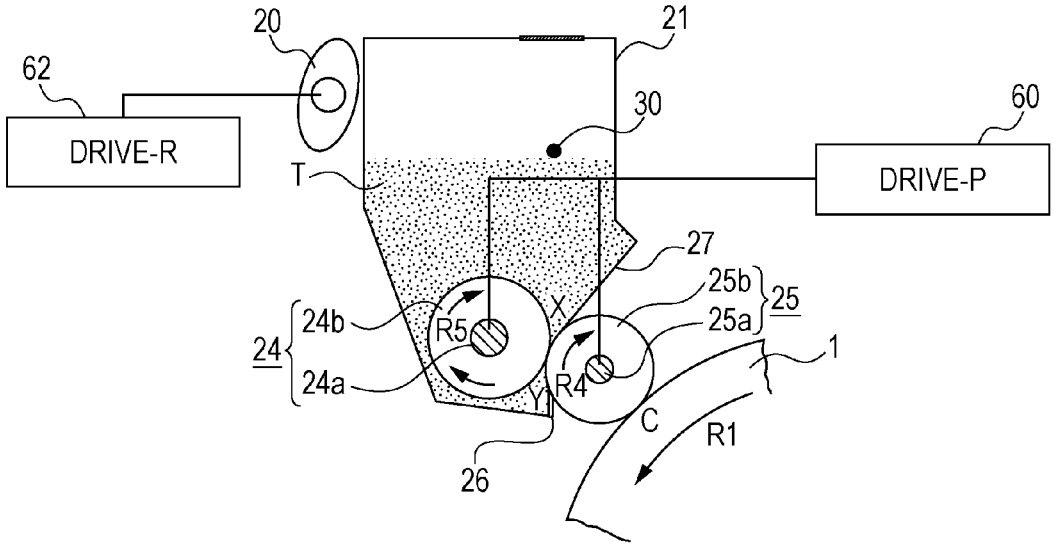
FIG. 24 schematically illustrates a developing device used in an image forming apparatus according to a fifth embodiment.

The developing device 5 will be described in detail below with reference to FIG. 24. The developing device 5 includes a cartridge 21 that contains a toner T, a development roller 25 serving as a toner bearing member that is arranged at an opening of the cartridge 21, a restriction blade 27 serving as a toner restriction member, and a supply roller 24 serving as a toner supply member that is provided in the cartridge 21 at a position adjacent to the development roller 25. The development roller 25 rotates while being in contact with the photosensitive drum 1 during developing. A driving force is transmitted from a drive-P 60 serving as a first drive and provided in the apparatus body of the image forming apparatus, to the development roller 25 and the supply roller 24. Hence, the development roller 25 and the supply roller 24 are synchronously rotated and stopped. After developing, by using a drive-R 60, which is provided in the apparatus body of the image forming apparatus as a posture changing device, a cam 20 shown in FIG. 24 is rotated to push an upper portion of the cartridge 21. Thus, the development roller 25 is separated from the photosensitive drum 1. After the separation, the rotation of the drive-P 60 (first drive) is stopped.

A separation distance between the development roller 25 and the photosensitive drum 1 is determined by a rotation phase of the cam 20. At the same time, the posture of the developing device 5 is determined. A swing center 30 shown in FIG. 24 for the separation of the developing device 5 by the posture changing device is aligned with the center of a first step input gear that transmits driving forces from the drive-P 60 in the apparatus body of the image forming apparatus to the development roller 25 and the supply roller 24. Even when the development roller 25 is separated from the photosensitive drum 1, the supply roller 24 can rotate.

Although described later, required herein is that the developing device 5 allows the supply roller 24 to be rotatable at a plurality of different posture steps in order to measure capacitances after the supply roller 24 is rotated to the plurality of different posture steps. For example, a plurality of drives may be provided to transmit driving forces to the supply roller 24 so that the supply roller 24 can be rotated to the different posture steps.

Figure 25A:
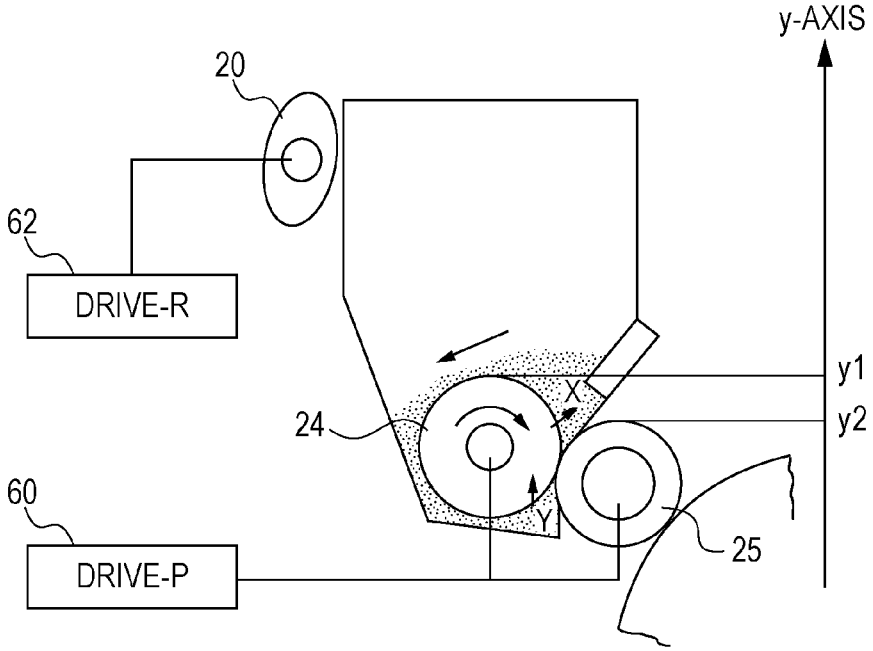
FIG. 25A illustrates movement of a toner around a supply roller when a developing device is in a posture during image formation according to a fifth embodiment.

During image formation, while the development roller 25 is in contact with the photosensitive drum 1, the developing device 5 has a posture of $\Delta y=4.5$ mm where $\Delta y$ is a difference $y1-y2$ between a top position y1 of the supply roller 24 and a top position y2 of the development roller 25 in the y-axis direction, which is directed upward in the vertical direction, as shown in FIG. 25A. However, as described above, the posture of the developing device 5 can be changed to the plurality of different steps at which the supply roller 24 is rotatable. In this embodiment, though described later, the supply roller 24 can be rotated in two separation states (FIGS. 26A and 26B) with different postures that are different from a state in which the development roller 25 is in contact with the photosensitive drum 1 during image formation. The posture of the developing device 5 is changed to a desirable posture at desirable timing by the rotation of the drive-R 60 and the cam 20.

Figure 27:
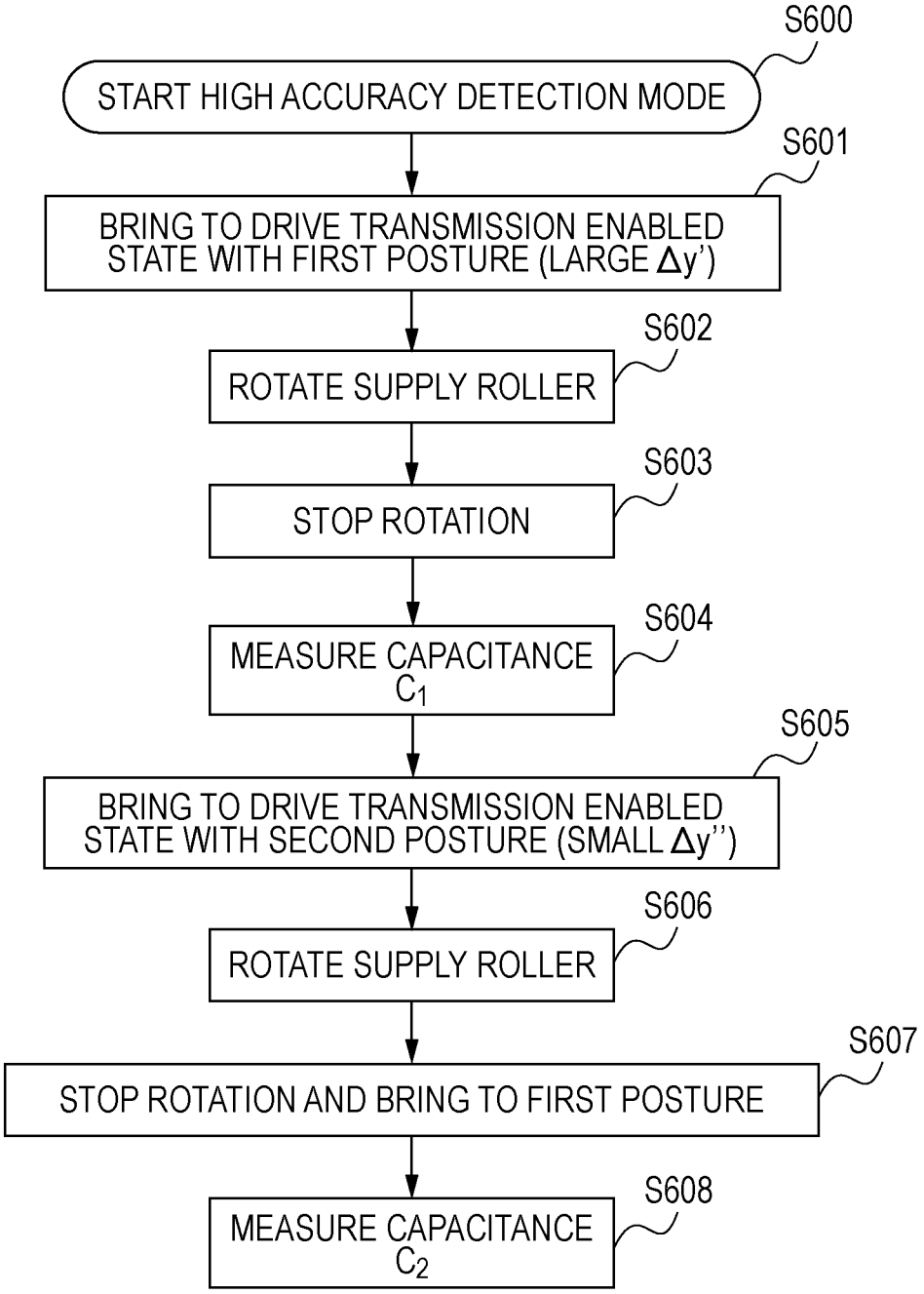
FIG. 27 is a flowchart of a high accuracy detection mode according to the fifth embodiment.

The high accuracy detection mode that is a feature of the present invention will be described with reference to FIG. 27. If the pixel count integrated value Pcount of a certain developing device reaches the predetermined value Pth, after developing, the high accuracy detection mode is started (S005, S600). The drive-R 60 rotates the cam 20, and the posture of the developing device 5 is changed by the drive-P 60 to the first posture that is in the drive transmission enabled state, in which the drive-P 60 can transmit driving forces to the development roller 25 and the supply roller 24 (S601), and to change the toner amount in the foam layer of the supply roller 24, the supply roller 24 is rotated at a predetermined rotation speed for a first predetermined time (S602).

Figure 26A:
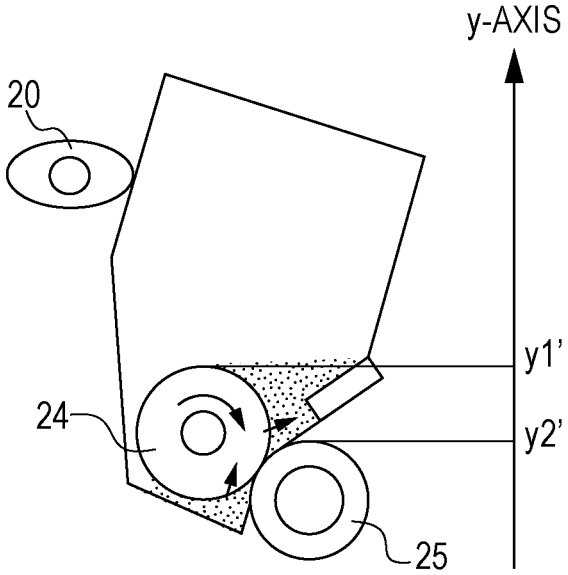
FIG. 26A illustrates movement of the toner around the supply roller when the developing device is in a first posture according to the fifth embodiment.
Figure 26B:
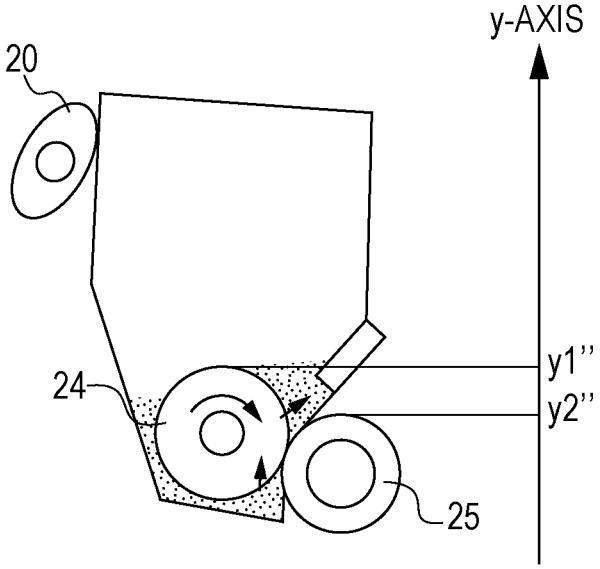
FIG. 26B illustrates movement of the toner around the supply roller when the developing device is in a second posture according to the fifth embodiment.

At the first posture, referring to FIG. 26A, a difference $\Delta y'$ between a top position y1' of the supply roller 24 and a top position y2' of the development roller 25 in the y-axis direction, which is directed upward in the vertical direction, namely, $\Delta y'=y1'-y2'$, is 8 mm. The development roller 25 is separated from the photosensitive drum 1. When the rotation speed of the supply roller 24 during the normal image formation is 100%, the rotation speed of the supply roller 24 used herein is 40%. The rotation time is determined so that the toner amount in the supply roller 24 becomes stable. In this embodiment, the rotation time is 50 seconds. After the rotation for 50 seconds, the rotation of the development roller 25 and the supply roller 24 is stopped for measurement of a remaining toner amount (S603). Then, a first capacitance $C_1$ is measured (S604).

The cam 20 is rotated, and the posture of the developing device 5 is changed by the drive-P 60 to the second posture that is in the drive transmission enabled state (S605). To change the toner amount in the foam layer of the supply roller 24 again, the supply roller 24 is rotated at a predetermined rotation speed for a second predetermined time (S606). At the second posture, referring to FIG. 26B, a difference $\Delta y''$ between a top position y1" of the supply roller 24 and a top position y2" of the development roller 25 in the y-axis direction, which is directed upward in the vertical direction, namely, $\Delta y''=y1''-y2''$, is 5 mm. The development roller 25 is separated from the photosensitive drum 1. The rotation speed of the supply roller 24 used herein is 40%.

The rotation time is determined so that the toner amount in the supply roller 24 becomes stable. In this embodiment, the rotation time is 25 seconds. After the rotation for the second predetermined time, to measure the remaining toner amount, the rotation of the development roller 25 and the supply roller 24 is stopped. The posture of the developing device 5 is changed again to the first posture for the measurement of the first capacitance $C_1$ by the rotation of the cam 20 (S607). However, the developing device 5 does not have to be brought into the first posture in S607 if electric contact is provided for the developing device 5 so that the capacitance can be detected even at the second posture. Then, a second capacitance $C_2$ is measured (S608).

In this embodiment, the development roller 25 is separated from the photosensitive drum 1 at both the first and second postures when the supply roller 24 is rotated, in order to prevent the photosensitive drum 1 from being scratched by the development roller 25. However, to attain the advantage of the present invention, the supply roller 24 may be rotated while the development roller 25 is in contact with the photosensitive drum 1 as long as the first and second postures provides the different heights of the top of the toner supply member with respect to the top of the toner bearing member.

When an absolute value $|C_1-C_2|$ of the difference between the detected capacitances $C_1$ and $C_2$ is $\Delta C$, the relationship between $\Delta C$ and the remaining toner amount in the developing device 5 becomes similar to one illustrated in FIG. 7.

In this embodiment, by using the calculated value $\Delta C$, it is determined whether $\Delta C$ exceeds a threshold through the flow shown in FIG. 8 like the first embodiment, to perform notification relating to the remaining toner amount and detection relating to the replacement timing of the cartridge 21 like the first embodiment. Accordingly, this embodiment can attain the advantage similar to that of the first embodiment.

Here, the physical meaning of the correlation between the capacitance difference and the remaining toner amount in the cartridge 21 will be discussed on the basis of the observed result of the developing device 5.

The inventors of the present invention found that the relationship between the remaining toner amount and the toner amount in the supply roller 24 was changed by the posture of the developing device 5 when the supply roller 24 was rotated. FIG. 25A illustrates the relationship of the contained toner amount in the supply roller 24 with respect to the remaining toner amount in the cartridge 21 when the supply roller 24 is rotated at the first and second postures in a state close to the run out of the toner. If the remaining toner amount in the cartridge 21 is large, the supply roller 24 contains the toner by a larger amount at the second posture ($\Delta y''$=5 mm) with a small value of $\Delta y''$, and markedly differs from the contained toner amount at the first posture ($\Delta y'$=8 mm) with a large value of $\Delta y'$. As the remaining toner amount in the cartridge 21 becomes small, the toner amount in the supply roller 24 becomes small at both the first posture ($\Delta y'$=3 mm) and the second posture ($\Delta y''$=5 mm). In a state in which the remaining toner amount in the cartridge 21 is very small (point B), the contained toner amount at the first posture is substantially the same as that at the second posture.

Figure 28:
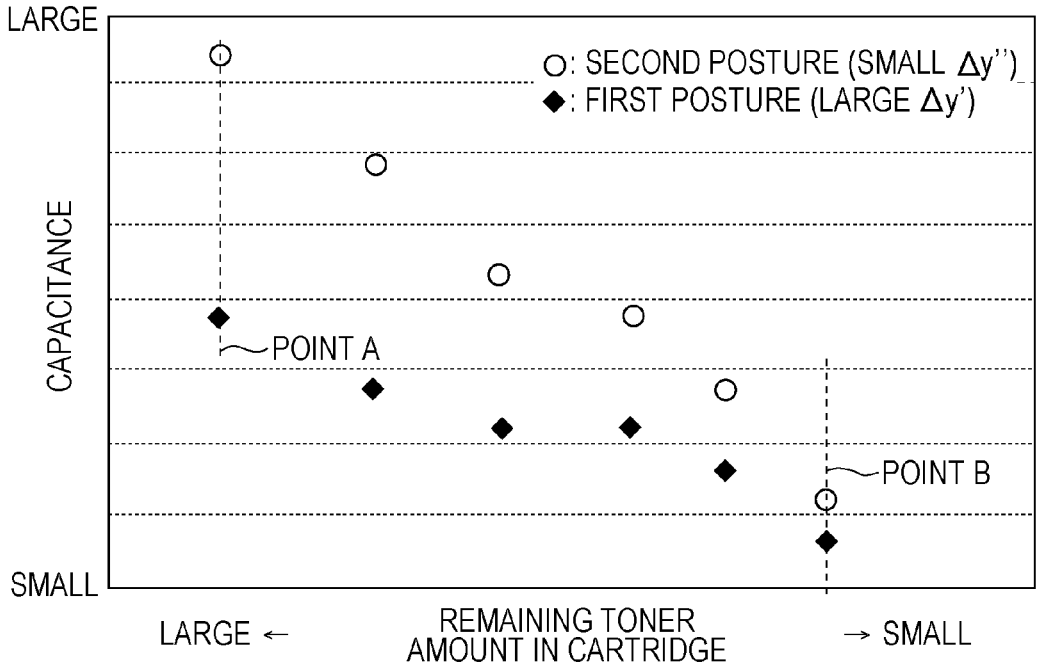
FIG. 28 illustrates capacitances for various postures of the developing device according to the fifth embodiment.

From the observed result by the inventors of the present invention, it was found that the toner could not move across the top of the supply roller 24 from the portion X to the portion Y in a direction opposite to the rotating direction of the supply roller 24 around the supply roller 24 as shown in FIG. 25A in the state close to the run out of the toner. Thus, the toner discharged from the supply roller 24 by the compression of the supply roller 24 stays in the portion X. Also, it was found that the toner amount in the portion X was large as shown in FIG. 26A when the developing device 5 was at the first posture ($\Delta y'$=8 mm) with a large capacity for the toner which is discharged from the supply roller 24 to the portion X and stays in the portion X without moving toward the portion Y. Also, the toner amount in the portion X is larger when the developing device 5 is at the first posture ($\Delta y'$=8 mm) as compared with the second posture ($\Delta y''$=5 mm). The toner amount in the portion Y becomes small, and the toner is hardly sucked to the supply roller 24 from the portion Y. As the result, when the toner remains in the cartridge 21 by a certain amount (point A in FIG. 28), the toner amount in the supply roller 24 becomes smaller when the supply roller 24 is rotated at the first posture ($\Delta y'$=8 mm) as compared with that the supply roller 24 is rotated at the second posture ($\Delta y''$=5 mm).

Also, when the remaining toner amount in the cartridge 21 is very small (point B in FIG. 28), the toner in the portion Y (FIG. 24) is reduced at both the first and second postures. The portion Y is a portion in which the supply roller 24 compressed by the contact with the development roller 25 is decompressed. Hence, the toner is sucked by a large amount in the portion Y at the moment of the decompression. Since the toner is mainly sucked into the supply roller 24 from the portion Y, the state of the toner in the portion Y affects the toner amount in the supply roller 24. If the toner amount in the portion Y is small, it may be difficult to supply the supply roller 24 with the toner. The toner amount in the supply roller 24 decreases. As mentioned above, this phenomenon is significantly affected by the state of the toner in the portion Y. Thus, the toner amount in the supply roller 24 may decrease irrespective of the posture of the developing device 5.

Consequently, the relationship between the remaining toner amount in the cartridge 21 and the toner amount in the supply roller 24 becomes one shown in FIG. 25A. If FIG. 25A is plotted by using the difference therebetween, the relationship like one in FIG. 7 is obtained.

Figure 29A:
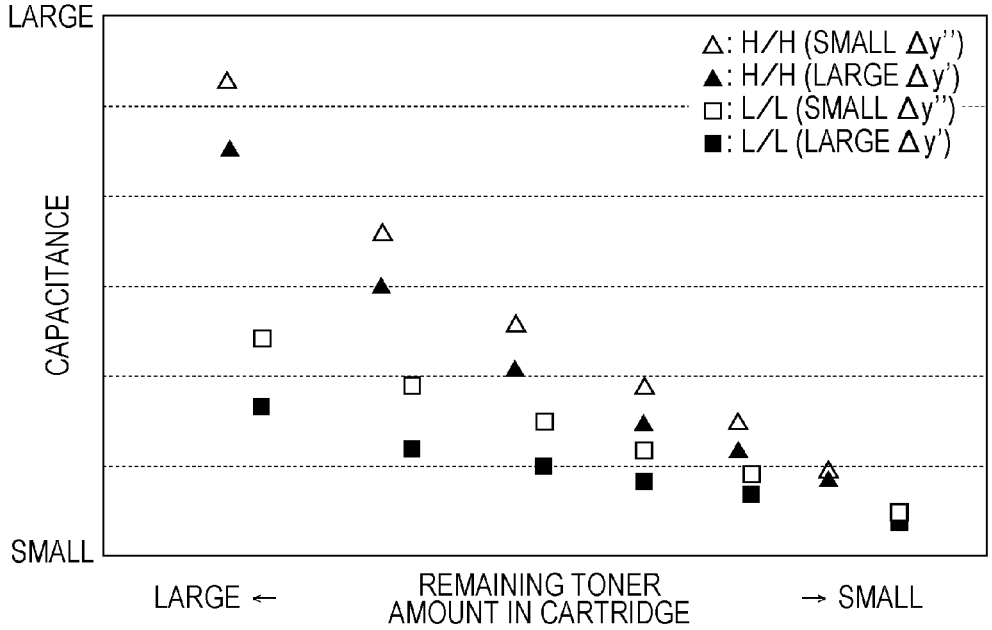
FIG. 29A illustrates the relationship between the remaining toner amount and the capacitance for various postures of the developing device under high-temperature and high-humidity environment and low-temperature and low-humidity environment.
Figure 29B:
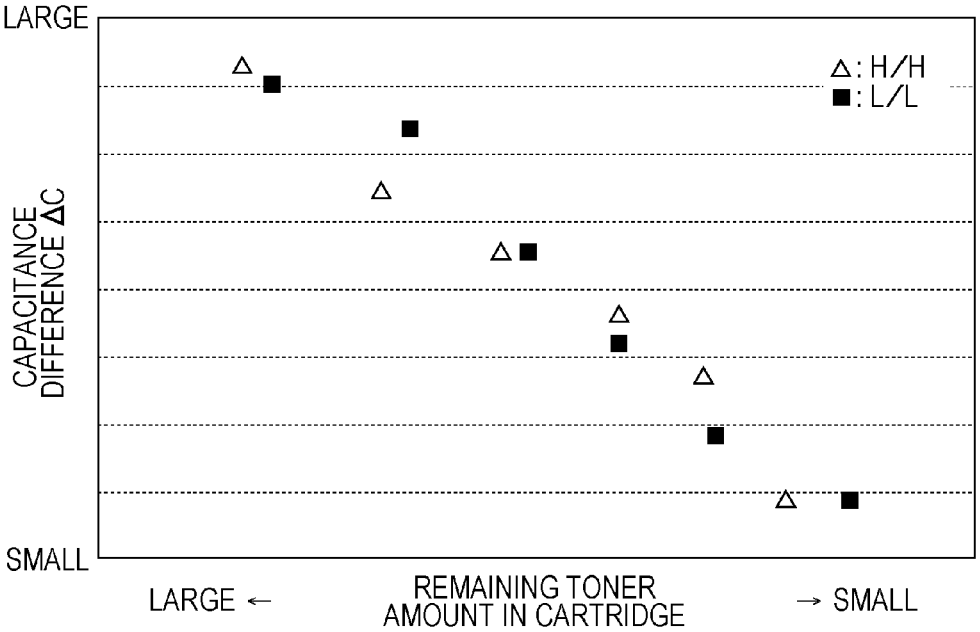
FIG. 29B illustrates the relationship between the remaining toner amount and the capacitance difference for various postures of the developing device under high-temperature and high-humidity environment and low-temperature and low-humidity environment.

With regard to the above-described points, the advantage according to this embodiment of the present invention will be described in detail. FIG. 29A illustrates the relationship between the remaining toner amount in the cartridge 21 and the capacitance for the respective postures under high-temperature high-humidity environment (at 30° C. and 80% RH, hereinafter, referred to as H/H) and low-temperature low-humidity environment (at 15° C. and 10% RH, hereinafter, referred to as L/L). The measurement value at H/H indicates a higher capacitance than the measurement value at L/L. If the capacitance difference is measured for the respective postures, the result at H/H is similar to the result at L/L as shown in FIG. 29B.

With these results, the influence by the temperature and humidity to the capacitance is substantially equivalent even if the posture of the developing device 5 is changed. Accordingly, if the capacitance differences at the respective postures are used as parameters for detecting the remaining toner amount, the influence by the change in environment to the capacitance can be canceled. By measuring the remaining toner amount with the difference detection method according to this embodiment, even if the temperature and humidity environment is changed, the remaining toner amount can be highly accurately measured without the temperature sensor or the humidity sensor. Thus, a user can be notified with high accuracy that the remaining toner amount is smaller than a predetermined amount or that a cartridge 21 has to be replaced, without a temperature sensor or a humidity sensor even if the temperature and humidity environment is changed.

In this embodiment, the difference $\Delta y''=y1''-y2''$ between the top position of the supply roller 24 and the top position of the development roller 25 at the second posture is smaller than the difference $\Delta y'=y1'-y2'$ between the top position of the supply roller 24 and the top position of the development roller 25 at the first posture, for the rotation of the supply roller 24 in the high accuracy detection mode. The differences Δy' and Δy" include negative values, and Δy'>Δy" is established.

Hence, if the high accuracy detection mode is ended after the rotation at the posture with the small value of Δy", the development can be started for the following image formation when the supply roller 24 contains a large amount of toner. Accordingly, an image with a low density or an image with an unprinted portion is less frequently generated even if an image with a high coverage rate is output after the high accuracy detection mode. However, to obtain the advantage according to the present invention of highly accurately measuring the remaining toner amount even if the temperature and humidity environment is changed, the postures of the developing device 5 during the rotation of the supply roller 24 do not have to be set in that order.

Figure 30A:
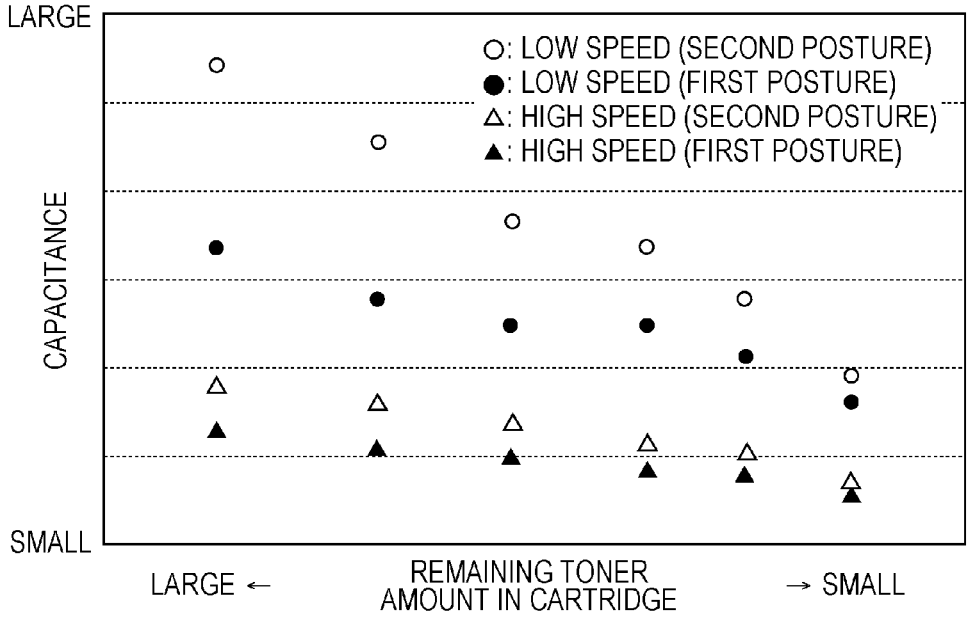
FIG. 30A illustrates the relationship between the remaining toner amount and the capacitance for various postures of the developing device for high speed rotation and low speed rotation of the supply roller.
Figure 30B:
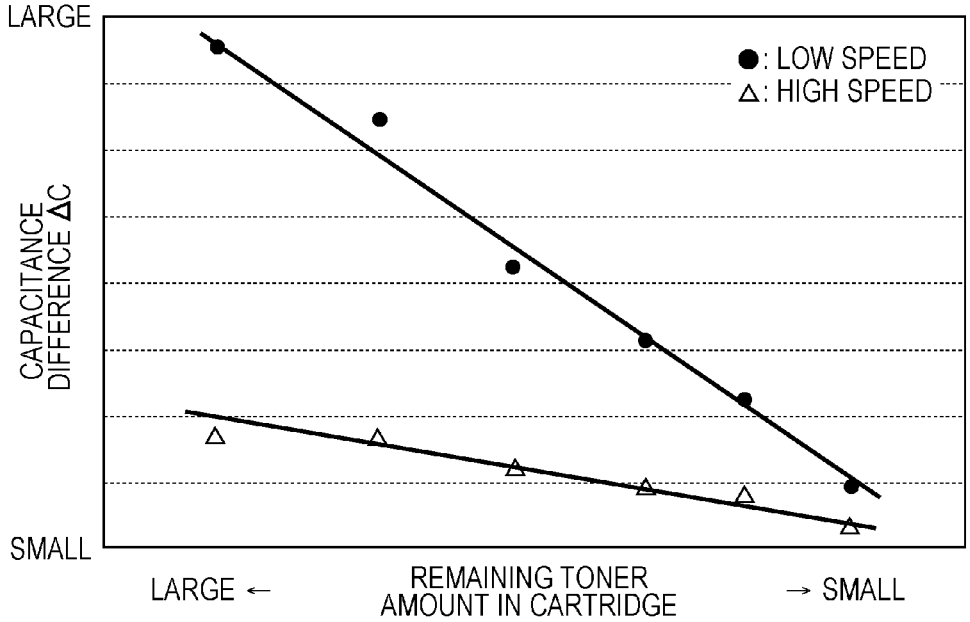
FIG. 30B illustrates the relationship between the remaining toner amount and the capacitance difference for various postures of the developing device for high speed rotation and low speed rotation of the supply roller.

Also, in this embodiment, the rotation speed of the supply roller 24 in the high accuracy detection mode is lower than the rotation speed during the image formation. Accordingly, the remaining toner amount can be further highly accurately measured. The resulting advantage will be described below with reference to FIGS. 30A and 30B. Referring to FIG. 30A, the contained toner amount with the low-speed rotation is larger than the contained toner amount with the high-speed rotation. If the difference between the first posture and the second posture is plotted for the respective speeds, the result becomes like a graph in FIG. 30B. With the low-speed rotation, regarding the input and output of the toner to and from the foam layer of the supply roller 24, the suction of the toner from the portion Y is predominant over the discharge of the toner to the portion X. If the toner remains in the cartridge 21 by a certain amount in a state in which the toner amount in the portion Y is large, the low-speed rotation is selected. Accordingly, if the posture is changed, the capacitance difference ΔC between the different postures becomes large as shown in FIG. 30B.

In contrast, if the toner amount in the cartridge 21 is very small, the toner amount in the portion Y is small. The capacitance difference ΔC is not substantially changed by the change in rotation speed. If the low-speed rotation is selected, the inclination of the capacitance difference ΔC becomes large with respect to the remaining toner amount in the cartridge 21. If the inclination of the capacitance difference ΔC becomes large, the variation in remaining toner amount becomes smaller than the variation appearing during the detection for the capacitance difference ΔC. The remaining toner amount can be highly accurately detected. As described above, by changing the rotation speed of the supply roller 24 to the lower rotation speed as compared with the speed during the image formation like this embodiment, the remaining toner amount can be highly accurately measured.

The supply roller rotation time required so that the toner amount in the supply roller 24 becomes stable depends on, for example, the rotation speed of the supply roller 24. Hence, the first and second predetermined times are not limited to the values according to this embodiment, and may be the same or different.

Sixth Embodiment

Posture and Rotary Drum

An image forming apparatus according to a sixth embodiment of the present invention has a basic configuration similar to the image forming apparatus in FIG. 12 according to the second embodiment. In this embodiment, to detect the remaining toner amount, the flow shown in FIG. 3 is performed, and then the high accuracy detection mode using the change in posture of the developing device 5 is performed like the image forming apparatus according to the fifth embodiment. However, a method for changing the posture in this embodiment is different from that in the fifth embodiment. In particular, referring to FIG. 12, the image forming apparatus according to this embodiment includes a rotary drum 50 that supports the developing device 5 and is rotatable, and a drive-Q 60 that rotates the rotary drum 50. The rotary drum 50 is rotated by the drive-Q 60 to change the posture of the developing device 5 from the first posture to the second posture.

Only feature part of the embodiment will be described.

Figure 25B:
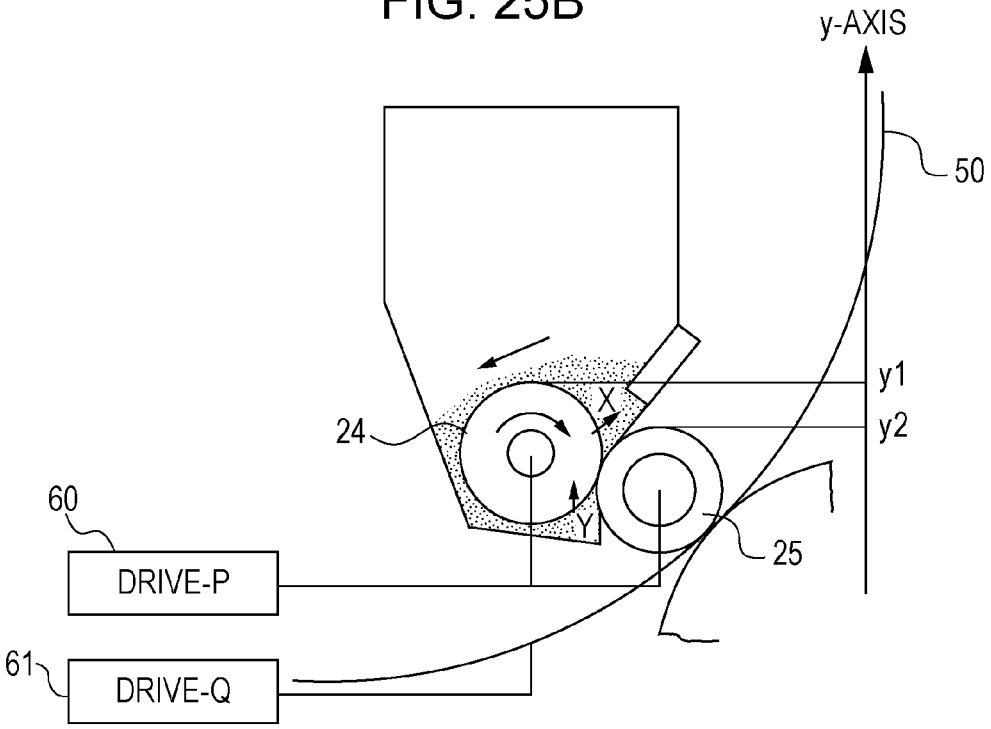
FIG. 25B illustrates movement of a toner around a supply roller when a developing device is in a posture during image formation according to a sixth embodiment.

The developing device 5 used in the sixth embodiment has a configuration similar to the configuration of the developing device used in the fifth embodiment shown in FIG. 24. The developing device 5 of the sixth embodiment has the development roller 25 and the supply roller 24 similar to those of the fifth embodiment. The peripheral speeds of the development roller 25 and the supply roller 24 during the image formation are also similar to those in the fifth embodiment. During the image formation, referring to FIG. 25B, the developing device 5 has a posture of Δy=4.5 mm where Δy is a difference y1−y2 between a top position y1 of the supply roller 24 and a top position y2 of the development roller 25 in the y-axis direction, which is directed upward in the vertical direction.

In this embodiment, the posture of the developing device 5 can be changed to a plurality of postures at which the supply roller 24 is rotatable like the fifth embodiment. The posture of the developing device 5 is changed when the drive-Q 60 (second drive) provided in the apparatus body of the image forming apparatus rotates the rotary drum 50 that supports the developing device 5. In other words, the posture of the developing device 5 is changed to a desirable posture when the position of the developing device 5 relative to the center of the rotary drum 50 is changed, the position which is determined by a rotation phase of the rotary drum 50.

Figure 26C:
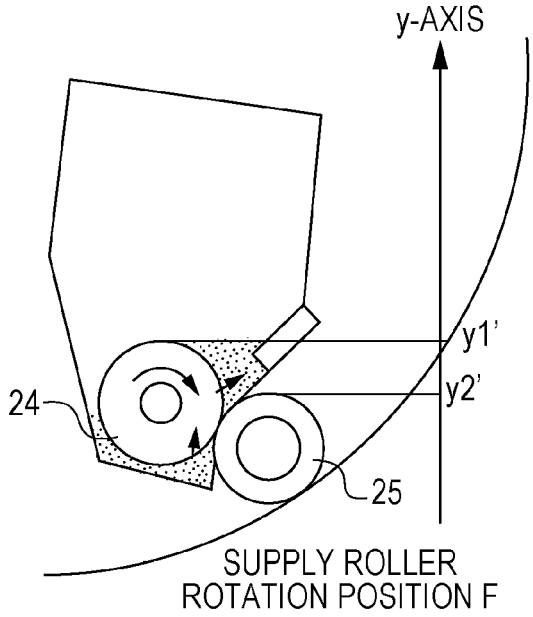
FIG. 26C illustrates movement of the toner around the supply roller when the developing device is in a first posture according to the sixth embodiment.
Figure 26D:
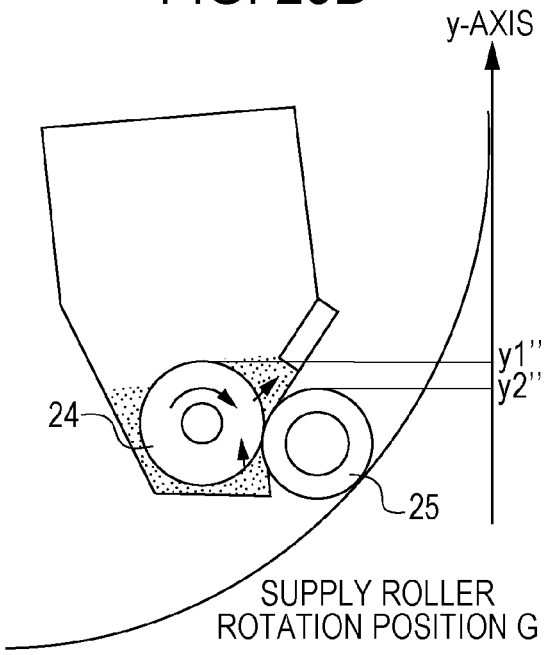
FIG. 26D illustrates movement of the toner around the supply roller when the developing device is in a second posture according to the sixth embodiment.

In this embodiment, an Oldham coupling is used. Hence, driving forces are transmitted from the drive-P 60 (first drive) provided in the apparatus body of the image forming apparatus to the development roller 25 and the supply roller 24 through the Oldham coupling while the developing device 5 is located at any of different development positions. In this embodiment, though described later, the supply roller 24 can be rotated when the developing device 5 is located at two separation positions F (part (a) in FIG. 31 and FIG. 26C) and G (part (c) in FIG. 31 and FIG. 26D) at different postures. The separation position F and G are provided when the rotary drum 50 is rotated from the development position C, at which the development roller 25 contacts the photosensitive drum 1 during the image formation. Required herein is that the supply roller 24 is rotatable at the different postures. For example, a plurality of drives may be provided for transmitting a driving force to the supply roller 24, and the supply roller 24 may be rotated at one of the different postures by one of the drives.

Next, a method for measuring a remaining toner amount of the developing device 5 according to this embodiment will be described. The method for measuring the remaining toner amount is basically similar to that of the first embodiment, and hence, only feature part of this embodiment will be described. In this embodiment, the developing device 5 as the subject of detection for the remaining toner amount is provided on a rotary support member, i.e., the rotary drum 50. The drive-Q 60 (second drive) rotates the rotary drum 50, so that the developing device 5 is moved to a detection position E for measurement. The detection position E is the position of the developing device 5*c* in FIG. 12. The AC power supply 91 for detection is connected with the shaft 24*a* (first electrode member) of the supply roller 24, and the detection circuit 80 is connected with the shaft 25*a* (second electrode member) of the development roller 25 at the detection position E through electrode terminals (not shown).

At the detection position E, since a toner around the supply roller 24 is dropped by own weight, the influence of the toner near the supply roller 24 can be reduced. Accordingly, the toner near the supply roller 24 hardly disturbs the detection. The toner amount in the supply roller 24 can be correctly measured.

Figure 3:
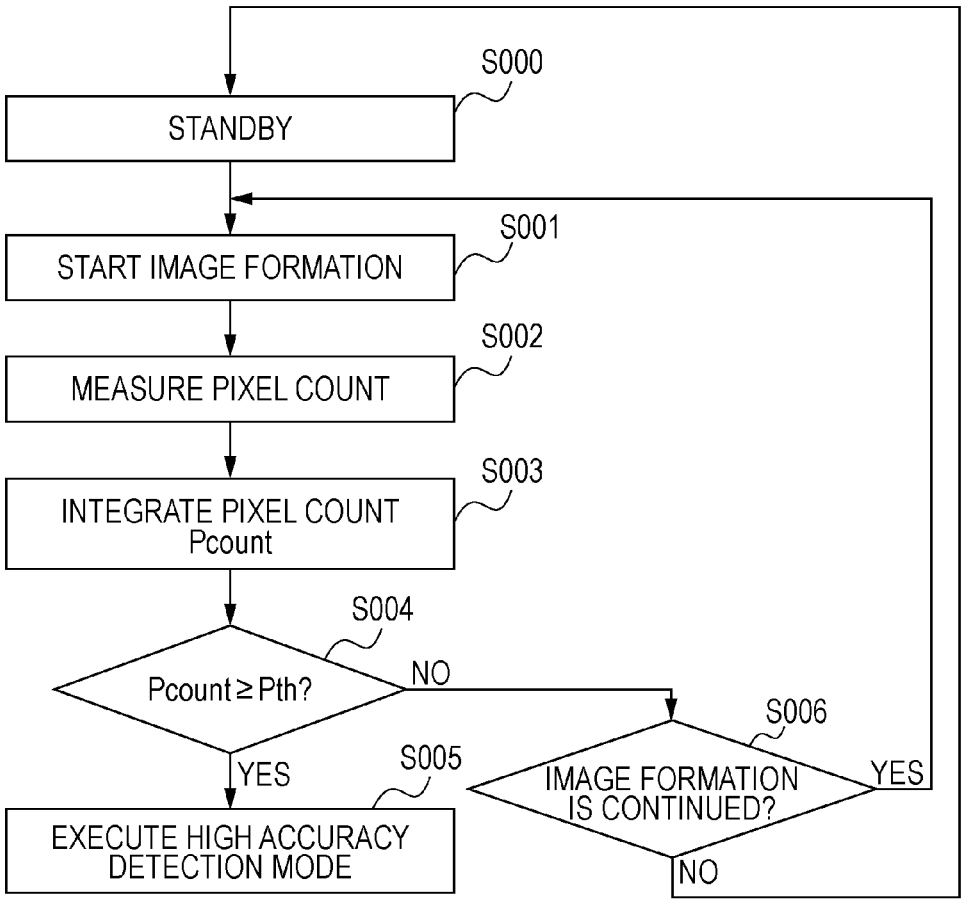
FIG. 3 is a flowchart before a high accuracy detection mode is executed according to the first embodiment.
Figure 31:
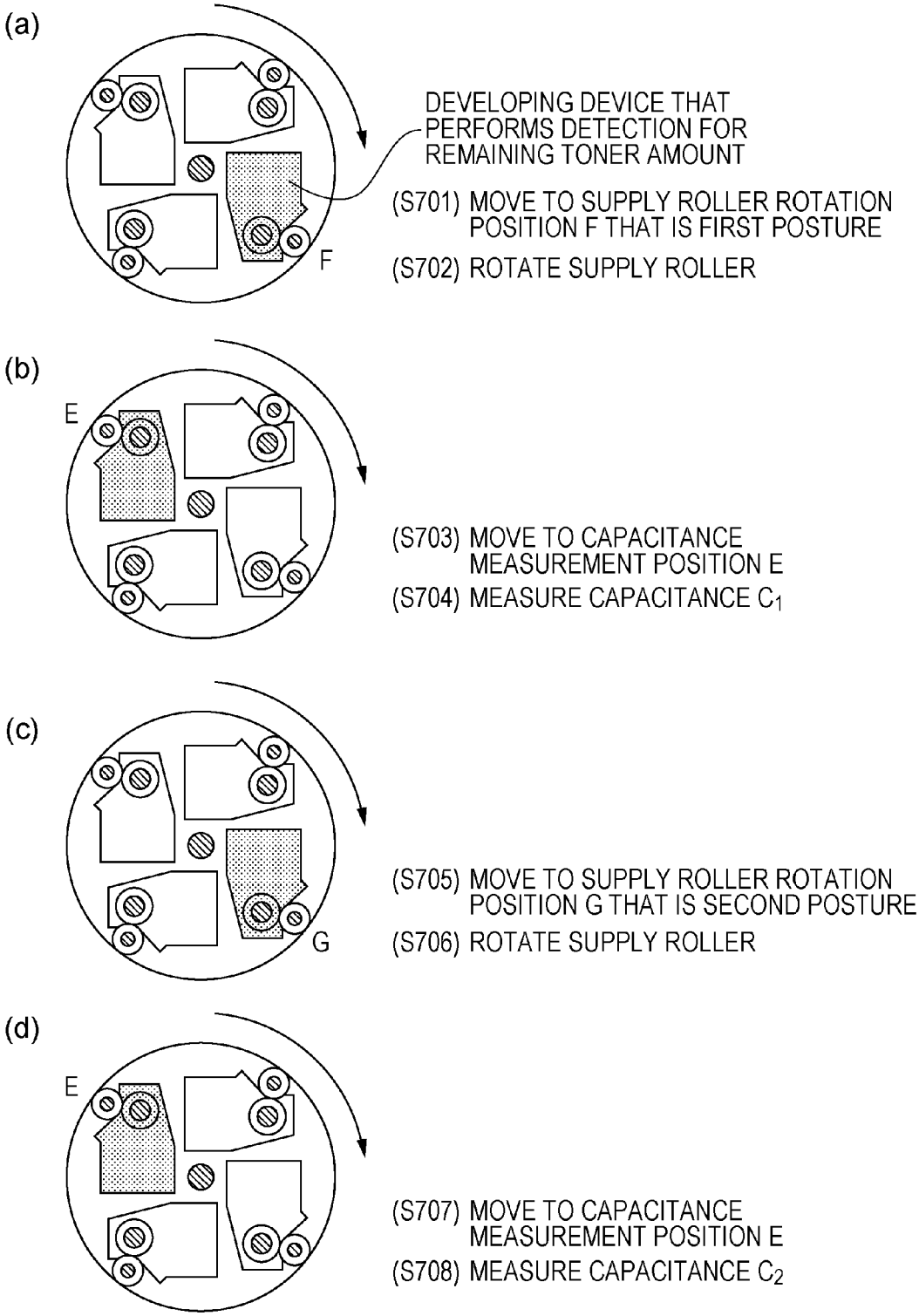
FIG. 31 illustrates movement of a rotary drum in a high accuracy detection mode according to the sixth embodiment.
Figure 32:
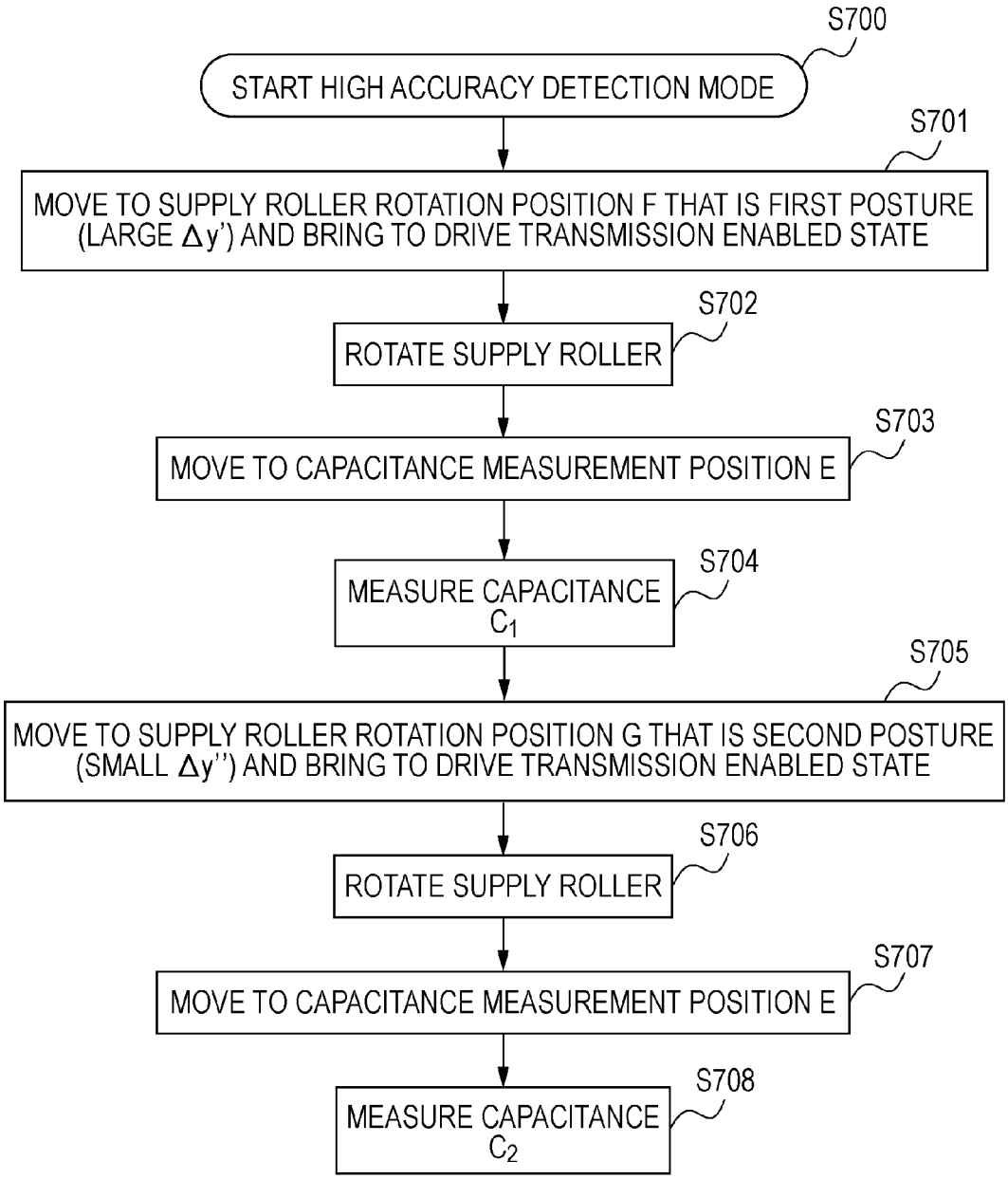
FIG. 32 is a flowchart of the high accuracy detection mode according to the sixth embodiment.

The operation during the high accuracy detection mode after the flow shown in FIG. 3 is performed will be described according to this embodiment. FIGS. 30A and 30B, and part (a) to part (d) in FIG. 31 illustrate the flow of a sequence and the movement of the rotary drum 50. If the pixel count integrated value Pcount of a certain developing device 5 reaches the predetermined value Pth, the high accuracy detection mode is started (S700). First, the rotary drum 50 of the developing device 5 whose integrated value Pcount reaches the predetermined value Pth is rotated, so that the developing device 5 is moved to a supply roller rotation position F serving as a first posture (S701). At the first posture, referring to FIG. 26C, a difference Δy' between a top position y1' of the supply roller 24 and a top position y2' of the development roller 25 in the y-axis direction, which is directed upward in the vertical direction, namely, Δy'=y1'−y2', is 6 mm. The development roller 25 is separated from the photosensitive drum 1.

To change the toner amount in the foam layer of the supply roller 24, the supply roller 24 is rotated at this position at a predetermined rotation speed for a first predetermined rotation time (S702). The rotation speed of the supply roller 24 used herein is 40% of the rotation speed of the supply roller 24 during the normal image formation. The rotation time is determined so that the toner amount in the supply roller 24 becomes stable. In this embodiment, the rotation time is 40 seconds. After the rotation for the predetermined time, the developing device 5 is moved to a capacitance measurement position E (S703), and a first capacitance $C_1$ is measured (S704). Then, the developing device 5 is moved to a supply roller rotation position G serving as a second posture by the rotation of the rotary drum 50 (S705). At the second posture, referring to FIG. 26D, a difference Δy" between a top position y1" of the supply roller 24 and a top position y2" of the development roller 25 in the y-axis direction, which is directed upward in the vertical direction, namely, Δy"=y1"−y2", is 3 mm. The development roller 25 is separated from the photosensitive drum 1. To change the toner amount in the foam layer of the supply roller 24 again, the supply roller 24 is rotated at this position at a predetermined rotation speed for a second predetermined rotation time (S706). The rotation speed of the supply roller 24 used herein is 40% of the rotation speed of the supply roller 24 during the normal image formation.

The rotation time is determined so that the toner amount in the supply roller 24 becomes stable. In this embodiment, the rotation time is 20 seconds. Then, the developing device 5 is moved to the capacitance measurement position E (S707), and a second capacitance $C_2$ is measured (S708). Similarly to the first embodiment, at the first and second postures when the supply roller 24 is rotated, the development roller 25 does not have to be separated from the photosensitive drum 1.

Figure 33A:
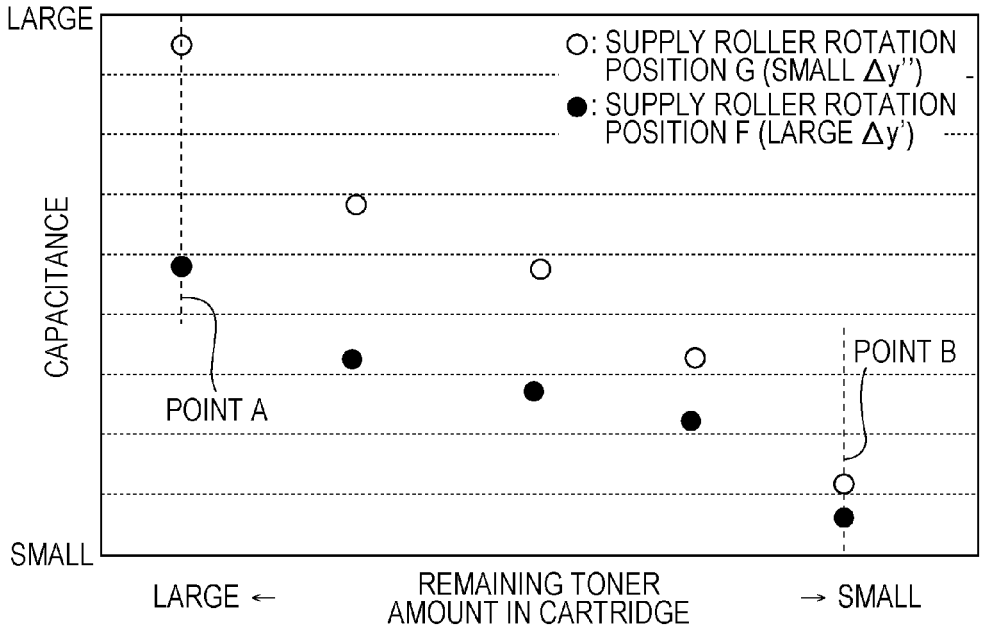
FIG. 33A illustrates the relationship between the remaining toner amount and the capacitance according to the sixth embodiment.
Figure 33B:
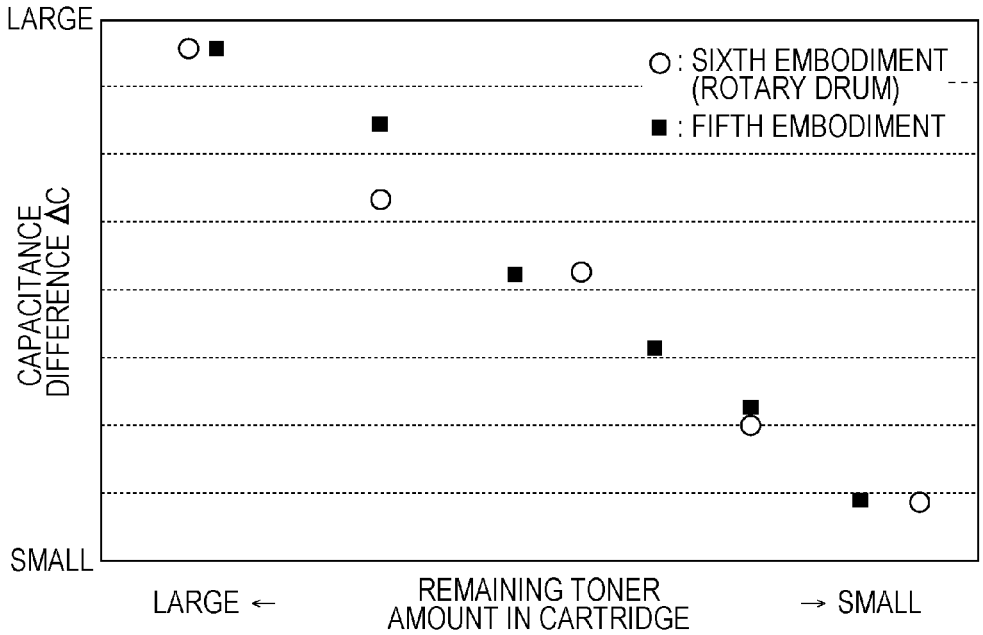
FIG. 33B illustrates the relationship between the remaining toner amount and the capacitance difference ΔC according to the sixth embodiment.

An absolute value $|C_1-C_2|$ of the difference between the detected capacitances $C_1$ and $C_2$ is ΔC. In this embodiment, ΔC in accordance with the remaining toner amount is shown in FIG. 33B, and has the same tendency as the first embodiment. By using the calculated value ΔC, it is determined whether ΔC exceeds a threshold through the flow shown in FIG. 8 like the first embodiment, to perform notification relating to the remaining toner amount and detection relating to the replacement timing of the cartridge 21 like the first embodiment. Accordingly, this embodiment can attain the advantage similar to that of the first embodiment.

In this embodiment, the influence by the temperature and humidity to the capacitance is substantially equivalent even if the posture of the developing device 5 is changed. Accordingly, if the capacitance differences at the respective postures are used as parameters for detecting the remaining toner amount, the influence by the change in environment to the capacitance can be canceled. By measuring the remaining toner amount with the difference detection method according to this embodiment, even if the temperature and humidity environment is changed, the remaining toner amount can be highly accurately measured without the temperature sensor or the humidity sensor. Thus, a user can be notified with high accuracy that the remaining toner amount is smaller than a predetermined amount or that the cartridge 21 has to be replaced, without the temperature sensor or the humidity sensor even if the temperature and humidity environment is changed.

This embodiment provides an advantage on account of the use of the rotary drum 50. The advantage will be described.

Since the rotary drum 50 is used as the posture changing device in this embodiment, the advantage of this embodiment can be attained while a cam member or the like does not have to be newly added for changing the posture unlike the fifth embodiment. FIG. 16 illustrates the movement of the toner when the rotary drum 50 is rotated when the amount of the toner is small. After the supply roller 24 is rotated at a position near the development position C (supply roller rotation positions C, F, G), a large amount of toner is present above the supply roller 24 (portion X) as shown in part (A) of FIG. 16. The rotary drum 50 is rotated from this state successively to part (B), part (C), part (D), and then part (E) in FIG. 16, the toner staying in the portion X located upstream the contact position, at which the development roller 25 contacts the supply roller 24, in the rotating direction of the supply roller 24 is conveyed to the portion Y located downstream the contact position in the rotating direction of the supply roller 24.

Since the supply roller 24 is supplied with the toner mainly through the suction from the portion Y, if the toner is conveyed to the portion Y by the rotation of the rotary drum 50, the toner is easily sucked to the supply roller 24 when the supply roller 24 is rotated. The toner amount in the supply roller 24 can become stable quickly. In particular, when the supply roller 24 is rotated at the low speed, the discharge amount of the toner to the portion X is small. The suction of the toner to the supply roller 24 from the portion Y is predominant over the discharge of the toner to the portion X. As the result, the supply roller 24 sucks the toner more quickly, and the rotation time can be reduced. Accordingly, in this embodiment, by sending the toner to the portion Y by the rotation of the rotary drum 50, the toner amount in the supply roller 24 can become stable with a reduced supply roller rotation time as compared with the fifth embodiment. The supply roller rotation time can be reduced.

With the configuration of this embodiment, the toner is moved as described above before the supply roller 24 is rotated. However, referring to FIG. 333, the capacitance difference ΔC between the different postures with respect to the remaining toner amount in the cartridge 21 is similar to ΔC of the case without the rotary drum 50 according to, for example, the fifth embodiment. This is because the toner sucked into the supply roller 24 from the portion Y is discharged to the portion X in FIG. 2 by the rotation of the supply roller 24 until the toner amount in the supply roller 24 becomes stable. When the toner remains in the cartridge 21 by a certain amount (point A in FIG. 33A), if the rotation of the supply roller 24 is started, the toner stays in the portion X. Similar to the fifth embodiment, the toner amount in the portion Y varies because the toner amount in the portion X varies in accordance with the posture. Thus, the toner amount in the supply roller 24 also varies in accordance with the posture during the rotation. When the remaining toner amount in the cartridge 21 is very small (point B in FIG. 33A), the toner stays in the portion X only by a small amount irrespective of the posture. The toner amount in the portion Y is also small. Hence, there is substantially no difference between the toner amount in the portion X and the toner amount in the portion Y. Accordingly, regardless of whether the rotary drum 50 is rotated or not, the capacitance difference is correlated with the remaining toner amount in the cartridge 21. The remaining toner amount can be detected like the first embodiment.

The rotary drum 50 attains another advantage such that the toner is hardly affected even if the toner is left for a long period because the toner is stirred by the rotation of the rotary drum 50. Thus, the toner amount in the supply roller 24 becomes stable after the rotation of the supply roller 24. The variation in capacitance can be reduced.

The supply roller rotation time required so that the toner amount in the supply roller 24 becomes stable depends on, for example, the rotation speed of the supply roller 24. Hence, the first and second predetermined times are not limited to the values according to this embodiment, and may be the same or different.

Seventh Embodiment

An image forming apparatus according to a seventh embodiment of the present invention has a basic configuration similar to the image forming apparatus in FIG. 12 according to the second embodiment. In this embodiment, to detect the remaining toner amount, a high accuracy detection mode that is different from the high accuracy detection mode of the second embodiment is executed after the flow shown in FIG. 3 is performed.

Figure 34:
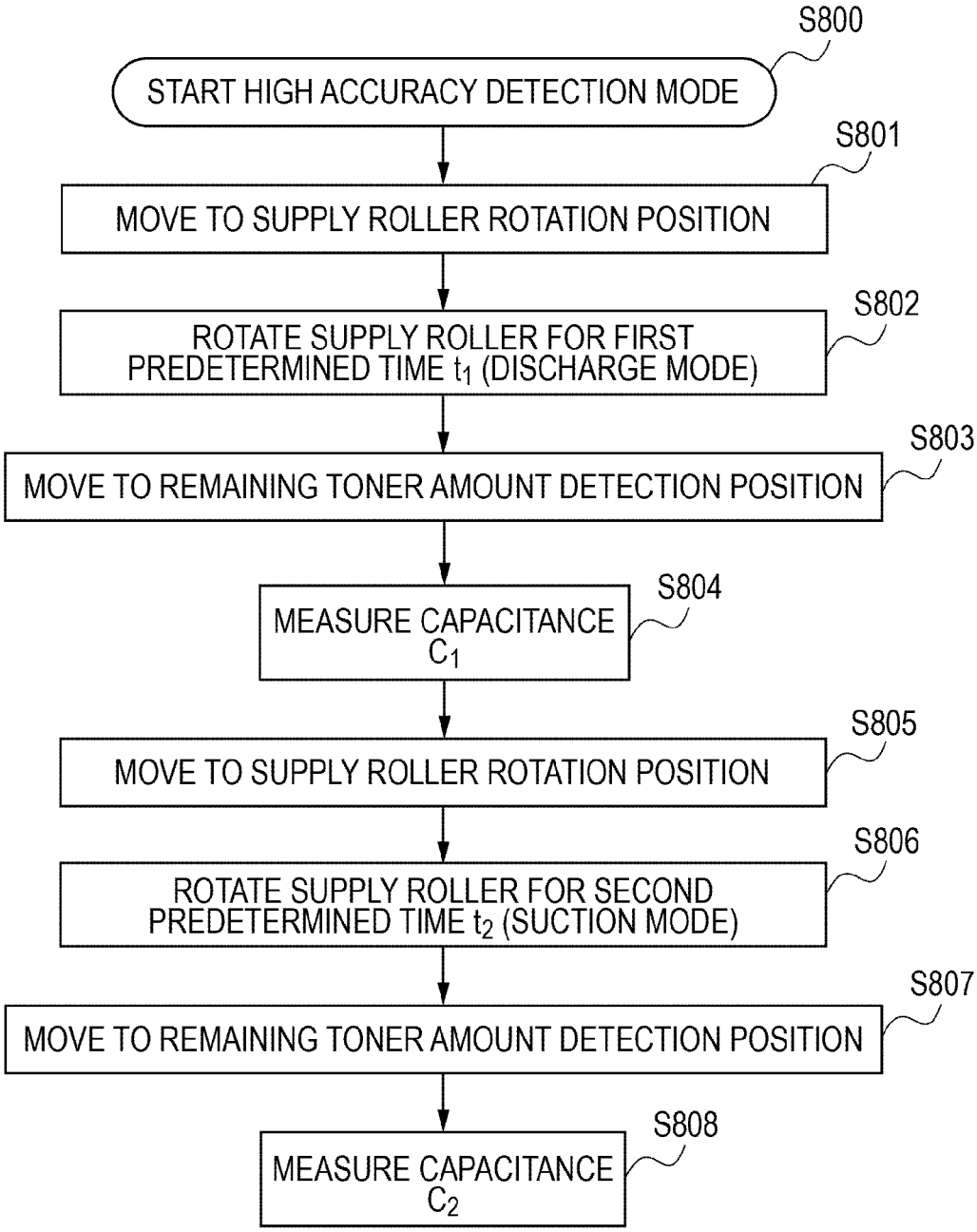
FIG. 34 is a flowchart of a high accuracy detection mode according to a seventh embodiment.
Figure 35:
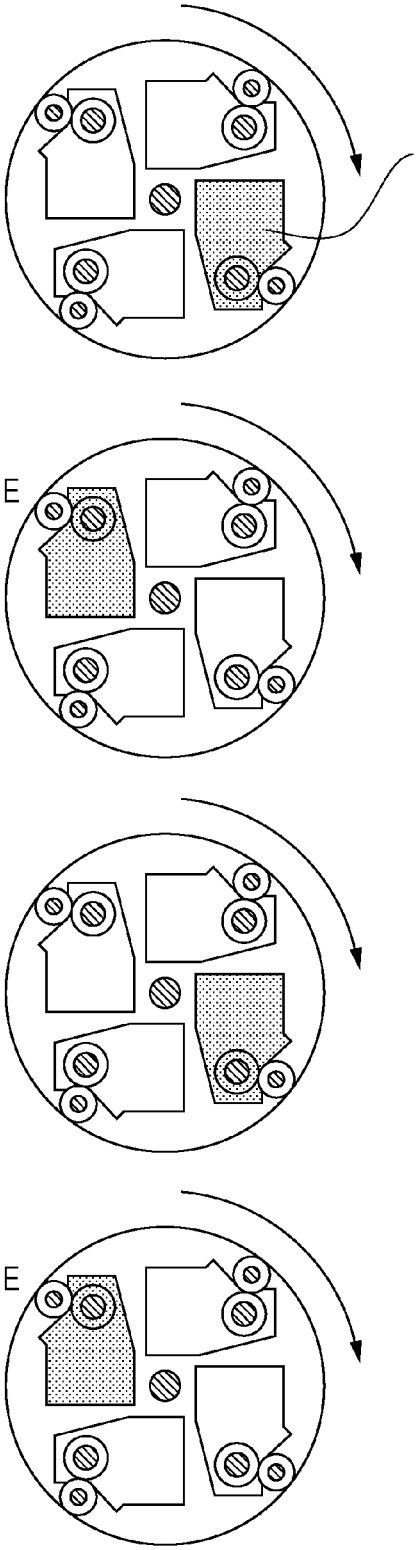
FIG. 35 illustrates movement of a rotary drum in the high accuracy detection mode according to the seventh embodiment.

The flow of the high accuracy detection mode that is a feature of this embodiment and the movement of the rotary drum 50 will be described with reference to FIGS. 34 and 35. If the pixel count integrated value Pcount of a certain developing device 5 reaches the predetermined value Pth, the high accuracy detection mode is started (S800). First, the rotary drum 50 of the developing device 5 whose integrated value Pcount reaches the predetermined value Pth is rotated, so that the developing device 5 is moved to the supply roller rotation position that is the development position (S801). To change the toner amount contained in the foam layer of the supply roller 24, the supply roller 24 is rotated at that position by the drive-P 60 for 15 second as a first predetermined time $t_1$, so that the toner amount in the supply roller 24 becomes stable with a small amount (S802). Hereinafter, the rotation operation of the supply roller 24 here is called discharge mode. Then, the rotary drum 50 is rotated by the drive-Q 60, so that the developing device 5 is moved to a toner remaining amount detection position (S803), and a first capacitance $C_1$ is measured (S804).

Then, the developing device 5 is moved to the supply roller rotation position again (S805). To change the toner amount contained in the foam layer of the supply roller 24 again, the supply roller 24 is rotated at this position for 3 seconds as a second predetermined time $t_2$, so that the toner amount in the foam layer becomes larger than the toner amount in the foam layer at the detection of $C_1$ (S806). Hereinafter, the rotation operation of the supply roller 24 here is called suction mode. Then, the developing device 5 is moved to the toner remaining amount detection position (S807), and a second capacitance $C_2$ is measured (S808).

Figure 36:
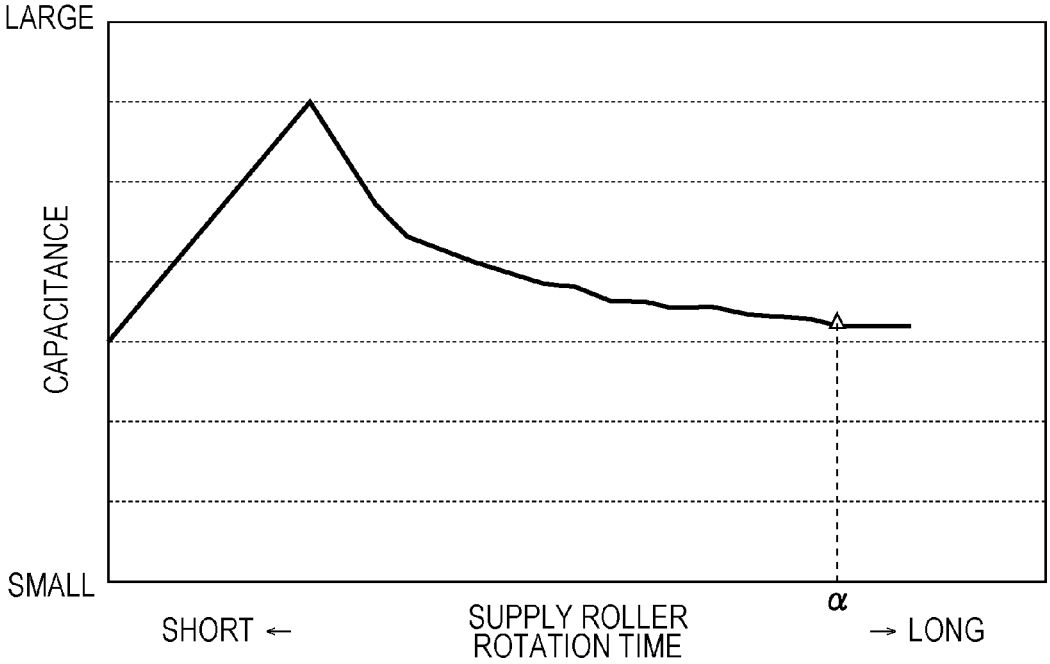
FIG. 36 illustrates the relationship between the supply roller rotation time and the capacitance according to the seventh embodiment.

FIG. 36 schematically illustrates the toner amount in the foam layer with respect to the rotation time when the supply roller 24 is rotated. When the rotary drum 50 is rotated to move the toner in the cartridge 21 to a position near the portion Y as shown in FIG. 16, and then the supply roller 24 is rotated, the foam layer of the supply roller 24 sucks the toner at the position near the portion Y. Thus, the line indicative of the toner amount in the foam layer starts from the left end in FIG. 36. In particular, in step S806, the toner amount in the foam layer starts from the amount at the left end in FIG. 36, increases for a while, and then decreases. Therefore, by properly setting $t_2$, the toner amount in the foam layer can be increased (suction mode).

Although the rotary drum 50 is rotated, unless the rotation causes the toner to be moved toward the portion Y as shown in FIG. 16, the toner amount may not be started from the left end in FIG. 36. The time $t_1$ is set to a time a or longer such that a reduction ratio of the toner amount in the foam layer with respect to the supply roller rotation time is below a predetermined value. Thus, the toner amount in the foam layer can become stable in FIG. 36 (discharge mode). In this embodiment, $t_1$ is 15 seconds and $t_2$ is 3 seconds. However, $t_1$ and $t_2$ may be properly determined with regard to the shape of the cartridge 21, and the size, material, structure, and rotation speed of the supply roller 24.

When an absolute value $|C_1-C_2|$ of the difference between the detected capacitances $C_1$ and $C_2$ is $\Delta C$, the relationship between $\Delta C$ and the remaining toner amount in the developing device 5 becomes similar to one illustrated in FIG. 7. By using the calculated value $\Delta C$, it is determined whether $\Delta C$ exceeds a threshold through the flow shown in FIG. 8 like the first embodiment, to perform notification relating to the remaining toner amount and detection relating to the replacement timing of the cartridge 21 like the first embodiment.

Here, the physical meaning of the correlation between the capacitance difference and the toner amount in the cartridge 21 will be discussed on the basis of the observed result of the developing device 5.

Figure 37:
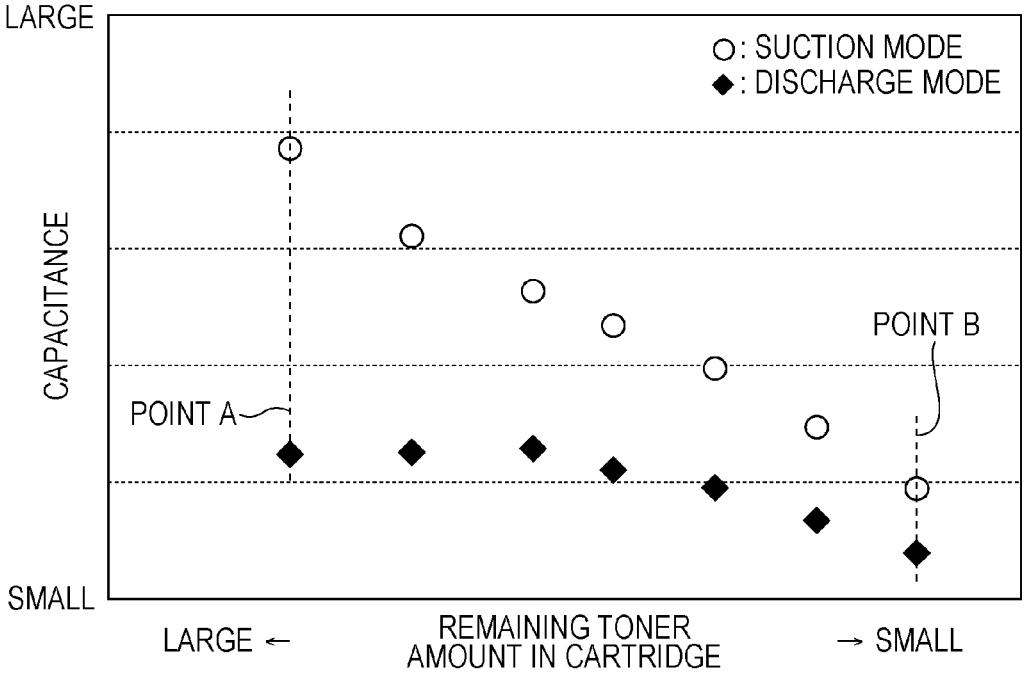
FIG. 37 illustrates the relationship between the remaining toner amount and the contained toner amount in the supply roller in a suction mode and a discharge mode.
Figure 38:
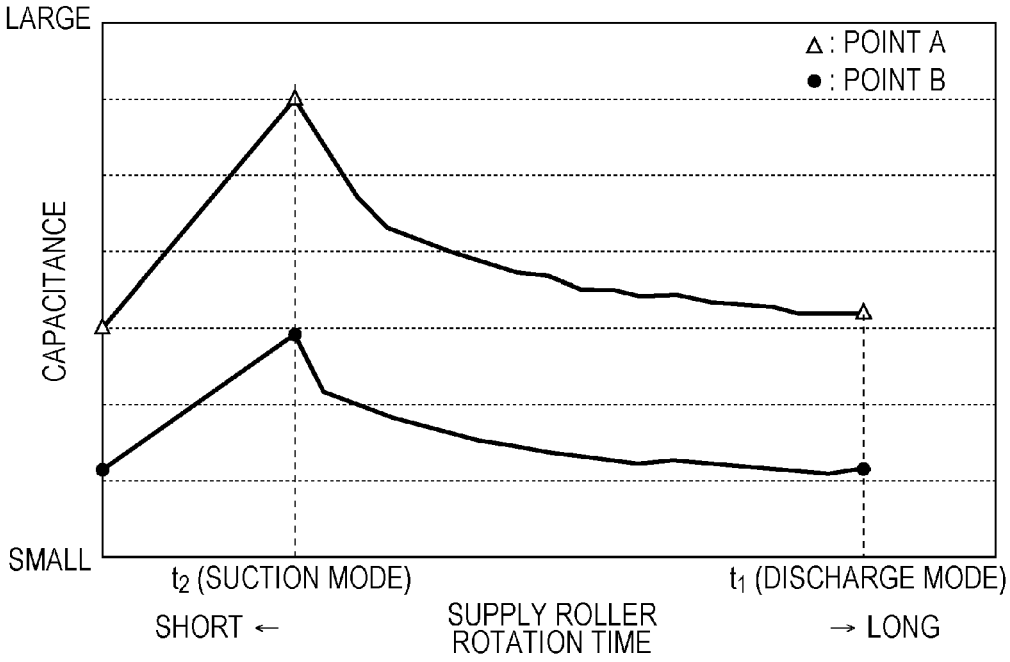
FIG. 38 illustrates the relationship between the supply roller rotation time and the capacitance according to the seventh embodiment.

The inventors of the present invention found that the relationship between the rotation time of the supply toner 24 and the toner amount in the supply roller 24 was changed by the remaining toner amount. FIG. 37 illustrates the relationship of the toner amount in the cartridge 21 with respect to the contained toner amount in the supply roller 24 immediately after the supply roller 24 is rotated in the discharge mode and the suction mode. FIG. 38 illustrates the relationship between the rotation time of the supply roller 24 and the contained toner amount in the supply roller 24. The contained toner amount gradually increases from the start of the rotation, and then decreases from a certain point of time. As the toner amount in the cartridge 21 decreases, the toner amount in the supply roller 24 decreases in either of the discharge mode and the suction mode. When the toner amount in the cartridge 21 is very small (point B), substantially the same contained toner amount is obtained after the discharge mode and after the suction mode.

From the observed result by the inventors of the present invention, it was found that the balance between the discharge and the suction was changed in accordance with the rotation time. This phenomenon will be discussed. FIG. 16 illustrates the movement of the toner when the rotary drum 50 is rotated when the amount of the toner is small. When the toner remains in the cartridge 21 by a certain amount (point A), after the supply roller 24 is rotated at the development position, a large amount of toner is present above the supply roller 24 (portion X) as shown in part (A) of FIG. 16. The rotary drum 50 is rotated from this state successively to part (B), part (C), part (D), and then part (E) in FIG. 16, the toner staying in the portion X located upstream the contact position, at which the development roller 25 contacts the supply roller 24, in the rotating direction of the supply roller 24 is conveyed to the portion Y located downstream the contact position in the rotating direction of the supply roller 24 after the rotation of the rotary drum 50. The portion Y is a portion in which the supply roller 24 compressed by the contact with the development roller 25 is decompressed.

Hence, the toner is sucked by a large amount in the portion Y at the moment of the decompression. Since the toner is mainly sucked into the supply roller 24 from the portion Y, the state of the toner in the portion Y affects the toner amount in the supply roller 24. If the toner amount in the portion Y is small, it may be difficult to supply the supply roller 24 with the toner. The toner amount in the supply roller 24 decreases. Accordingly, when the toner is conveyed to the portion Y by the rotation of the rotary drum 50, the toner in the supply roller 24 can be increased. Since the supply roller 24 is supplied with the toner for a while even after the rotation of the rotary drum 50, the toner in the supply roller 24 increases. If the toner in the portion Y is used up, the toner is no longer provided from the portion Y, and the influence by the discharge from the portion X becomes large. Thus, the toner amount in the supply roller 24 may decrease.

When the toner amount in the cartridge 21 is very small (point B), the toner amount in the portion X shown in FIG. 2 is small. Consequently, it was found that the toner amount fed to the portion Y decreases. Accordingly, the amount of toner to be fed to the supply roller 24 decreases.

Consequently, the relationship between the toner amount in the cartridge 21 and the toner amount in the supply roller 24 becomes one shown in FIG. 37. If FIG. 37 is plotted by using the difference therebetween, the relationship in FIG. 7 is obtained.

Figure 39A:
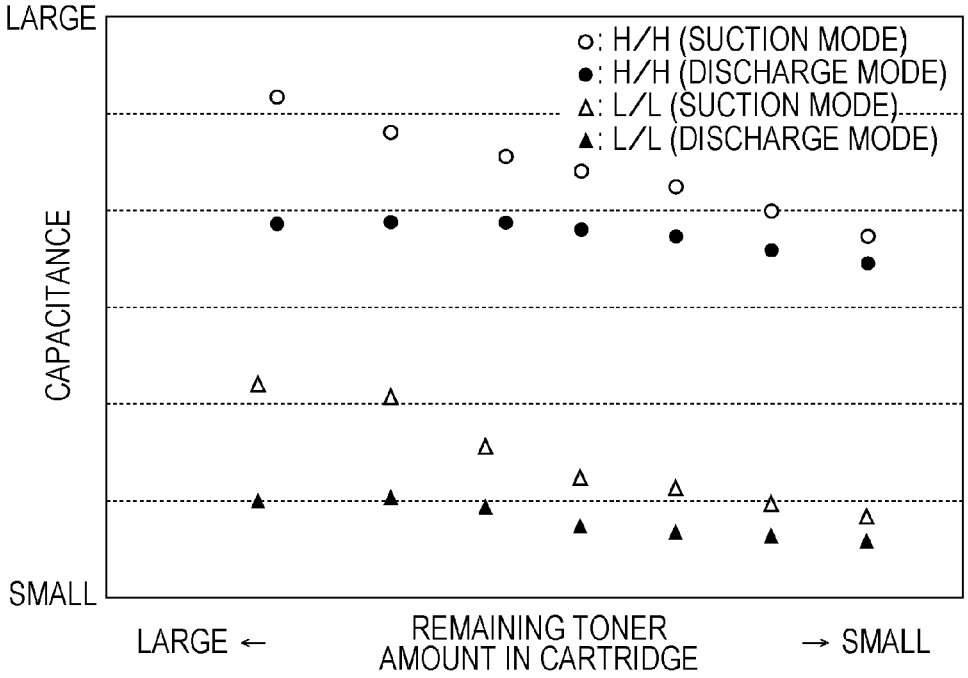
FIG. 39A illustrates the relationship between the remaining toner amount in a cartridge and the capacitance under H/H environment and L/L environment.
Figure 39B:
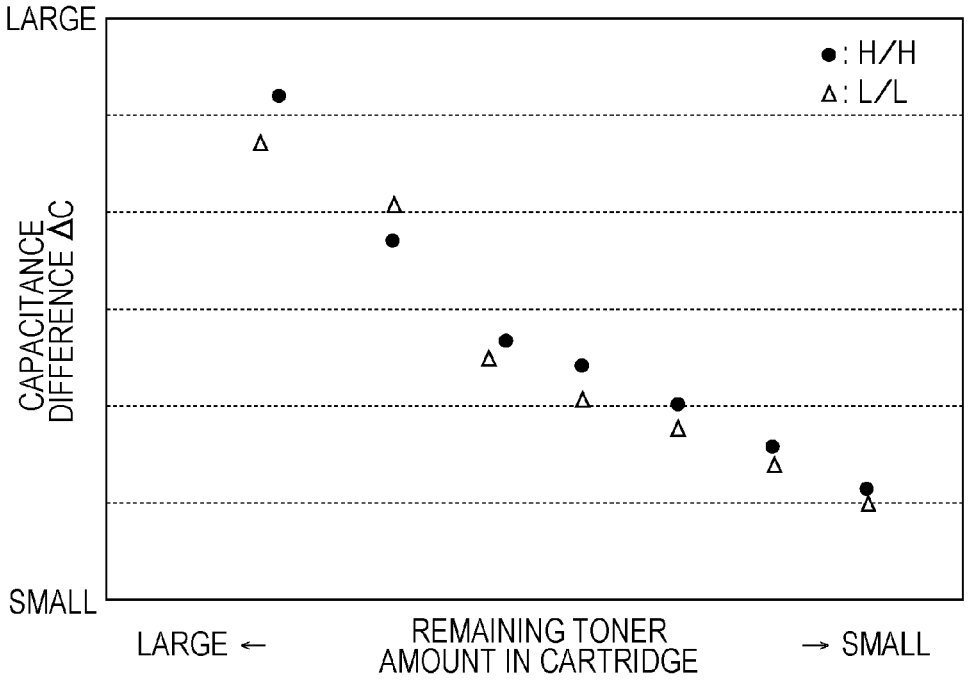
FIG. 39B illustrates the relationship between the remaining toner amount in the cartridge and the capacitance difference under H/H environment and L/L environment.

With regard to the above-described points, the advantage according to this embodiment of the present invention will be described in detail. FIG. 39A illustrates the relationship between the toner amount in the cartridge 21 and the capacitance at the respective speeds under high-temperature high-humidity environment (at 30° C. and 80% RH, hereinafter, referred to as H/H) and low-temperature low-humidity environment (at 15° C. and 10% RH, hereinafter, referred to as L/L). The measurement value at H/H indicates a higher capacitance than the measurement value at L/L. If the capacitance difference is measured at the respective speeds, the result at H/H is similar to the result at L/L as shown in FIG. 39B.

Accordingly, if the capacitance differences for the suction mode and the discharge mode are used as parameters for detecting the remaining toner amount, the influence by the change in environment to the capacitance can be canceled. By measuring the remaining toner amount with the difference detection method according to this embodiment, even if the temperature and humidity environment is changed, the remaining toner amount can be highly accurately measured without the temperature sensor or the humidity sensor. Thus, a user can be notified with high accuracy that the remaining toner amount is smaller than a predetermined amount or that the cartridge 21 has to be replaced, without the temperature sensor or the humidity sensor even if the temperature and humidity environment is changed.

In this embodiment, the first rotation time of the supply roller 24 is the discharge mode and the second rotation time of the next rotation is the suction mode. This is because if the high accuracy detection mode is ended after the suction mode, the supply roller 24 can contain the toner by a large amount for the next image formation. Accordingly, an image with a low density or an image with an unprinted portion is less frequently generated even if an image with a high coverage rate is output after the high accuracy detection mode.

Eighth Embodiment

An image forming apparatus according to an eighth embodiment of the present invention has a basic configuration similar to the image forming apparatus in FIG. 12 according to the second embodiment. In this embodiment, to detect the remaining toner amount, a high accuracy detection mode that is different from the high accuracy detection mode of the second embodiment is executed after the flow shown in FIG. 3 is performed.

Figure 40:
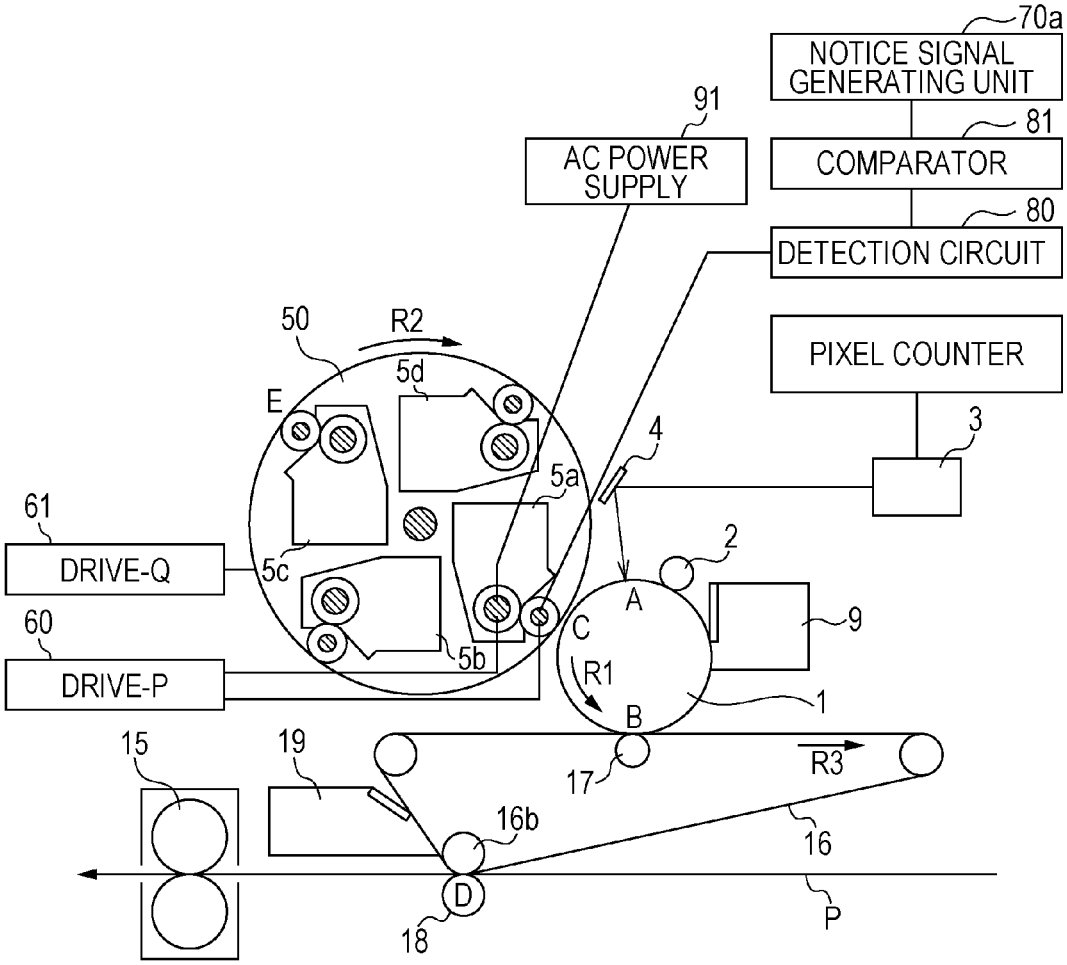
FIG. 40 schematically illustrates an exemplary image forming apparatus according to an eighth embodiment.

In this embodiment, the developing device 5 as the subject of detection for the remaining toner amount is provided on a rotary support member, i.e., a rotary drum 50. A drive-Q 60 (second drive) rotates the rotary drum 50, so that the developing device 5 is moved, the toner is stirred, and the developing device 5 is moved to a toner remaining amount detection position F. The detection position F is the position of a developing device 5*a* in FIG. 40. An AC power supply 91 is connected with the shaft 24*a*, and a detection circuit 80 is connected with the shaft 25*a* at the detection position F through electrode terminals (not shown).

Figure 41:
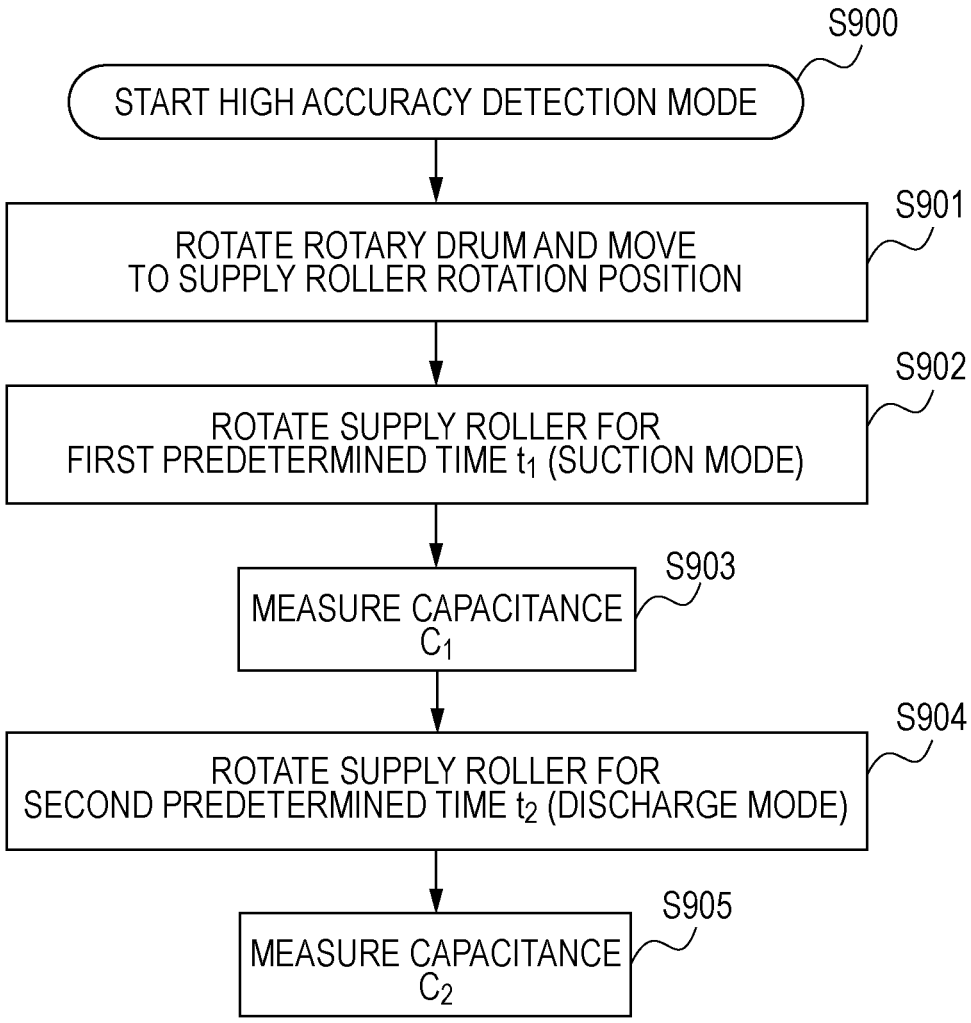
FIG. 41 is a flowchart of a high accuracy detection mode according to the eighth embodiment.

FIG. 41 illustrates a high accuracy detection mode that is a feature of this embodiment. If the pixel count integrated value Pcount of a certain developing device 5 reaches the predetermined value Pth, the high accuracy detection mode is started (S900). First, the rotary drum 50 of the developing device 5 whose integrated value Pcount reaches the predetermined value Pth is rotated, so that the toner is stirred and the developing device 5 is moved to the supply roller rotation position that is the development position. By stirring the toner, referring to FIG. 16, the toner is moved to the position (the portion Y) at which the toner is easily supplied (S901). (When it is assumed that the posture of the developing device 5 when moved to the supply roller rotation position is a predetermined posture F, the sequence of step S903 or later is performed at the posture F so that the toner amount moved to the portion Y is not changed by the change in posture.) Next, the supply roller 24 is rotated for a first predetermined time $t_1$ (3 seconds) to change the toner amount contained in the foam layer of the supply roller 24 (S902).

The time $t_1$ is 3 seconds in this embodiment because this time causes the toner amount in the supply roller 24 to exceed a maximum value once like the first embodiment. Then, a first capacitance $C_1$ is measured (S903). The capacitance is measured while the supply roller 24 is rotated by the drive-P 60. After $C_1$ is measured, to change the toner amount in the foam layer of the supply roller 24, the supply roller 24 is rotated for a second predetermined time $t_2$ (10 seconds) that causes the toner in the supply roller 24 to be sufficiently discharged (S904). Then, a second capacitance $C_2$ is measured (S905). When an absolute value $|C_1-C_2|$ of the difference between the detected capacitances $C_1$ and $C_2$ is $\Delta C$, the relationship between $\Delta C$ and the remaining toner amount in the developing device 5 becomes similar to one illustrated in FIG. 7. By using the calculated value ΔC, it is determined whether ΔC exceeds a threshold through the flow shown in FIG. 8 like the first embodiment, to perform notification relating to the remaining toner amount and detection relating to the replacement timing of the cartridge 21 like the first embodiment.

As described above, in this embodiment, the rotary drum 50 is rotated first, and then the capacitance is measured at the position, at which developing can be performed, while the supply roller 24 is rotated. Accordingly, the capacitance can be continuously measured without the rotary drum 50 is rotated between the measurement of $C_1$ and the measurement of $C_2$ unlike the seventh embodiment. The measurement time can be reduced as compared with the seventh embodiment.

Also, in the seventh embodiment, the toner is not moved to the portion Y in the cartridge 21 by the rotation of the rotary drum 50 before the supply roller 24 is rotated for the first predetermined time, and the start point of the toner amount in the curve shown in FIG. 36 is not clear. Thus, the toner amount in the foam layer has to be reduced by the rotation for the time a or longer. As the result, the toner amount in the foam layer has to be larger when $C_2$ is detected than the toner amount in the foam layer when $C_1$ is detected. In contrast, in this embodiment, the toner is moved to the portion Y in the cartridge 21 by the rotation of the rotary drum 50 at the start of the high accuracy detection mode. Then, the supply roller 24 is rotated and $C_1$ and $C_2$ are continuously detected. Accordingly, in this embodiment, the toner amount in the foam layer is started from the left end in the curve in FIG. 36. By properly setting $t_1$ and $t_2$, the toner amount in the foam layer can be large in either case when $C_1$ is detected and $C_2$ is detected. That is, $t_1$ and $t_2$ may be properly determined so that the toner amount in the foam layer varies.

In this embodiment, the toner is moved to the portion Y by the rotation of the rotary drum 50 and then the capacitance is detected two times while the supply roller 24 is rotated. Alternatively, the capacitance may be detected three times or more until the reduction ratio of the capacitance with respect to the rotation time of the supply roller 24 becomes below a predetermined value. The details are described below.

Figure 42:
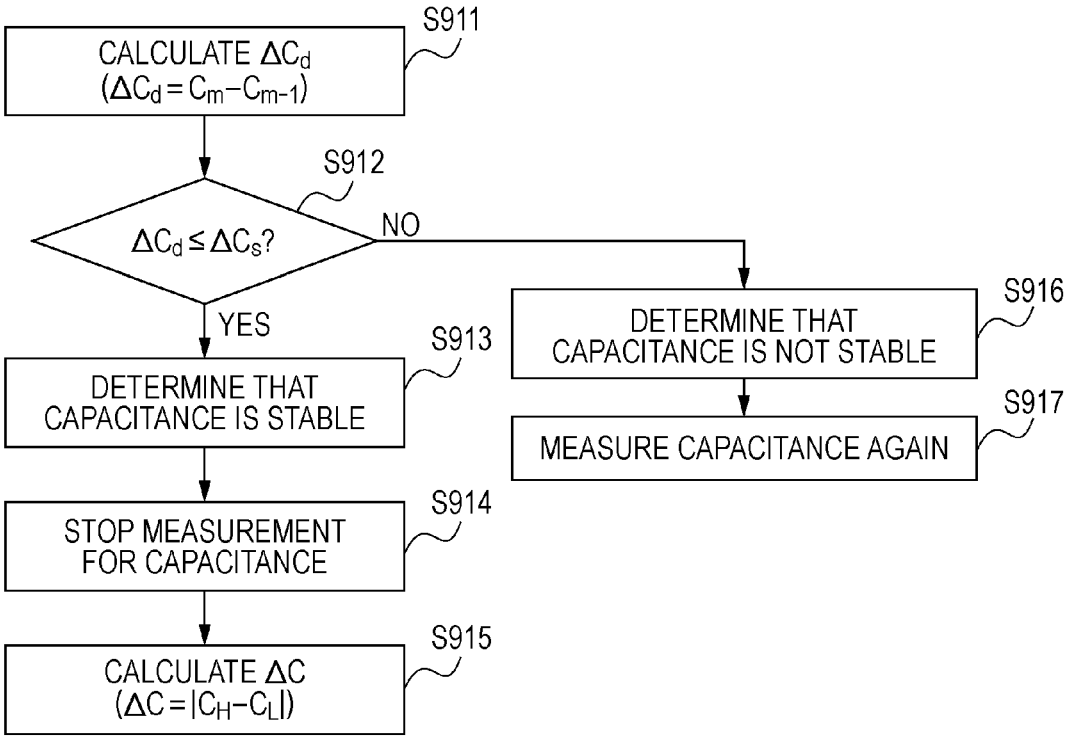
FIG. 42 is a flowchart for judging whether the capacitance is stable or not according to the eighth embodiment.
Figure 43:
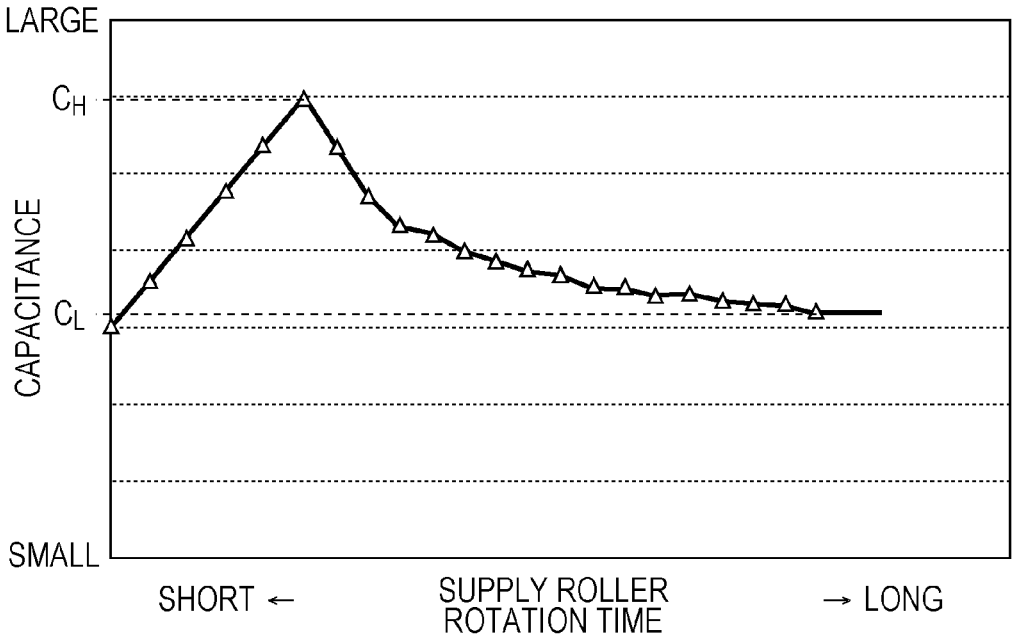
FIG. 43 illustrates the relationship between the supply roller rotation time and the capacitance according to the eighth embodiment.

FIG. 42 illustrates a flow of a high accuracy detection mode when the capacitance is detected three times or more. FIG. 43 illustrates the detection result of the capacitance. The capacitance is detected every 0.5 second while the supply roller 24 is rotated. Assuming that the capacitance at m-th time measurement is $C_m$, an absolute value $\Delta C_d$ of a difference between the m-th capacitance and a (m−1)-th capacitance is calculated as $\Delta C_d = |C_m - C_{(m-1)}|$ (S911). If $\Delta C_d$ is equal to or smaller than a certain threshold $\Delta C_s$ (S912), it is determined that the toner amount in the foam layer becomes substantially stable (or that the reduction ratio of the capacitance with respect to the rotation time of the supply roller 24 is equal to or smaller than a predetermined value) (S913). An absolute value $|C_H - C_L|$ of a difference between a highest capacitance $C_H$ and a lowest capacitance $C_L$ from among capacitances obtained by performing the measurement N times is calculated (S915). The obtained value is determined as ΔC.

Thus obtained ΔC is used for notifying a user about the remaining toner amount and the replacement of the cartridge 21 through the flow in FIG. 8 like the first embodiment.

As described above, since the toner is moved to the portion Y by the rotation of the rotary drum 50 and then the capacitance is detected three times or more while the supply roller 24 is rotated, the change in capacitance can be monitored. By using the highest capacitance and the lowest capacitance, a large value can be obtained as the absolute value of the capacitance difference. The change in absolute value of the capacitance difference becomes large as compared with the change in remaining toner amount. Accordingly, the remaining toner amount and the replacement timing of the cartridge 21 can be highly accurately notified.

APPENDIX

According to the present invention, like the high accuracy detection mode described in any of the first to eighth embodiments, the remaining toner amount can be detected by using $|C_1 - C_2|$ as long as a predetermined period for changing the toner amount in the foam layer by rotating the supply roller is provided between the measurement of the capacitance $C_1$ and the measurement of the capacitance $C_2$. Thus, a user can be notified with high accuracy that the remaining toner amount is smaller than a predetermined amount or that the cartridge has to be replaced, without the temperature sensor or the humidity sensor even if the temperature and humidity environment is changed. Also, since the supply roller is rotated for the predetermined period even before the measurement of the capacitance $C_1$, the change in toner amount in the foam layer resulted from image formation before the high accuracy detection mode is executed can be reduced. The value that is more stable than the capacitance $C_1$ can be measured. Accordingly, the notification can be performed highly accurately.

In addition, with the high accuracy detection mode described in any of the first to eighth embodiments, the operation from the measurement of the capacitance $C_1$ to the measurement of the capacitance $C_2$ is continuously performed. The operation is desirably performed continuously. However, it is not limited thereto unless the environment and the toner amount in the cartridge are not markedly changed between the measurement of $C_1$ and the measurement of $C_2$. For example, if an image has a low coverage ratio, the image may be printed for several sheets between the measurement of $C_1$ and the measurement of $C_2$.

Also, in the high accuracy detection mode described in any of the first to eighth embodiments, the supply roller and the development roller are rotated for the predetermined period for changing the toner amount in the foam layer. However, only the supply roller may be rotated to allow the toner to be sucked into and discharged from the foam layer.

Further, in any of the first to eighth embodiments, only the developing device is the cartridge that can be mounted on the apparatus body of the image forming apparatus in a replaceable manner. However, a combined cartridge in which the developing device and the photosensitive drum are integrally formed can be mounted on the apparatus body of the image forming apparatus in a replaceable manner.

Further, the notice content by the notice signal generating unit according to the present invention may be a notice that notifies the user about the toner amount being smaller than the predetermined amount and promotes the user to replace the developing device. For example, a display of the apparatus body of the image forming apparatus, or a display of a PC that is connected with the image forming apparatus through a network may display notices such as "remaining toner amount is small," "toner is run out," and "replace cartridge." That is, it is obvious that the notification can be made even if the apparatus body of the image forming apparatus does not have a display. Further, by setting a plurality of thresholds, the toner amount can be detected stepwise. Accordingly, the remaining toner amount can be notified stepwise for the user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1 photosensitive drum
5 (5*a* to 5*d*) developing device
17 transfer roller
15 fixing device
21 cartridge
24 supply roller
24*a* shaft
24*b* urethane spongy layer
25 development roller
25*a* shaft
40 mount portion
50 rotary support member (rotary drum)
70 controller
70*a* notice signal generating unit

The invention claimed is:

1. An image forming apparatus comprising:

a developing device including a container that has an opening and contains a toner, a toner bearing member arranged at the opening of the container, having a first electrode member, and supplying an electrostatic latent image with the toner by bearing and conveying the toner, and a toner supply member arranged in the container and having a second electrode member and a foam layer, wherein the foam layer is provided around the second electrode member, wherein the developing device supplies the toner bearing member with the toner in the container by rotating the toner supply member in a contact manner with the toner bearing member;

a detection mode execution unit configured to execute a detection mode in which a predetermined period for changing a toner amount in the foam layer by rotating the toner supply member is provided, a capacitance $C_1$ between the first and second electrode members is detected before the predetermined period, and a capacitance $C_2$ between the first and second electrode members is detected after the predetermined period; and a notice signal generating unit configured to generate a notice signal in response to an absolute value $|C_1-C_2|$ of a difference between the capacitances $C_1$ and $C_2$ being smaller than a predetermined threshold, wherein the notice signal is indicative of a toner amount in the container being smaller than a predetermined amount.

2. The image forming apparatus according to claim 1, wherein the detection mode execution unit rotates the toner supply member at a first speed for a first predetermined time before the capacitance $C_1$ is detected, and rotates the toner supply member at a second speed for a second predetermined time during the predetermined period, wherein the second speed is different from the first speed.

3. The image forming apparatus according to claim 2, wherein the second speed is lower than the first speed.

4. The image forming apparatus according to claim 3, wherein the developing device is provided on a rotary support member, and wherein the detection mode execution unit rotates the rotary support member after the capacitance $C_1$ is detected and before the predetermined period, to move the toner in a region located upstream a contact position, at which the toner bearing member contacts the toner supply member, in a rotating direction of the toner supply member, to a region located downstream the contact position in the rotating direction of the toner supply member.

5. The image forming apparatus according to claim 3, wherein the predetermined time at a higher speed of the first and second speeds is shorter than the predetermined time at a lower speed.

6. The image forming apparatus according to claim 1, wherein the detection mode execution unit rotates the toner supply member for a first predetermined time while applying a first direct-current voltage between the first and second electrode members before the capacitance $C_1$ is detected, and rotates the toner supply member for a second predetermined time while applying a second direct-current voltage between the first and second electrode members during the predetermined period, wherein the second direct-current voltage is different from the first direct-current voltage.

7. The image forming apparatus according to claim 6, wherein the detection mode execution unit applies the first and second direct-current voltages such that a value of $(V_a-V_b)-(V_c-V_d)$ is homopolar with a normal charge polarity of the toner, where $V_a$ is a potential of the second electrode member and $V_b$ is a potential of the first electrode member during the application of the first direct-current voltage, and $V_c$ is a potential of the second electrode member and $V_d$ is a potential of the first electrode member during the application of the second direct-current voltage.

8. The image forming apparatus according to claim 7, wherein the developing device is provided on a rotary support member, and wherein the detection mode execution unit rotates the rotary support member after the capacitance $C_1$ is detected and before the predetermined period, to move the toner in a region located upstream a contact position, at which the toner bearing member contacts the toner supply member, in a rotating direction of the toner supply member, to a region located downstream the contact position in the rotating direction of the toner supply member.

9. The image forming apparatus according to claim 1, wherein the developing device can change a posture thereof between a first posture and a second posture, the second posture having a height of a top of the toner supply member, the height which is different from a height of the top of the toner supply member of the first posture, with respect to a height of a top of the toner bearing member, and wherein the detection mode execution unit rotates the toner supply member at the first posture for a first predetermined time before the capacitance $C_1$ is detected, and rotates the toner supply member at the second posture for a second predetermined time during the predetermined period.

10. The image forming apparatus according to claim 9, wherein a rotation speed of the toner supply member at the first posture and a rotation speed of the toner supply member at the second posture are lower than a rotation speed of the toner supply member when the electrostatic latent image is developed.

11. The image forming apparatus according to claim 10, wherein the height of the top of the toner supply member at the second posture is lower than the height of the top of the toner supply member at the first posture, with respect to the height of the top of the toner bearing member.

12. The image forming apparatus according to claim 10, wherein the developing device is provided on a rotary support member, and wherein, in response to the rotary support member being rotated, the posture of the developing device is changed from the first posture to the second posture.

13. The image forming apparatus according to claim 1, wherein the developing device is provided on a rotary support member, wherein the detection mode execution unit rotates the toner supply member for a first predetermined time before the capacitance $C_1$ is detected, wherein the first predetermined time allows a reduction ratio of the toner amount in the foam layer with respect to a rotation time of the toner supply member to be smaller than a predetermined value, wherein the detection mode execution unit rotates the rotary support member until the posture of the developing device becomes a predetermined posture after the capacitance $C_1$ is detected and before the predetermined period, to move the toner in a region located upstream a contact position, at which the toner bearing member contacts the toner supply member, in a rotating direction of the toner supply member, to a region located downstream the contact position in the rotating direction of the toner supply member, and wherein the detection mode execution unit rotates the toner supply member at the predetermined posture for a second predetermined time during the predetermined period, to cause the toner amount in the foam layer to be larger than the toner amount in the foam layer when the capacitance $C_1$ is detected.

14. The image forming apparatus according to claim 1, wherein the developing device is provided on a rotary support member, and wherein the detection mode execution unit rotates the rotary support member until the posture of the developing device becomes a predetermined posture before the capacitance $C_1$ is detected, to move the toner in a region located upstream a contact position, at which the toner bearing member contacts the toner supply member, in a rotating direction of the toner supply member, to a region located downstream the contact position in the rotating direction of the toner supply member, and then rotates the toner supply member at the predetermined posture for a first predetermined time, and wherein the detection mode execution unit rotates the toner supply member at the predetermined posture for a second predetermined time during the predetermined period, to cause the toner amount in the foam layer to be different from the toner amount in the foam layer when the capacitance $C_1$ is detected.

15. The image forming apparatus according to claim 1, wherein the developing device is provided on a rotary support member, and wherein the detection mode execution unit rotates the rotary support member until a posture of the developing device becomes a predetermined posture, to move the toner in a region located upstream a contact position, at which the toner bearing member contacts the toner supply member, in a rotating direction of the toner supply member, to a region located downstream the contact position in the rotating direction of the toner supply member, and then detects a capacitance between the first and second electrode members three times or more while rotating the toner supply member at the predetermined posture until a reduction ratio of the capacitance becomes smaller than a predetermined value, and wherein, in response to $|C_1-C_2|$ being smaller than a threshold and $C_2$ being a lowest capacitance and $C_1$ being a highest capacitance from among the capacitances detected by the detection mode execution unit, the notice signal generating unit generates the notice signal.

16. An image forming apparatus comprising:

a developing device including a container that has an opening and contains a toner, a toner bearing member arranged at the opening of the container, having a first electrode member, and supplying an electrostatic latent image with the toner by bearing and conveying the toner, and a toner supply member arranged in the container and having a second electrode member and a foam layer, wherein the foam layer is provided around the second electrode member, wherein the developing device supplies the toner bearing member with the toner in the container by rotating the toner supply member in a contact manner with the toner bearing member;

a mount portion on which the developing device is mounted in a replaceable manner;

a detection mode execution unit configured to execute a detection mode in which a predetermined period for changing a toner amount in the foam layer by rotating the toner supply member is provided, a capacitance $C_1$ between the first and second electrode members is detected before the predetermined period, and a capacitance $C_2$ between the first and second electrode members is detected after the predetermined period; and a notice signal generating unit configured to generate a notice signal in response to an absolute value $|C_1-C_2|$ of a difference between the capacitances $C_1$ and $C_2$ being smaller than a predetermined threshold, wherein the notice signal prompts replacement of the developing device.

17. The image forming apparatus according to claim 16, wherein the detection mode execution unit rotates the toner supply member at a first speed for a first predetermined time before the capacitance $C_1$ is detected, and rotates the toner supply member at a second speed for a second predetermined time during the predetermined period, wherein the second speed is different from the first speed.

18. The image forming apparatus according to claim 17, wherein the second speed is lower than the first speed.

19. The image forming apparatus according to claim 18, wherein the developing device is provided on a rotary support member, and wherein the detection mode execution unit rotates the rotary support member after the capacitance $C_1$ is detected and before the predetermined period, to move the toner in a region located upstream a contact position, at which the toner bearing member contacts the toner supply member, in a rotating direction of the toner supply member, to a region located downstream the contact position in the rotating direction of the toner supply member.

20. The image forming apparatus according to claim 18, wherein the predetermined time at a higher speed of the first and second speeds is shorter than the predetermined time at a lower speed.

21. The image forming apparatus according to claim 16, wherein the detection mode execution unit rotates the toner supply member for a first predetermined time while applying a first direct-current voltage between the first and second electrode members before the capacitance $C_1$ is detected, and rotates the toner supply member for a second predetermined time while applying a second direct-current voltage between the first and second electrode members during the predetermined period, wherein the second direct-current voltage is different from the first direct-current voltage.

22. The image forming apparatus according to claim 21, wherein the detection mode execution unit applies the first and second direct-current voltages such that a value of $(V_a-V_b)-(V_c-V_d)$ is homopolar with a normal charge polarity of the toner, where $V_a$ is a potential of the second electrode member and $V_b$ is a potential of the first electrode member during the application of the first direct-current voltage, and $V_c$ is a potential of the second electrode member and $V_d$ is a potential of the first electrode member during the application of the second direct-current voltage.

23. The image forming apparatus according to claim 22, wherein the developing device is provided on a rotary support member, and wherein the detection mode execution unit rotates the rotary support member after the capacitance $C_1$ is detected and before the predetermined period, to move the toner in a region located upstream a contact position, at which the toner bearing member contacts the toner supply member, in a rotating direction of the toner supply member, to a region located downstream the contact position in the rotating direction of the toner supply member.

24. The image forming apparatus according to claim 16, wherein the developing device can change a posture thereof between a first posture and a second posture, the second posture having a height of a top of the toner supply member, the height which is different from a height of the top of the toner supply member of the first posture, with respect to a height of a top of the toner bearing member, and wherein the detection mode execution unit rotates the toner supply member at the first posture for a first predetermined time before the capacitance $C_1$ is detected, and rotates the toner supply member at the second posture for a second predetermined time during the predetermined period.

25. The image forming apparatus according to claim 24, wherein a rotation speed of the toner supply member at the first posture and a rotation speed of the toner supply member at the second posture are lower than a rotation speed of the toner supply member when the electrostatic latent image is developed.

26. The image forming apparatus according to claim 25, wherein the height of the top of the toner supply member at the second posture is lower than the height of the top of the toner supply member at the first posture, with respect to the height of the top of the toner bearing member.

27. The image forming apparatus according to claim 25, wherein the developing device is provided on a rotary support member, and wherein, in response to the rotary support member being rotated, the posture of the developing device is changed from the first posture to the second posture.

28. The image forming apparatus according to claim 16, wherein the developing device is provided on a rotary support member, wherein the detection mode execution unit rotates the toner supply member for a first predetermined time before the capacitance $C_1$ is detected, wherein the first predetermined time allows a reduction ratio of the toner amount in the foam layer with respect to a rotation time of the toner supply member to be smaller than a predetermined value, wherein the detection mode execution unit rotates the rotary support member until the posture of the developing device becomes a predetermined posture after the capacitance $C_1$ is detected and before the predetermined period, to move the toner in a region located upstream a contact position, at which the toner bearing member contacts the toner supply member, in a rotating direction of the toner supply member, to a region located downstream the contact position in the rotating direction of the toner supply member, and wherein the detection mode execution unit rotates the toner supply member at the predetermined posture for a second predetermined time during the predetermined period, to cause the toner amount in the foam layer to be larger than the toner amount in the foam layer when the capacitance $C_1$ is detected.

29. The image forming apparatus according to claim 16, wherein the developing device is provided on a rotary support member, and wherein the detection mode execution unit rotates the rotary support member until the posture of the developing device becomes a predetermined posture before the capacitance $C_1$ is detected, to move the toner in a region located upstream a contact position, at which the toner bearing member contacts the toner supply member, in a rotating direction of the toner supply member, to a region located downstream the contact position in the rotating direction of the toner supply member, and then rotates the toner supply member at the predetermined posture for a first predetermined time, and wherein the detection mode execution unit rotates the toner supply member at the predetermined posture for a second predetermined time during the predetermined period, to cause the toner amount in the foam layer to be different from the toner amount in the foam layer when the capacitance $C_1$ is detected.

30. The image forming apparatus according to claim 16, wherein the developing device is provided on a rotary support member, and wherein the detection mode execution unit rotates the rotary support member until a posture of the developing device becomes a predetermined posture, to move the toner in a region located upstream a contact position, at which the toner bearing member contacts the toner supply member, in a rotating direction of the toner supply member, to a region located downstream the contact position in the rotating direction of the toner supply member, and then detects a capacitance between the first and second electrode members three times or more while rotating the toner supply member at the predetermined posture until a reduction ratio of the capacitance becomes smaller than a predetermined value, and wherein, in response to $|C_1-C_2|$ being smaller than a threshold and $C_2$ being a lowest capacitance and $C_1$ being a highest capacitance from among the capacitances detected by the detection mode execution unit, the notice signal generating unit generates the notice signal.

* * * * *